US011389352B2

(12) United States Patent
Connor

(10) Patent No.: US 11,389,352 B2
(45) Date of Patent: Jul. 19, 2022

(54) DEVICES AND METHODS TO HELP PREVENT DECUBITUS ULCERS

(71) Applicant: Sleepme Inc., Mooresville, NC (US)

(72) Inventor: Robert A. Connor, Burnsville, MN (US)

(73) Assignee: SLEEPME INC., Mooresville, NC (US)

( * ) Notice: Subject to any disclaimer, the term of this patent is extended or adjusted under 35 U.S.C. 154(b) by 0 days.

(21) Appl. No.: 16/826,197

(22) Filed: Mar. 21, 2020

(65) Prior Publication Data

US 2020/0315885 A1 Oct. 8, 2020

Related U.S. Application Data

(60) Provisional application No. 62/830,497, filed on Apr. 7, 2019.

(51) Int. Cl.

| | |
|---|---|
| ***A61G 7/00*** | (2006.01) |
| ***A61G 7/10*** | (2006.01) |
| ***A61G 7/057*** | (2006.01) |

(52) U.S. Cl.

CPC ..... *A61G 7/001* (2013.01); *A61G 7/057* (2013.01); *A61G 7/1055* (2013.01)

(58) Field of Classification Search

CPC ..... A61G 7/001; A61G 7/057; A61G 7/1055

See application file for complete search history.

(56) References Cited

U.S. PATENT DOCUMENTS

| | | | | |
|---|---|---|---|---|
| 4,799,276 | A | 1/1989 | Kadish | |
| 5,010,608 | A | 4/1991 | Barnett et al. | |
| 5,052,067 | A | 10/1991 | Thomas et al. | |
| 5,267,364 | A | 12/1993 | Volk | |
| 5,283,735 | A | 2/1994 | Gross et al. | |
| 5,659,905 | A * | 8/1997 | Palmer, Jr. | A61G 7/001 5/612 |
| 5,794,289 | A | 8/1998 | Wortman et al. | |
| 5,815,864 | A | 10/1998 | Sloop | |
| 5,963,997 | A | 10/1999 | Hagopian | |
| 6,560,804 | B2 | 5/2003 | Wise et al. | |
| 7,515,059 | B2 | 4/2009 | Price et al. | |
| 7,895,688 | B1 * | 3/2011 | Rowes | A61G 7/001 5/612 |
| 8,539,627 | B2 | 9/2013 | Terawaki et al. | |
| 8,719,980 | B2 | 5/2014 | Chen | |
| 8,726,908 | B2 | 5/2014 | Squitieri | |
| 8,752,222 | B2 | 6/2014 | Papaioannou | |
| 8,757,165 | B2 | 6/2014 | Squitieri | |
| 8,801,635 | B2 | 8/2014 | Hovorka | |
| 8,813,284 | B2 | 8/2014 | Teasdale et al. | |
| 8,893,338 | B2 | 11/2014 | McCausland et al. | |

(Continued)

*Primary Examiner* — Peter M. Cuomo
*Assistant Examiner* — Adam C Ortiz
(74) *Attorney, Agent, or Firm* — NEO IP

(57) ABSTRACT

This invention can help a person in bed to avoid decubitus ulcers. This device has a flexible body support structure (such as a sheet or blanket) which is automatically moved from a first configuration which is flat to a second configuration which enfolds and/or wraps around a person's body. The device turns a person from lying on their first side to lying on their opposite side by: enfolding the person in the support structure; rotating or pivoting the support structure; and then releasing the person by unfolding the support structure.

1 Claim, 10 Drawing Sheets

(56) References Cited

U.S. PATENT DOCUMENTS

| | | | |
|---|---|---|---|
| 8,898,842 | B2 | 12/2014 | Dennis |
| 9,015,885 | B2 | 4/2015 | Chapin |
| 9,149,401 | B2 | 10/2015 | Davenport et al. |
| 9,295,600 | B2 | 3/2016 | Receveur |
| 9,504,620 | B2 | 11/2016 | Soltani et al. |
| 9,693,916 | B2 | 7/2017 | Dennis |
| 9,711,029 | B2 | 7/2017 | Ribble et al. |
| 9,724,257 | B1 | 8/2017 | Chen et al. |
| 9,730,585 | B2 | 8/2017 | Hovorka |
| 9,763,841 | B2 | 9/2017 | Carlson et al. |
| 9,888,784 | B2 | 2/2018 | Chapin |
| 9,901,491 | B2 | 2/2018 | Squitieri |
| 9,931,238 | B2 | 4/2018 | Squitieri |
| 10,037,674 | B2 | 7/2018 | Ribble et al. |
| 10,039,488 | B2 | 8/2018 | Hermann et al. |
| 10,045,632 | B2 | 8/2018 | Chapin |
| 10,058,189 | B2 | 8/2018 | Petrov |
| 2009/0194115 | A1 | 8/2009 | Squitieri |
| 2010/0094175 | A1 | 4/2010 | Hovorka |
| 2010/0101026 | A1 | 4/2010 | Papaioannou |
| 2011/0263950 | A1 | 10/2011 | Larson et al. |
| 2013/0090571 | A1 | 4/2013 | Nourani et al. |
| 2013/0281804 | A1 | 10/2013 | Lee et al. |
| 2014/0103687 | A1 | 4/2014 | Carlson et al. |
| 2014/0290670 | A1 | 10/2014 | Squitieri |
| 2014/0350434 | A1 | 11/2014 | Hovorka |
| 2015/0128352 | A1 | 5/2015 | Papaioannou |
| 2015/0128354 | A1 | 5/2015 | Greenstein et al. |
| 2015/0164677 | A1 | 6/2015 | Squitieri |
| 2016/0022519 | A1 | 1/2016 | Soltani et al. |
| 2016/0037939 | A1 | 2/2016 | Petrov |
| 2016/0125716 | A1 | 5/2016 | Ribble et al. |
| 2016/0228050 | A1 | 8/2016 | Sugla et al. |
| 2016/0317370 | A1 | 11/2016 | Evans et al. |
| 2016/0324707 | A1 | 11/2016 | Lachenbruch et al. |
| 2017/0056264 | A1 | 3/2017 | Chapin |
| 2017/0128297 | A1 | 5/2017 | Cernasov et al. |
| 2017/0135632 | A1* | 5/2017 | Franceschetti ..... A61B 5/7271 |
| 2017/0270766 | A1 | 9/2017 | Ribble et al. |
| 2017/0348181 | A1 | 12/2017 | Perriard et al. |
| 2018/0061044 | A1 | 3/2018 | Woodbridge et al. |
| 2018/0160821 | A1 | 6/2018 | Chapin |
| 2018/0185205 | A1 | 7/2018 | Squitieri |
| 2018/0280219 | A1 | 10/2018 | Garrett et al. |
| 2018/0310719 | A1 | 11/2018 | Wiggermann |
| 2018/0311095 | A1 | 11/2018 | Bednarz et al. |
| 2018/0369040 | A1 | 12/2018 | Sheth |
| 2018/0369041 | A1 | 12/2018 | Sheth |
| 2019/0021918 | A1 | 1/2019 | Squitieri |
| 2019/0029903 | A1 | 1/2019 | Riley et al. |

* cited by examiner

DEVICES AND METHODS TO HELP PREVENT DECUBITUS ULCERS

CROSS-REFERENCE TO RELATED APPLICATIONS

This patent application claims the priority benefit of U.S. Provisional Patent Application No. 62/830,497 entitled "Devices and Methods to Help Prevent Decubitus Ulcers" by Robert A. Connor of Sleepnea LLC filed on Apr. 7, 2019. The entire contents of this related application are incorporated herein by reference.

FEDERALLY SPONSORED RESEARCH

Not Applicable

SEQUENCE LISTING OR PROGRAM

Not Applicable

BACKGROUND

Field of Invention

This invention relates to devices for reducing decubitus ulcers on people in bed.

INTRODUCTION

Decubitus ulcers (also known as pressure ulcers or bed sores) are localized areas of tissue damage and/or necrosis which are caused by prolonged pressure on the same tissue location, sheer friction on the tissue, localized high moisture level, incontinence or high perspiration, high temperature, poor blood circulation, anemia, infection, poor nutrition, inactivity or immobility, sensory impairment, and/or advanced age. Decubitus ulcers tend to form where there is prolonged external pressure on tissue at a bony prominence such as the sacrum, coccyx, hips, heels, ankles, knees, and elbows.

Decubitus ulcers can result in pain and suffering, open wounds, infection and sepsis, disability, amputation, and even death. The prevalence of decubitus ulcers among people in intensive care units and nursing homes continues to be high despite ongoing efforts toward prevention, with high associated costs in terms of human suffering as well as direct healthcare costs. There remains a significant need for development of better devices and methods to help prevent decubitus ulcers, especially with the aging population. This need is increasing due to the increase in the elderly population, economic constraints on human labor to turn patients from one side to the other, and the increase in contagious diseases. The devices and methods disclosed herein provide some innovative ways to help prevent decubitus ulcers.

REVIEW OF THE PRIOR ART

There are some innovative devices and methods in the prior art which seek to address the problem of decubitus ulcers. Some of these devices and methods include mattresses with arrays of individually inflatable cells which are adjusted to reduce areas of prolonged pressure on a reclining person's body. In some of the prior art, the operation of these inflatable cells is adjusted based on data from an array of pressure sensors which is incorporated into a mattress. However, there are limits to the amount of inter-cell variation in pressure against body tissue when cells are covered by a continuous sheet and/or when the upper surfaces of individual cells are interconnected. Also, it can be challenging to manage tissue moisture levels when the upper surfaces of inflatable cells are non-porous. The prior art also includes moving mattresses which automatically tilt to turn a person from lying on one side to the opposite side. However, it can be challenging to avoid abrupt movements (e.g. sudden "flopping over" movement) and/or having a person fall out of bed when a mattress automatically tilts. Specific examples of relevant prior art include the following.

U.S. Pat. No. 4,799,276 (Kadish, Jan. 24, 1989, "Body Rest with Means for Preventing Pressure Sores") discloses a bed with a matrix of vertical displaceable supports. U.S. Pat. No. 5,010,608 (Barnett et al., Apr. 30, 1991, "Support System for Reducing Formation of Decubitus Ulcers") discloses a system with cells that can be individually inflated and deflated. U.S. Pat. No. 5,052,067 (Thomas et al., Oct. 1, 1991, "Bimodal System for Pressurizing a Low Air Loss Patient Support") discloses a patient support system with a plurality of inflatable sacks. U.S. Pat. No. 5,267,364 (Volk, Dec. 7, 1993, "Therapeutic Wave Mattress") discloses a mattress with a plurality of inflatable tubular elements. U.S. Pat. No. 5,283,735 (Gross et al., Feb. 1, 1994, "Feedback System for Load Bearing Surface") discloses a chair or bed an array of pressure sensors.

U.S. Pat. No. 5,794,289 (Wortman et al., Aug. 18, 1998, "Mattress for Relieving Pressure Ulcers") discloses a mattress with a fabric strip bridging a foam crib to provide lateral stability when the mattress is tilted to turn a patient. U.S. Pat. No. 5,815,864 (Sloop, Oct. 6, 1998, "Microprocessor Controller and Method of Initializing and Controlling Low Air Loss Floatation Mattress") discloses a pressurization and control system for an air floatation mattress or cushion. U.S. Pat. No. 5,963,997 (Hagopian, Oct. 12, 1999, "Low Air Loss Patient Support System Providing Active Feedback Pressure Sensing and Correction Capabilities for Use as a Bed Mattress and a Wheelchair Seating System") discloses a therapeutic air support system with real time pressure adjustments.

U.S. Pat. No. 6,560,804 (Wise et al., May 13, 2003, "System and Methods for Mattress Control in Relation to Patient Distance") discloses a system for monitoring the distance between a patient and an inflatable air mattress and for controlling the air supply. U.S. Pat. No. 7,515,059 (Price et al., Apr. 7, 2009, "Patient Support Surface with Physiological Sensors") discloses a support surface with an air bladder and a sensor to detect a physiological parameter of a patient on the surface. U.S. Pat. No. 8,539,627 (Terawaki et al., Sep. 24, 2013, "Body Position and Pressure Control Apparatus") discloses a body position and pressure control apparatus for detecting body pressure distribution. U.S. Pat. No. 8,719,980 (Chen, May 13, 2014, "Pressure-Ulcer-Prevention Dynamic Cushion") discloses a multiple-phase dynamic cushion with clusters of interleaved strips.

U.S. Pat. No. 8,726,908 (Squitieri, May 20, 2014, "Enhanced Patient-Orienting Alternating Pressure Support Apparatus"), U.S. Pat. No. 9,931,238 (Squitieri, Apr. 3, 2018, "Enhanced Patient-Orienting Alternating Pressure Support Apparatus"), U.S. patent application 20140290670 (Squitieri, Oct. 2, 2014, "Enhanced Patient-Orienting Alternating Pressure Support Apparatus"), U.S. Pat. No. 8,757,165 (Squitieri, Jun. 24, 2014, "Patient-Orienting Alternating Pressure Support Apparatus with Lower Extremity Wedge"), U.S. Pat. No. 9,901,491 (Squitieri, Feb. 27, 2018, "Patient-Orienting Alternating Pressure Support Apparatus with Lower Extremity Wedge"), U.S. patent application 20150164677 (Squitieri, Jun. 18, 2015, "Patient-Orienting Alternating Pressure Support Apparatus with Lower Extremity Wedge"), and U.S. patent application 20180185205 (Squitieri, Jul. 5, 2018, "Patient-Orienting Alternating Pressure Support Apparatus with Lower Extremity Wedge") disclose systems to mitigate pressure by actively orienting a patient over an anatomy-specific pressure-mitigating contact surface.

U.S. Pat. No. 8,752,222 (Papaioannou, Jun. 17, 2014, "Adaptable Surface for Use in Beds and Chairs to Reduce Occurrence of Pressure Ulcers"), patent application 20100101026 (Papaioannou, Apr. 29, 2010, "Adaptable Surface for Use in Beds and Chairs to Reduce Occurrence of Pressure Ulcers") and patent application 20150128352 (Papaioannou, May 14, 2015, "Adaptable Surface for Use in Beds and Chairs to Reduce Occurrence of Pressure Ulcers") disclose an adaptable surface system with a plurality of individually adjustable surface units and a plurality of pressure sensors. U.S. Pat. No. 8,801,635 (Hovorka, Aug. 12, 2014, "Adjustable Pneumatic Supporting Surface"), U.S. Pat. No. 9,730,585 (Hovorka, Aug. 15, 2017, "Adjustable Pneumatic Supporting Surface"), U.S. patent application 20100094175 (Hovorka, Apr. 15, 2010, "Adjustable Pneumatic Supporting Surface") and U.S. patent application 20140350434 (Hovorka, Nov. 27, 2014, "Adjustable Pneumatic Supporting Surface") disclose an apparatus with a plurality of inflatable bladders which apply kinetic energy to human tissue.

U.S. Pat. No. 8,813,284 (Teasdale et al., Aug. 26, 2014, "Inflatable Component for an Alternating Pressure Mattress") discloses an inflatable mattress with at least two inflatable cells. U.S. Pat. No. 8,893,338 (McCausland et al., Nov. 25, 2014, "Inflatable Cellular Mattress with Alternating Zones of Inflated Cells") discloses a cushion or mattress with a plurality of linearly-aligned air cells. U.S. Pat. No. 8,898,842 (Dennis, Dec. 2, 2014, "Anti-Decubitus Ulcer Mattress Overlay System with Selective Elevation Structure") and U.S. Pat. No. 9,693,916 (Dennis, Jul. 4, 2017, "Anti-Decubitus Ulcer Mattress Overlay System with Selective Elevation Structure") an elevation structure system with multiple elongate, positionally-adjustable, relatively-moveable risers. U.S. Pat. No. 9,149,401 (Davenport et al., Oct. 6, 2015, "Support Apparatus for Preventing and/or Inhibiting Decubitus Ulcers") discloses an apparatus with a pair of frame supports which are spaced from each other.

U.S. Pat. No. 9,295,600 (Receveur, Mar. 29, 2016, "Person Support Apparatus with Activity and Mobility Sensing") discloses a person support apparatus with sensors to monitor changes in a person's position. U.S. Pat. No. 9,504,620 (Soltani et al., Nov. 29, 2016, "Method of Controlling a Pressurized Mattress System for a Support Structure") and U.S. patent application 20160022519 (Soltani et al., Jan. 28, 2016, "Method of Controlling a Pressurized Mattress System for a Support Structure") disclose a method for automatically varying the pressure in an air bladder in a zone of a pressurized mattress. U.S. Pat. No. 9,711,029 (Ribble et al., Jul. 18, 2017, "Equipment, Dressing and Garment Wireless Connectivity to a Patient Bed"), U.S. patent application 20160125716 (Ribble et al., May 5, 2016, "Equipment, Dressing and Garment Wireless Connectivity to a Patient Bed"), U.S. patent Ser. No. 10/037,674 (Ribble et al., Jul. 31, 2018, "Equipment, Dressing, and Garment Wireless Connectivity to a Patient Bed"), and U.S. patent application 20170270766 (Ribble et al., Sep. 21, 2017, "Equipment, Dressing, and Garment Wireless Connectivity to a Patient Bed") disclose a patient bed having a reader to read wireless signals, such as those from a wound dressing.

U.S. Pat. No. 9,724,257 (Chen et al., Aug. 8, 2017, "Anti-Bedsore Bed") discloses a bed unit with six supporting units arranged at positions corresponding to a user's upper, middle and lower back. U.S. Pat. No. 9,763,841 (Carlson et al., Sep. 19, 2017, "Apparatus and Method for Automatic Adjustment of a Support Surface with Interwoven Support Elements") and U.S. patent application 20140103687 (Carlson et al., Apr. 17, 2014, "Apparatus and Method for Automatic Adjustment of a Support Surface with Interwoven Support Elements") disclose an apparatus for adjusting the lengths of a plurality of interwoven support elements to conform to contours of a user's anatomy. U.S. patent Ser. No. 10/039,488 (Hermann et al., Aug. 7, 2018, "System and Method to Determine Tissue Compression") discloses a system to measure body tissue compression in a non-contact manner.

U.S. patent Ser. No. 10/045,632 (Chapin, Aug. 14, 2018, "Traveling Wave Air Mattresses and Method and Apparatus for Generating Traveling Waves Thereon"), U.S. Pat. No. 9,015,885 (Chapin, Apr. 28, 2015, "Traveling Wave Air Mattresses and Method and Apparatus for Generating Traveling Waves Thereon"), U.S. Pat. No. 9,888,784 (Chapin, Feb. 13, 2018, "Traveling Wave Air Mattresses and Method and Apparatus for Generating Traveling Waves Thereon"), and U.S. patent application 20180160821 (Chapin, Jun. 14, 2018, "Traveling Wave Air Mattresses and Method and Apparatus for Generating Traveling Waves Thereon") disclose a traveling wave air mattress apparatus with an array of laterally disposed, longitudinally spaced air bladder cells. U.S. patent Ser. No. 10/058,189 (Petrov, Aug. 28, 2018, "Active Multicompartmental Pressure Redistribution System") and patent application 20160037939 (Petrov, Feb. 11, 2016, "Active Multicompartmental Pressure Redistribution System") disclose a multicompartmental pressure redistribution system that identifies contact body pressure points and redistributes pressure in real time.

U.S. patent application 20090194115 (Squitieri, Aug. 6, 2009, "Apparatus for Prevention and Treatment of Decubitus Ulcers") discloses a garment with a bladder to prevent and/or treat pressure ulcers. U.S. patent application 20110263950 (Larson et al., Oct. 27, 2011, "Systems, Devices and Methods for Preventing, Detecting and Treating Pressure-Induced Ischemia, Pressure Ulcers, and Other Conditions") discloses a system with sensors for monitoring pressure ulcers. U.S. patent application 20130090571 (Nourani et al., Apr. 11, 2013, "Methods and Systems for Monitoring and Preventing Pressure Ulcers") a pressure mapping system that records a patient's bed posture. U.S. patent application 20130281804 (Lee et al., Oct. 24, 2013, "Methods and Systems for Monitoring a Patient to Reduce the Incidence of Pressure Ulcers") discloses monitoring a patient using a sensor array disposed between the patient and a support surface.

U.S. patent application 20150128354 (Greenstein et al., May 14, 2015, "Methods, Circuits, Apparatuses and Assemblies for Providing a Mattress or Body Portion Support Cushion with a Sensor Layer") discloses a resting body support comprising a sensor layer in a mattress adjustment system. U.S. patent application 20160228050 (Sugla et al., Aug. 11, 2016, "System and Method for Prevention of Pressure Ulcers") discloses a system including a pressure sensor attached to a patient to prevent pressure ulcers. U.S. patent application 20160317370 (Evans et al., Nov. 3, 2016, "Cushion with Bladders Running Different Pressurization Modes Inside and Outside Dynamically Selected Target Bladder Group") discloses a responsive cushion system with a pressure adjustment system.

U.S. patent application 20160324707 (Lachenbruch et al., Nov. 10, 2016, "Multi-Mode Sacral Unloading Pressure Relief in a Patient Support Surface") discloses a mattress including a support bladder system and a rotation bladder system. U.S. patent application 20170056264 (Chapin, Mar. 2, 2017, "Soliton Traveling Wave Air Mattresses") discloses an air mattress with an array of air bladder cells that are individually inflatable and a wave generator. U.S. patent application 20170128297 (Cernasov et al., May 11, 2017, "Supporting Surface with Programmable Supports and Method to Reduce Pressure on Selected Areas of a Body") discloses a system to reduce pressure on selected body areas and at least one sensor to detect a physical property of the body. U.S. patent application 20170348181 (Perriard et al., Dec. 7, 2017, "System for Adjusting Pressure Locally on the Skin and Subcutaneous Tissue") discloses a system for adjusting pressure with a set of adjacent modules capable of changing shape.

U.S. patent application 20180061044 (Woodbridge et al., Mar. 1, 2018, "Method and System for Monitoring a User to Prevent Pressure Ulcers") discloses monitoring users to prevent pressure ulcers using imaging technologies to detect the user's posture. U.S. patent application 20180280219 (Garrett et al., Oct. 4, 2018, "Air Mattress Turning Device") discloses an apparatus comprising first and second sets of bladders for rotating a bed-ridden person. U.S. patent application 20180310719 (Wiggermann, Nov. 1, 2018, "Adaptable Mattress") discloses a mattress with a phase changeable component and a thermal management system. U.S. patent application 20180311095 (Bednarz et al., Nov. 1, 2018, "Pressure Redistribution System and Methods of Using Same") discloses a chair with a frame, a back cushion inflation system, and a plurality of back cushion air bladders.

U.S. patent application 20180369040 (Sheth, Dec. 27, 2018, "System and Method for Treating and Preventing Pressure Sores in Bedridden Patients") and U.S. patent application 20180369041 (Sheth, Dec. 27, 2018, "System and Method for Treating and Preventing Pressure Sores in Bedridden Patients") disclose a system with an array of expandable and collapsible supports to provide pressure relief to a patient. U.S. patent application 20190021918 (Squitieri, Jan. 24, 2019, "Non-Invasive Pressure-Mitigation Apparatuses for Improving Blood Flow and Associated Systems and Methods") discloses a pressure-mitigation apparatus with a series of chambers whose pressure can be individually varied. U.S. patent application 20190029903 (Riley et al., Jan. 31, 2019, "Person Support Apparatus Having Physiological Sensor") discloses a system with a frame, a support surface, and a sensor.

Despite these examples of innovation in the prior art to address decubitus ulcers, there is still a significant unmet clinical need for better devices and methods to prevent decubitus ulcers. This need is increasing due to the increase in the elderly population, economic constraints on human labor to turn patients from one side to the other, and the increase in contagious diseases. This invention helps to address some of the limitations of the prior art and to meet this increasing clinical need.

SUMMARY OF THIS INVENTION

This invention comprises novel devices and methods to help prevent decubitus ulcers on people who are in bed for prolonged periods of time. Turning a person from lying on one side to lying on their opposite side in bed can help to avoid decubitus ulcers. This can be done manually, but is labor intensive and can expose workers to contagious illness. The devices disclosed herein automatically turn a person from lying on one side to lying on their opposite side. In an example, such a device can include a flexible body support structure such as a sheet or blanket. The support structure can have a first configuration in which it is substantially flat and a second configuration in which it is folded or wrapped around a person's body. The device automatically moves the support structure from its first configuration to its second configuration, and vice versa.

In an example, a device for reducing decubitus ulcers can automatically turn a person from lying on their first side to lying on their opposite side by: (a) changing a flexible body support structure from a first (flat) configuration to a second configuration as the person is lying on their first side, thereby at least partially enfolding and/or wrapping the person in the support structure; (b) rotating, tilting, and/or pivoting the support structure relative to a longitudinal axis, thereby rotating, tilting, and/or pivoting the person within the support structure; and then (c) changing the support structure from the second configuration back to the first configuration, thereby unfolding or unwrapping the support structure and releasing the person to lay on their opposite side.

BRIEF INTRODUCTION TO THE FIGURES

FIGS. 1 and 2 show two views of the first device with a configuration-changing flexible body support structure at a first point in time—before the first device has been activated to move a person.

FIGS. 3 and 4 show two views of the first device at a second point in time—wherein the support structure has been moved from a first (flat) configuration to a second configuration in which it enfolds a reclining person lying on their first side.

FIGS. 5 and 6 show two views of the first device at a third point in time—wherein the support structure has been rotated, tilted, and/or pivoted, thereby rotating, tilting, and/or pivoting the person to face in an opposite direction.

FIGS. 7 and 8 show two views of the first device at a fourth point in time—wherein the support structure has been moved from its second configuration back to its first (flat) configuration, thereby releasing the person who is now lying on their opposite side.

FIGS. 9 through 12 show four additional side views (looking at the foot of a bed) of the first device corresponding to the four sequential times shown in FIGS. 1 through 8.

FIG. 9 shows the first device at a first time before the first device has been activated to move a person.

FIG. 10 shows the first device at a second time when the support structure has been moved from a first (flat) configuration to a second configuration in which it enfolds a reclining person lying on their first side.

FIG. 11 shows the first device at a third time when the support structure has been rotated, tilted, and/or pivoted, thereby rotating, tilting, and/or pivoting the person to face in an opposite direction.

FIG. 12 shows the first device at a fourth time when the support structure has been moved from its second configuration back to its first (flat) configuration, thereby releasing the person who is now lying on their opposite side.

FIG. 13 shows the second device at a first time before the second device has been activated to move a person.

FIG. 14 shows the second device at a second time when the support structure has been moved from a first (flat) configuration to a second configuration in which it enfolds a reclining person lying on their first side.

FIG. 15 shows the second device at a third time when the inflatable members have been inflated and the support structure has been rotated, tilted, and/or pivoted, thereby rotating, tilting, and/or pivoting the person to face in an opposite direction.

FIG. 16 shows the second device at a fourth time when the inflatable members have been deflated and the support structure has been moved from its second configuration back to its first (flat) configuration, thereby releasing the person who is now lying on their opposite side.

FIGS. 17 and 18 show two views of the third device with a configuration-changing flexible body support structure at a first point in time—before the third device has been activated to move a person.

FIGS. 19 and 20 show two views of the third device at a second point in time—wherein the support structure has been moved from a first (flat) configuration to a second configuration in which it enfolds a reclining person lying on their first side.

FIGS. 21 and 22 show two views of the third device at a third point in time—wherein the support structure has been rotated, tilted, and/or pivoted, thereby rotating, tilting, and/or pivoting the person to face in an opposite direction.

FIGS. 23 and 24 show two views of the third device at a fourth point in time—wherein the support structure has been moved from its second configuration back to its first (flat) configuration, thereby releasing the person who is now lying on their opposite side.

DETAILED DESCRIPTION OF THE FIGURES

FIGS. 1 through 12 show sequential views, from alternating perspectives, of an example of a device which helps a person in bed to avoid decubitus ulcers. This example comprises: a longitudinal flexible body support structure on which a person lies (wherein the support structure is selected from the group consisting of a sheet, blanket, pad, net, mesh, and hammock); wherein the support structure has a first configuration in which it is substantially flat and a second configuration in which it is folded (along a longitudinal axis) and/or wrapped at least partially around the person's body; and a plurality of actuators which change the support structure from its first configuration to its second configuration, or vice versa; wherein the person is moved from lying on their first side (e.g. their right side or left side) to lying on their opposite side (e.g. their left side if the first side is their right side or their right side if their first side is their left side) as follows—(a) activating the actuators to change the support structure from the first configuration to the second configuration as the person is lying on their first side, thereby at least partially enfolding the person in the support structure; (b) activating the actuators to rotate, tilt, and/or pivot the support structure relative to a longitudinal axis, thereby rotating, tilting, and/or pivoting the person within the support structure; and (c) activating the actuators to change the support structure from the second configuration to the first configuration, thereby unfolding or unwrapping the support structure and releasing the person to lay on their second side.

Figure 1:
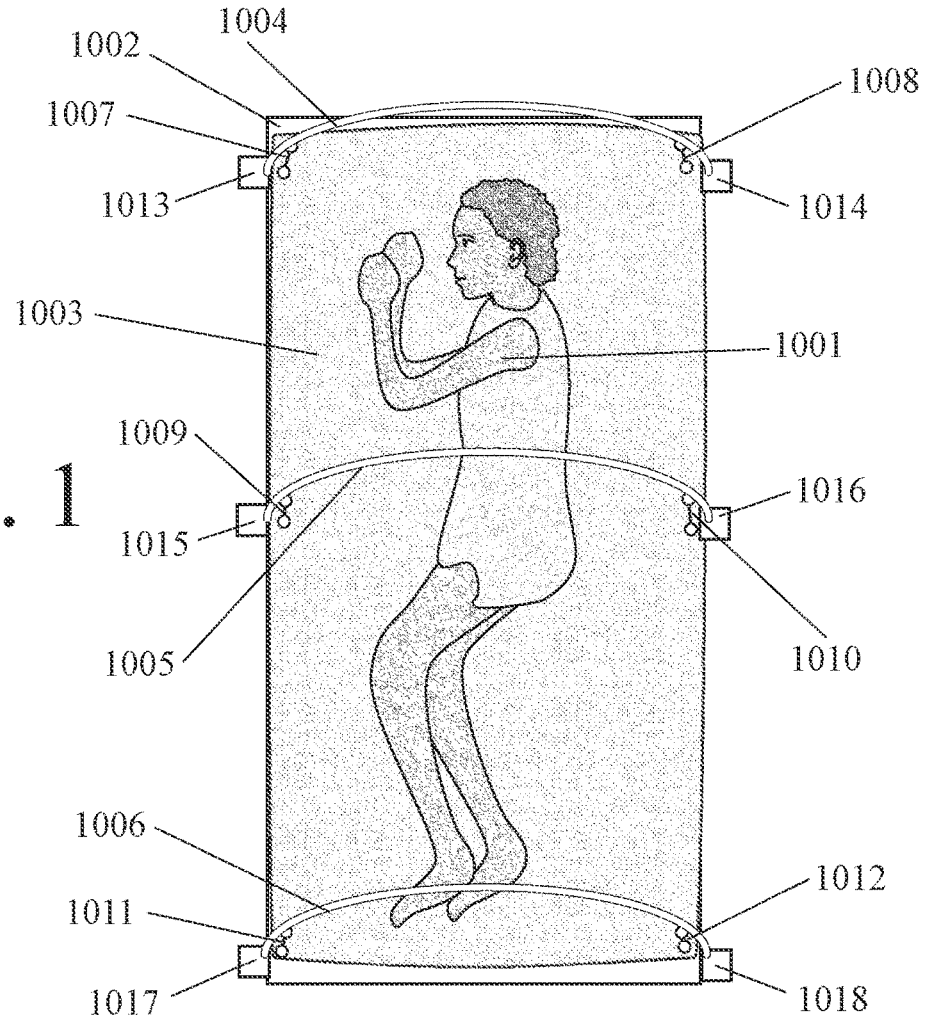
FIGS. 1 through 12 show sequential, different-perspective views of a first device, with a configuration-changing flexible body support structure attached to lateral arches, to help reduce decubitus ulcers on a person in bed.
Figure 2:
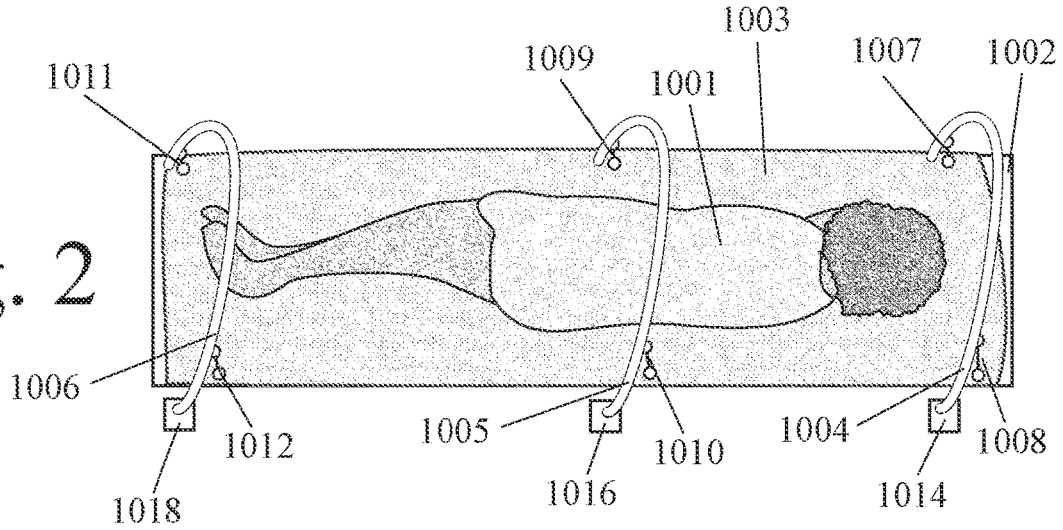

FIGS. 1 and 2 show top-down and oblique side views, respectively, of this example device at a first point in time. FIGS. 1 and 2 show a person 1001 lying on their right side on a flexible body support structure 1003. This support structure can be selected from the group consisting of: a sheet, a blanket, a pad, a net, a mesh, and a hammock. This support structure has a first configuration in which it is substantially flat as is shown in FIGS. 1 and 2. This support structure can also have a second configuration in which it is folded along a longitudinal axis and/or wrapped at least partially around the person's body as will be shown in subsequent figures.

FIGS. 1 and 2 also show a plurality of actuators (1013, 1014, 1015, 1016, 1017, and 1018) which change the support structure from its first configuration to its second configuration, or vice versa, as will be shown in subsequent figures. In this example, the device further comprises a mattress 1002 below the flexible body support structure. In this example, the device further comprises three lateral arches, ribs, beams, or arms (1004, 1005, and 1006) which span the mattress laterally (e.g. right to left). In this example, the device further comprises six connectors (1007, 1008, 1009, 1010, 1011, and 1012) which connect edges of the flexible body support structure to the three lateral arches, ribs, beams or arms. In this example, actuators move the connectors (e.g. right, left, up, and/or down) along the arches, ribs, beams or arms, thereby also moving the flexible body support structure which is attached to the connectors. In an example, the connectors can slide along channels or tracks in the arches, ribs, beams or arms.

FIGS. 1 and 2 show top-down and oblique side views, respectively, of this example device at a first point in time. At this first time, a person is lying on their first side (e.g. right side in this example) on the longitudinal flexible body support structure. This is before the device has been activated to move the person.

Figure 3:
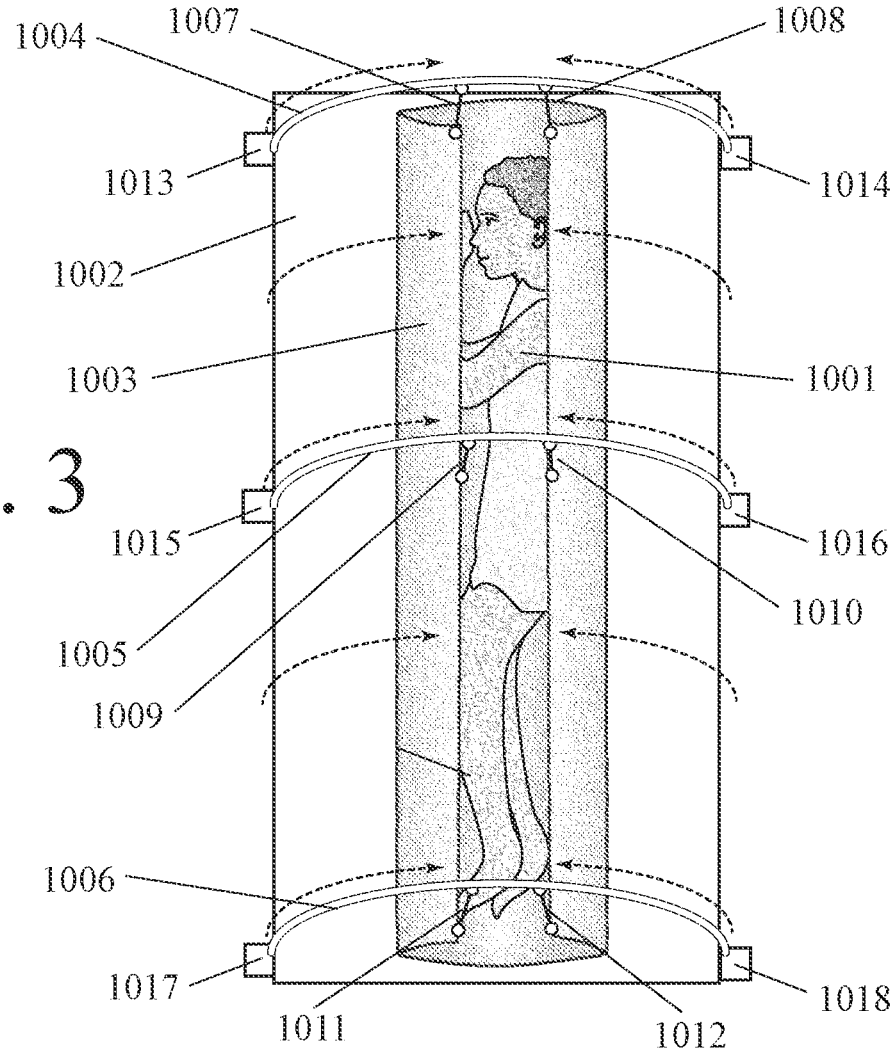
Figure 4:
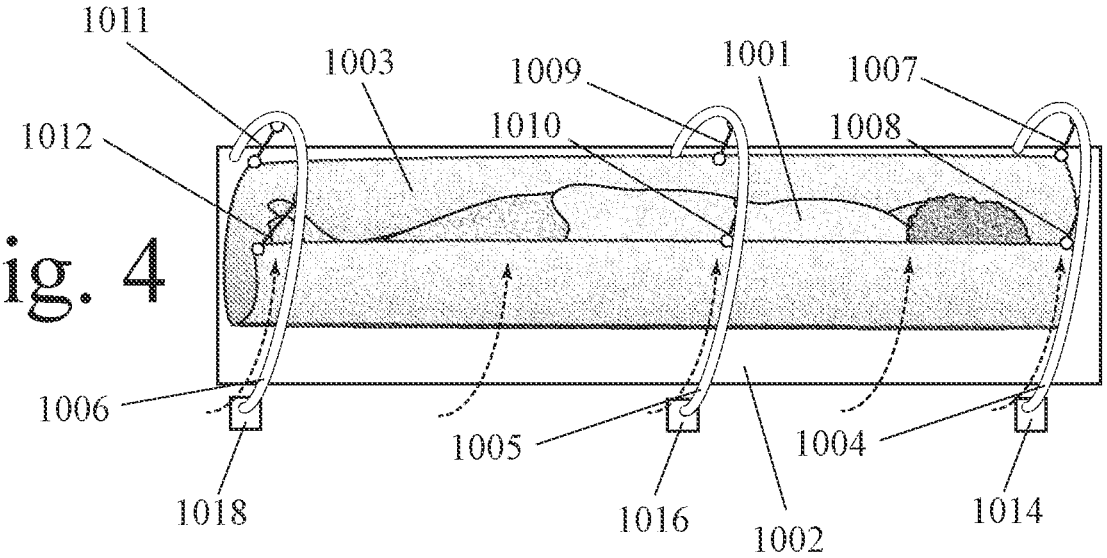

FIGS. 3 and 4 show top-down and oblique side views, respectively, of this example device at a second point in time. At this second time, the actuators have moved the support structure from its first (flat) configuration to its second (folded and/or wrapped) configuration. This at least partially enfolds or wraps the person in the support structure. In this example, this is done by having the actuators move the right-side and left-side connectors upward and inward along the arches, ribs, beams, or arms, toward a (central) longitudinal axis of the device. In an example, this can partially or completely lift the person off the mattress. In an example, this can hold the lateral axis of the person's torso in a substantially vertical orientation.

Figure 5:
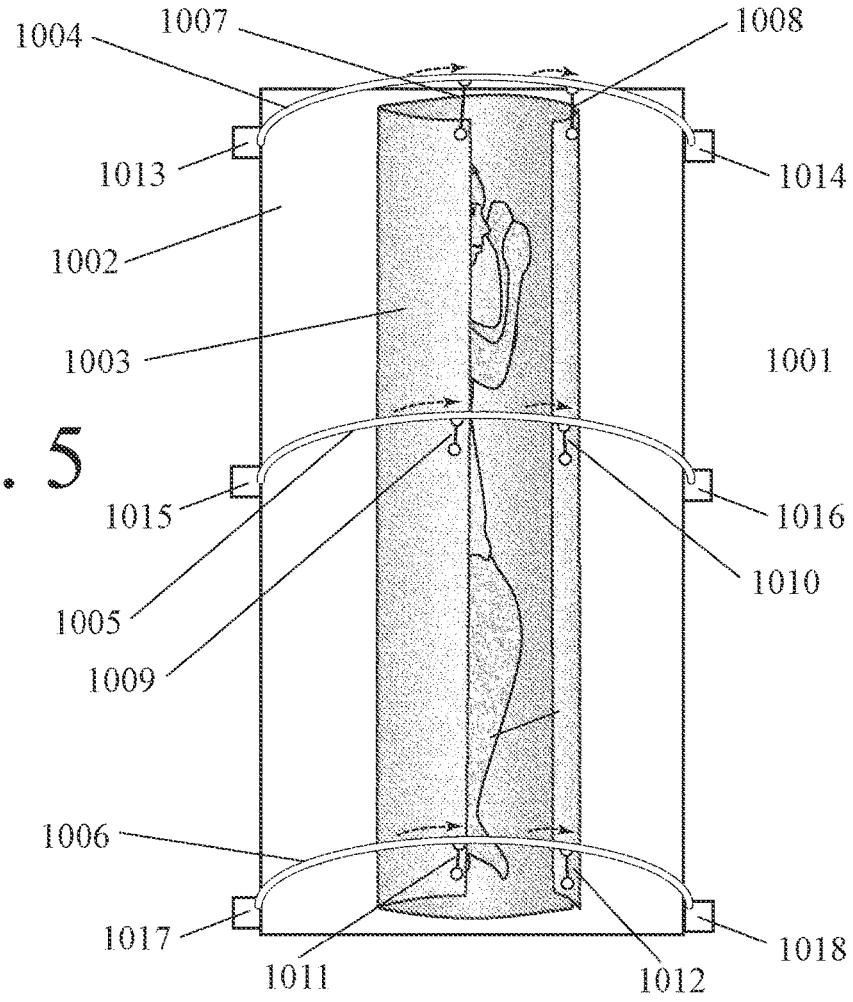
Figure 6:
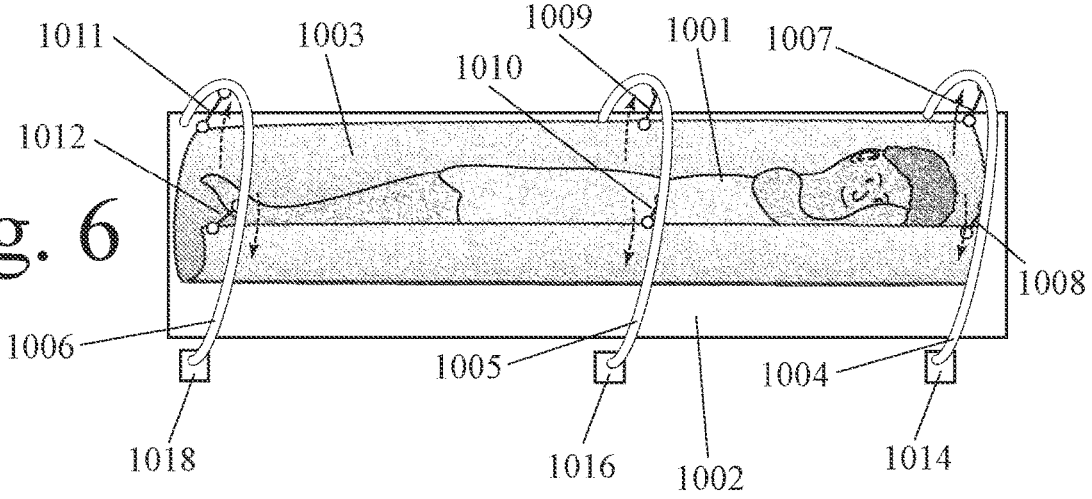

FIGS. 5 and 6 show top-down and oblique side views, respectively, of this example device at a third point in time. At this third time, the actuators have rotated, tilted, and/or pivoted the support structure relative to a (central) longitudinal axis of the support structure, thereby rotating, tilting, and/or pivoting the person within the support structure. This changes the direction in which the person faces from one side of the mattress (e.g. the left side) to the other side of the mattress (e.g. the right side).

Figure 7:
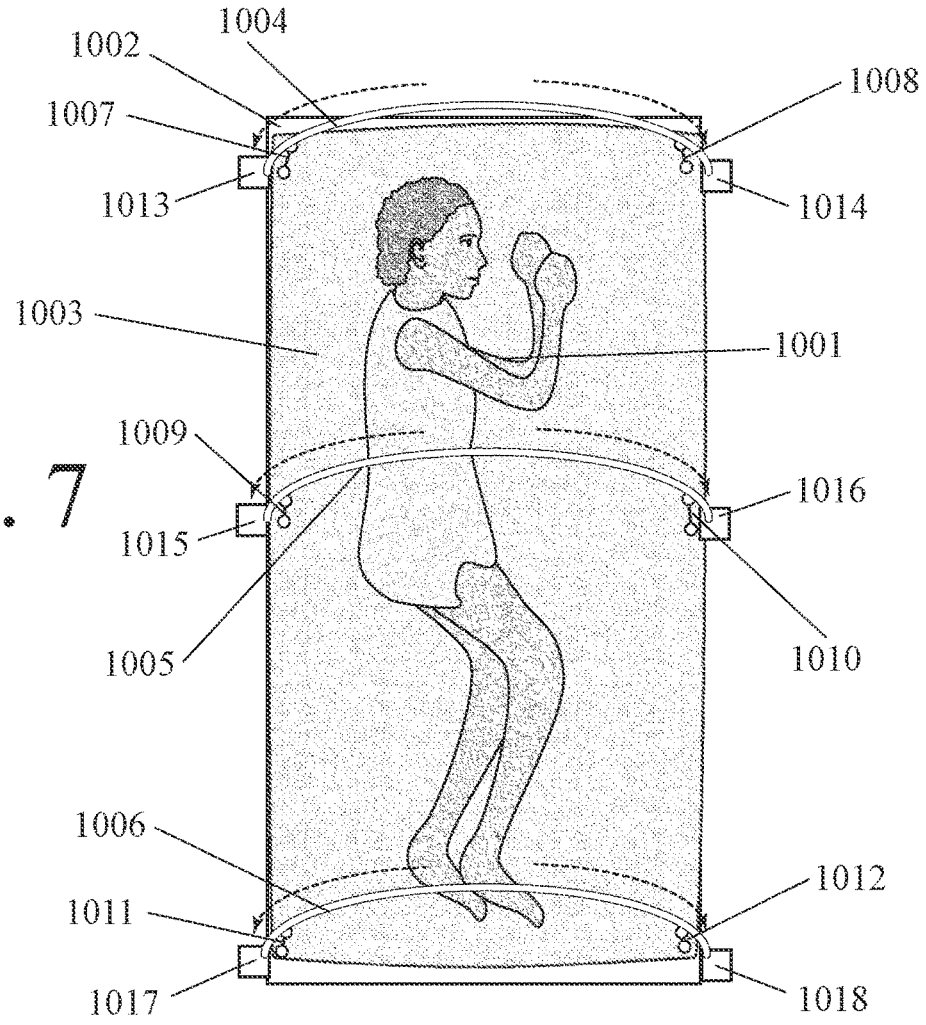
Figure 8:
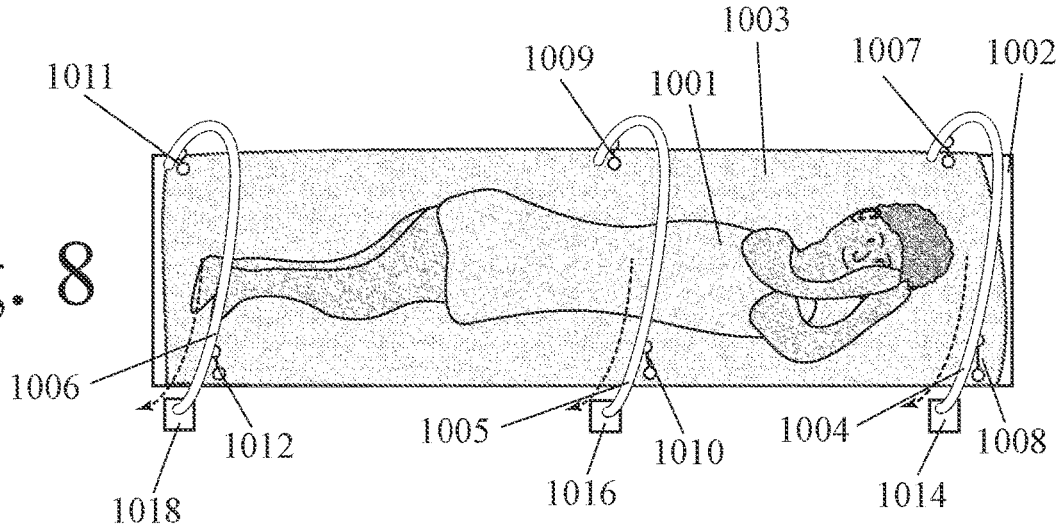

FIGS. 7 and 8 show top-down and oblique side views, respectively, of this example device at a fourth point in time. At this fourth time, the actuators have moved the support structure from its second (folded and/or wrapped) configuration back to its first (flat) configuration. This unfolds or unwraps the support structure and releases the person who is now lying on their left side.

The sequence of motions shown in FIGS. 1 through 8 shows how this device can automatically turn a person from lying on their first side (e.g. their right side in this example) to lying on their opposite side (e.g. their left side in this example). Such a device can also move (e.g. turn) a person in the opposite direction, from lying on their left side to lying on their right side, using a symmetric sequence of motions and/or configurations.

FIGS. 9 through 12 show additional views of the device and the sequence of motions which were just shown in FIGS. 1 through 8. FIGS. 9 through 12 show this device and this sequence from a different side perspective looking at the foot of the bed. FIGS. 9 through 12 show this device at the four points in time, respectively, corresponding to the four pairs of sequential top-down and oblique side views which were shown in FIGS. 1 through 8.

Figure 9:
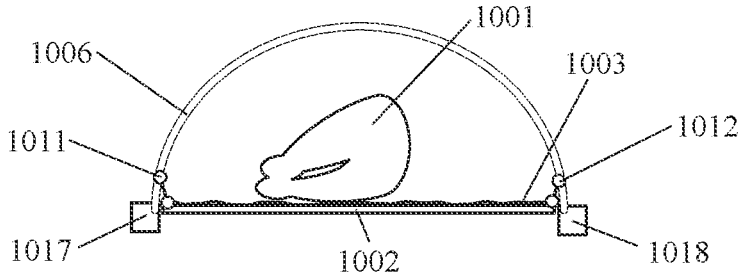
Figure 10:
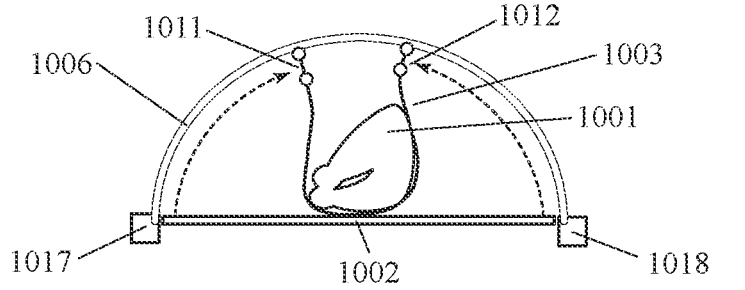
Figure 11:
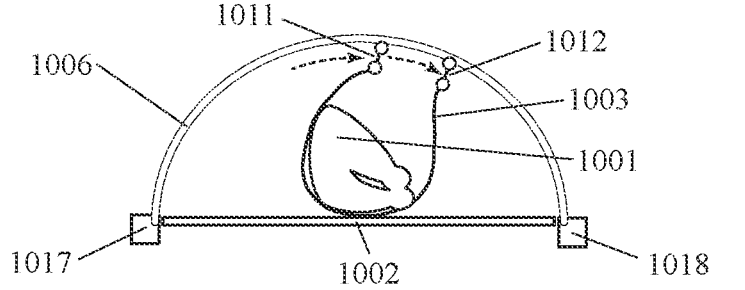
Figure 12:
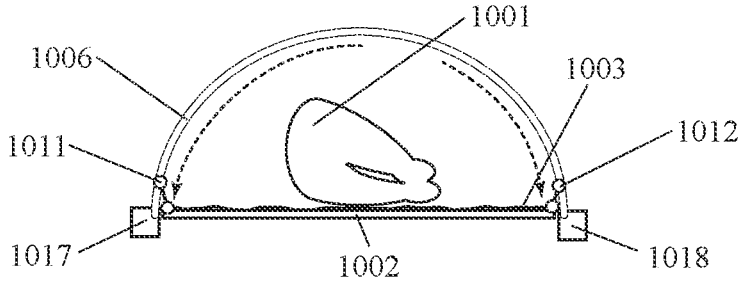

FIG. 9 shows a side view (looking at the foot of the bed) of a person lying on their right side at a first point in time, before the device is activated and before the person has been moved. FIG. 10 shows this side view (looking at the foot of the bed) of the person lying on their right side at a second point in time, after the device has been activated to lift up the sides of the support structure (e.g. sheet, blanket, pad, net, mesh, or hammock) so as to at least partially enfold and/or wrap the person within that support structure. FIG. 11 shows this side view (looking at the foot of the bed) of the person lying on their right side at a third point in time, after the device has been activated to rotate, tilt, and/or pivot the support structure, thereby rotating, tilting, and/or pivoting the person within the support structure. FIG. 12 shows this side view (looking at the foot of the bed) of the person lying on their right side at a fourth point in time, after the support structure has unfolded and/or unwrapped the person, thereby releasing the person to lay on their left side. Example variations discussed elsewhere in this disclosure or priority-linked disclosures can also be applied to this example where relevant.

In an example, a flexible body support structure can be a sheet or blanket. In an example, a flexible body support structure can be a mattress pad. In an example, a flexible body support structure can be a net or mesh. In an example, a flexible body support structure can be a hammock. In an example, a flexible body support structure can be rectangular or square. In an example, a flexible body support structure can have a rounded rectangular shape. In an example, a flexible body support structure can have an oval or elliptical shape. In an example, a flexible body support structure can be made from cotton, polyester, and/or nylon. In an example, a flexible body support structure can be sufficiently strong to enfold and lift a person (e.g. 100 to 300 pounds in weight), but also sufficiently porous that it does not obstruct breathing when close to the person.

In an example, a flexible body support structure can have lateral (e.g. left to right) variation in material, structure, strength, flexibility, durometer, porosity, and/or thickness. In an example, a flexible body support structure can be conceptually divided into multiple (e.g. three) longitudinal segments. In an example, a central and/or middle longitudinal segment can be made with a different (combination of) material than right and left side longitudinal segments. In an example, a central and/or middle longitudinal segment can have a different level of strength than right and left side longitudinal segments. In an example, a central and/or middle longitudinal segment can have a different level of flexibility than right and left side longitudinal segments. In an example, a central and/or middle longitudinal segment can have a different durometer level than right and left side longitudinal segments. In an example, a central and/or middle longitudinal segment can have a different porosity level than right and left side longitudinal segments. In an example, a central and/or middle longitudinal segment can have a different thickness than right and left side longitudinal segments.

In an example, a central and/or middle longitudinal segment can have a greater level of strength than right and left side longitudinal segments. In an example, a central and/or middle longitudinal segment can have a greater level of flexibility than right and left side longitudinal segments. In an example, a central and/or middle longitudinal segment can have a greater durometer level than right and left side longitudinal segments. In an example, a central and/or middle longitudinal segment can have a greater porosity level than right and left side longitudinal segments. In an example, a central and/or middle longitudinal segment can have a greater thickness than right and left side longitudinal segments.

In an example, a central and/or middle longitudinal segment can have a lower level of strength than right and left side longitudinal segments. In an example, a central and/or middle longitudinal segment can have a lower level of flexibility than right and left side longitudinal segments. In an example, a central and/or middle longitudinal segment can have a lower durometer level than right and left side longitudinal segments. In an example, a central and/or middle longitudinal segment can have a lower porosity level than right and left side longitudinal segments. In an example, a central and/or middle longitudinal segment can have a lower thickness than right and left side longitudinal segments.

In an example, a laterally-central portion of a body support structure can be made with a different (combination of) material than laterally-non-central portions of a body support structure. In an example, a laterally-central portion of a body support structure can have a different level of strength than laterally-non-central portions of a body support structure. In an example, a laterally-central portion of a body support structure can have a different level of flexibility than laterally-non-central portions of a body support structure. In an example, a laterally-central portion of a body support structure can have a different durometer level than laterally-non-central portions of a body support structure. In an example, a laterally-central portion of a body support structure can have a different porosity level than laterally-non-central portions of a body support structure. In an example, a laterally-central portion of a body support structure can have a different thickness than laterally-non-central portions of a body support structure.

In an example, a laterally-central portion of a body support structure can have a greater level of strength than laterally-non-central portions of a body support structure. In an example, a laterally-central portion of a body support structure can have a greater level of flexibility than laterally-non-central portions of a body support structure. In an example, a laterally-central portion of a body support structure can have a greater durometer level than laterally-non-central portions of a body support structure. In an example, a laterally-central portion of a body support structure can have a greater porosity level than laterally-non-central portions of a body support structure. In an example, a laterally-central portion of a body support structure can have a greater thickness than laterally-non-central portions of a body support structure.

In an example, a laterally-central portion of a body support structure can have a lower level of strength than laterally-non-central portions of a body support structure. In an example, a laterally-central portion of a body support structure can have a lower level of flexibility than laterally-non-central portions of a body support structure. In an example, a laterally-central portion of a body support structure can have a lower durometer level than laterally-non-central portions of a body support structure. In an example, a laterally-central portion of a body support structure can have a lower porosity level than laterally-non-central portions of a body support structure. In an example, a laterally-central portion of a body support structure can have a lower thickness than laterally-non-central portions of a body support structure.

In an example, a flexible body support structure can have multiple layers. In an example, a lower layer can be stronger than an upper layer. In an example, an upper layer can be softer (e.g. more flexible and/or lower durometer) than a lower layer. In an example, an upper layer can be more porous than a lower layer. In an example, an upper layer can be made from a different material than a lower layer. In an example, an upper layer can have a different thickness than a lower layer. In an example: an upper layer can be a relatively-soft sheet, blanket, or pad; and a lower layer can be a relatively strong net or mesh.

In an example, a lower layer of a body support structure can have a greater level of strength than an upper layer of a body support structure. In an example, a lower layer of a body support structure can have a greater level of flexibility than an upper layer of a body support structure. In an example, a lower layer of a body support structure can have a greater durometer level than an upper layer of a body support structure. In an example, a lower layer of a body support structure can have a greater porosity level than an upper layer of a body support structure. In an example, a lower layer of a body support structure can have a greater thickness than an upper layer of a body support structure.

In an example, a lower layer of a body support structure can have a lower level of strength than an upper layer of a body support structure. In an example, a lower layer of a body support structure can have a lower level of flexibility than an upper layer of a body support structure. In an example, a lower layer of a body support structure can have a lower durometer level than an upper layer of a body support structure. In an example, a lower layer of a body support structure can have a lower porosity level than an upper layer of a body support structure. In an example, a lower layer of a body support structure can have a lower thickness than an upper layer of a body support structure.

In an example, a device can have multiple lateral arches, ribs, beams, or arms which span over a flexible body support structure (and/or mattress) in a lateral (e.g. left to right) manner. In an example, a device can have multiple concave (e.g. downward opening) beams and/or arms which span over a flexible body support structure (and/or mattress) in a lateral (e.g. left to right) manner. In an example, a device can have three such lateral arches, ribs, beams, or arms. In an example, a device can have four or five lateral arches, ribs, beams, or arms. In an example, a device can have six or more lateral arches, ribs, beams, or arms which span over a mattress in a lateral (e.g. left to right) manner. In an example, the peak of a lateral arch, rib, beam, or arm can be between 2 and 4 feet above a flexible body support structure in its first (flat) configuration. In an example, the peak of a lateral arch, rib, beam, or arm can be between 3 and 5 feet above a flexible body support structure in its first (flat) configuration.

In an example, a lateral arch, rib, beam, or arm can be stationary, but there can be one or more moving connectors which slide along it (e.g. on a track or channel), wherein the one or more connectors are also connected to the flexible body support structure. In an example, a connector can comprise a strap, strip, cord, band, loop, hook, or chain. In an example, a connector can have a fixed length. In an example, a connector can have an (automatically) adjustable length. In an example, a connector can be elastic. In an example, a connector can slide along a track or channel on a lateral arch, rib, beam, or arm. In an example, a connector can comprise a loop which encircles and slides along a lateral arch, rib, beam, or arm (like a curtain slides along a curtain rod).

In an example, one or more connectors can be moved along an arch, rib, beam, or arm by one or more actuators. In an example, the lengths of one or more connectors can be changed by one or more actuators. In an example, an actuator can be an electromagnetic actuator. In an example, an actuator can be an electromagnetic motor. In an example, an actuator can pull, rotate, or otherwise move a cord, chain, link, or belt which, in turn, moves a connector. In an example, one or more actuators can be located on the right and/or left sides of the device (e.g. right and/or left sides of a mattress). In an example, one or more actuators can be within an arch, rib, beam, or arm. In an example, there can be one actuator for each connector. In an example, one actuator can move a plurality of connectors. In an alternative example, an actuator can be a hydraulic or pneumatic actuator.

In an example, sliding one or more connectors along one or more arches, ribs, beams, or arms changes the configuration of a flexible body support structure. In an example, sliding one or more connectors along one or more arches, ribs, beams, or arms changes the configuration of a flexible body support structure from a first (substantially flat) configuration to a second (folded or wrapped) configuration, or vice versa. In an example, a flexible body support structure in its first configuration can have a generally horizontal and linear cross-sectional shape (as viewed from the foot of the bed). In an example, a flexible body support structure in its second configuration can have a generally U-shaped, C-shaped, circular, or elliptical cross-sectional shape (as viewed from the foot of the bed).

In an example, moving a first connector and a second connector closer together along a lateral arch, rib, beam, or arm can draw the left side and the right side of a flexible body support structure closer together, thereby causing the flexible body support structure to at least partially enfold and/or wrap around a person on the flexible body support structure. In an example, moving both first and second connectors toward the center of a lateral arch, rib, beam, or arm can draw the left and right sides of a flexible body support structure closer together, thereby causing the flexible body support structure to at least partially enfold and/or wrap around a person on the flexible body support structure. In an example, moving both first and second connectors toward one side of a lateral arch, rib, beam, or arm can rotate, tilt, and/or pivot a folded flexible body support structure, thereby rotating, tilting, or pivoting the torso of a person enfolded and/or wrapped within the flexible body support structure. In an example, moving first and second connectors away from the center and toward the left and right sides, respectively, of a lateral arch, rib, beam, or arm can unfold and/or unwrap a flexible body support structure, thereby causing the flexible body support structure to release a person to lie on their side.

In an example, a lateral arch, rib, beam, or arm can be connected to a flexible body support structure by (a pair of) first and second connectors. In an example, these first and second connectors can be separated by a first distance when the flexible body support structure is in its first configuration and a second distance when the flexible body support structure is in its second configuration. In an example, the second distance can be less than the first distance. In an example, the second distance can be 1 to 2 feet less than the first distance. In an example, the second distance can be 1 to 4 feet less than the first distance. In an example, one or more actuators can slide first and second connectors up or down (and right or left) along a lateral arch, rib, beam, or arm. In an example, body support surface can comprise grommets along its sides to which connectors are attached. In an example, connectors can be sewn or woven into, or otherwise an integral part of, a body support surface.

In an example, a flexible body support structure can lift a person up off a mattress and shift them to the right or left before: rotating, tilting, or pivoting the person; and unfolding or unwrapping the person to lay on their other side. In an example, a flexible body support structure can lift a person up off the mattress and then shift them to the right or left in order to center them on a mattress before unfolding and releasing them to lay on their other side.

In an example, a device which helps a person in bed to avoid decubitus ulcers can comprise: a longitudinal flexible body support structure on which a person lies; wherein the support structure is selected from the group consisting of a sheet, blanket, pad, net, mesh, and hammock; wherein the support structure has a first configuration in which it is substantially flat and a second configuration in which it is folded along a longitudinal axis and/or wrapped at least partially around the person's body; and a plurality of actuators which change the support structure from its first configuration to its second configuration, or vice versa; wherein the person is moved from lying on their first side, wherein their first side is their right side or left side, to lying on their opposite side, wherein their opposite side is their left side if the first side is their right side or is their right side if their first side is their left side, as follows: (a) activating the actuators to change the support structure from the first configuration to the second configuration as the person is lying on their first side, thereby at least partially enfolding the person in the support structure; (b) activating the actuators to move the support structure, and thereby also move the person, laterally to the right or left; (c) activating the actuators to rotate, tilt, and/or pivot the support structure relative to a longitudinal axis, thereby rotating, tilting, and/or pivoting the person within the support structure; and (d) activating the actuators to change the support structure from the second configuration to the first configuration, thereby unfolding or unwrapping the support structure and releasing the person to lay on their second side.

In an alternative example, a device can have longitudinal arches, ribs, beams, and/or arms which longitudinally span a bed from head to foot (or vice versa). In an example, a flexible body support structure can be connected to longitudinal arches, ribs, beams, and/or arms by a plurality of connectors. In an example, a flexible body support structure can be directly attached to longitudinal arches, ribs, beams, and/or arms. In an example, channels in a flexible body support structure can slide onto longitudinal arches, ribs, beams, and/or arms. In an example, a plurality of longitudinal arches, ribs, beams, and/or arms can move and thereby move an attached flexible body support structure.

In an example, the left side (e.g. left edge) of a flexible body support surface can be attached to a first (left-side) longitudinal arch, rib, beam, and/or arm and the right side (e.g. right edge) of the support surface can be attached to a second (right-side) longitudinal arch, rib, beam, and/or arm. In an example, when the first (left-side) longitudinal arch, rib, beam, and/or arm is moved right toward the longitudinal center of the device and the second (right-side) longitudinal arch, rib, beam, and/or arm is moved left toward the longitudinal center of the device, then this changes the support surface from its first configuration to its second configuration—lifting the sides of the support surface and enfolding the person within the support surface. In an example, when the first (left-side) longitudinal arch, rib, beam, and/or arm is moved left away from the longitudinal center of the device and the second (right-side) longitudinal arch, rib, beam, and/or arm is moved right away from the longitudinal center of the device, then this changes the support surface from its second configuration back to its first configuration—lowering the sides of the support surface and letting the person down onto the support surface.

In an example, a plurality of longitudinal arches, ribs, beams, and/or arms can move laterally (e.g. left or right) with respect to a mattress and thereby move a flexible body support structure from its first configuration to its second configuration. In an example, a plurality of longitudinal arches, ribs, beams, and/or arms can rotate, tilt, and/or pivot around joints which are located at the head and foot of a bed. In an example, a plurality of longitudinal arches, ribs, beams, and/or arms can rotate, tilt, and/or pivot around joints which are centrally located at the head and foot of a bed.

In an example, this device can further comprise one or more sensors selected from the group consisting of: motion sensor (e.g. accelerometer, gyroscope, or inclinometer); pressure sensor; moisture and/or humidity sensor; and biological and/or chemical sensor; camera; infrared sensor; ultrasonic sensor; and spectroscopic sensor. In an example, one or more sensors can be attached to (or integrated into) a flexible body support structure. In an example, one or more sensors can be attached to (or integrated into) a mattress. In an example, one or more sensors can be attached to (or integrated into) a smart garment with which the device is in electromagnetic communication.

In an example, the device can be triggered to automatically turn a person (from lying one side to the other) when data from one or more sensors indicates a high risk of the person getting a decubitus ulcer if they are not turned. In an example, the device can be triggered to turn a person (from lying one side to the other) when data from one or more sensors indicates poor tissue oxygenation. In an example, a device can be triggered to prompt a person for permission to turn the person (from lying one side to the other) when data from one or more sensors indicates a high risk of the person getting a decubitus ulcer if they are not turned. In an example, a person can self-initiate and/or activate the device to turn the person from lying one side to the other. In an example, a person can self-initiate such turning with an oral command. In an example, a person can self-initiate such turning by touching a screen or pushing a button.

In an example, a device can be triggered to turn a person (from lying one side to the other) when data from a motion sensor indicates a high risk of the person getting a decubitus ulcer if they are not turned. In an example, a device can be triggered to turn a person (from lying one side to the other) when data from a pressure sensor indicates a high risk of the person getting a decubitus ulcer if they are not turned. In an example, a device can be triggered to turn a person (from lying one side to the other) when data from a moisture and/or humidity sensor indicates a high risk of the person getting a decubitus ulcer if they are not turned. In an example, a device can be triggered to turn a person (from lying one side to the other) when data from a biological and/or chemical sensor indicates a high risk of the person getting a decubitus ulcer if they are not turned.

In an example, a device can be triggered to turn a person (from lying one side to the other) when data from a camera indicates a high risk of the person getting a decubitus ulcer if they are not turned. In an example, a device can be triggered to turn a person (from lying one side to the other) when data from an infrared sensor (e.g. infrared scan) indicates a high risk of the person getting a decubitus ulcer if they are not turned. In an example, a device can be triggered to turn a person (from lying one side to the other) when data from an ultrasonic sensor (e.g. ultrasound scan) indicates a high risk of the person getting a decubitus ulcer if they are not turned. In an example, a device can be triggered to turn a person (from lying one side to the other) when data from a spectroscopic sensor indicates a high risk of the person getting a decubitus ulcer if they are not turned.

In an example, a device may only turn a person when the person consents for the device to do so. In an example, this consent can be verbal. In an example, a device can prompt a person, asking for their consent to turn the person, on a periodic basis. In an example, this periodic basis can be programmed. In example, periodic turning can be programmed with a first frequency while a person is awake and a second frequency while the person is asleep. In an example, the frequency with which a person is prompted for permission to turn the person can be changed based on data from one or more sensors selected from the group consisting of: motion sensor (e.g. accelerometer, gyroscope, or inclinometer); pressure sensor; moisture and/or humidity sensor; and biological and/or chemical sensor; camera; infrared sensor; ultrasonic sensor; and spectroscopic sensor. In an example, the frequency with which a person is prompted for permission to turn the person can be changed based on the degree of self-movement by the person as detected by sensors. In an example, the frequency with which a person is prompted for permission to turn the person can be changed based on changes in the posture and/or configuration of the person as detected by sensors.

In an example, a device can prompt a person for their consent to be moved (turned) and will not move (turn) the person from one side to the other without the person's (verbal) consent to do so. In an example, a device can prompt a person at periodic intervals and not move (turn) the person unless the device receives the person's (verbal) consent to do so. In an example, a device can be triggered by one or more (motion, location, pressure, moisture, or biological) sensors which indicate a high risk of a person getting a decubitus ulcer unless the person is moved (turned). In an example, a person's may have voluntary control of the device so the device does not move (turn) the person unless the person activates it to do so.

In an example, a device can further comprise safety mechanisms which protect a person from too much force or rapid movement during the turning process. In an example, a device can further comprise pressure sensors and/or motion sensors which adjust the operation of the device to ensure that a person is not enfolded or wrapped with too much pressure or force. In an example, a device can further comprise a microphone which monitors for breathing sounds to ensure that respiration is not harmed during the turning process and/or monitors for verbal commands to adjust or abandon the turning process.

FIGS. 13 through 16 show four sequential side views (looking at the foot of the bed) of another example of a device to help avoid decubitus ulcers. This example is like the example shown in FIGS. 1 through 12, except that it further comprises right-side and left-side inflatable members. These inflatable members can be selected from the group consisting of: inflatable cushion, pillow, wedge, compartment, mattress section, bladder, and balloon. Selective inflation and deflation of these members can help to rotate, tilt, and/or pivot the flexible body support structure in order to help turn the person from facing one direction (e.g. to the right) to facing the opposite direction (e.g. to the left).

In an example, selective inflation of one or more both of these inflatable members can push the lower portion of the folded and/or wrapped flexible body support structure (at the third point in time) to the right or left, thereby rotating, tilting, and/or pivoting the person's torso. In an example, selection inflation and deflation of the right-side and left-side inflatable members can push against the lower portion of the flexible body support structure to the right or left, while movement of connectors pulls the upper portion of the flexible body support structure to the left or right, thereby causing the body support structure to rotate, tilt, and/or pivot. This can rotate, tilt, and/or pivot the person's body from facing in one lateral direction (e.g. left) to facing in the opposite lateral direction (e.g. right).

FIGS. 13 through 16 show this device at four sequential points in time, respectively, analogous to the four pairs of sequential top-down and oblique side views shown in FIGS. 1 through 8, but also including right-side and left-side inflatable members.

FIGS. 13 through 16 show four sequential side views (looking at the foot of the bed) of an example of a device which helps a person in bed to avoid decubitus ulcers. This device comprises: a longitudinal flexible body support structure 1003 on which a person 1001 lies (wherein the support structure is selected from the group consisting of a sheet, blanket, pad, net, mesh, and hammock); a plurality of actuators (including 1017 and 1018); a right-side inflatable member 13002, wherein the right-side inflatable member is selected from the group consisting of an inflatable cushion, pillow, wedge, compartment, mattress section, bladder, and balloon; and a left-side inflatable member 13001, wherein the left-side inflatable member is selected from the group consisting of an inflatable cushion, pillow, wedge, compartment, mattress section, bladder, and balloon; wherein the person is moved from lying on their first side (wherein their first side is their right side or left side) to lying on their opposite side (wherein their opposite side is their left side if the first side is their right side or is their right side if their first side is their left side) as follows: (a) activating the actuators to lift the right and left sides of the support structure, thereby at least partially wrapping the person in the support structure; (b) inflating the right-side and/or left-side inflatable members such that one or both of the inflatable members push against one or both sides of the support structure, thereby tilting, pivoting, and/or rotating the person's body around a longitudinal axis; and (c) activating the actuators to lower the right and left sides of the support structure, thereby unwrapping the support structure from the person's torso and lowering the person down to lay on their opposite side.

In the example shown in FIGS. 13 through 16, the device further comprises a mattress 1002 below the flexible body support structure. In this example, the device also comprises arches, ribs, beams or arms (including 1006) which span the mattress laterally (e.g. right to left). In this example, the device also comprises connectors (including 1011 and 1012) which connect edges of the flexible body support structure to lateral arches, ribs, beams or arms. In this example, the device the actuators move the connectors (e.g. right, left, up, and/or down) along the arches, ribs, beams or arms, thereby also moving the flexible body support structure which is attached to the connectors. In an example, the connectors can slide along channels or tracks in the arches, ribs, beams or arms.

Figure 13:
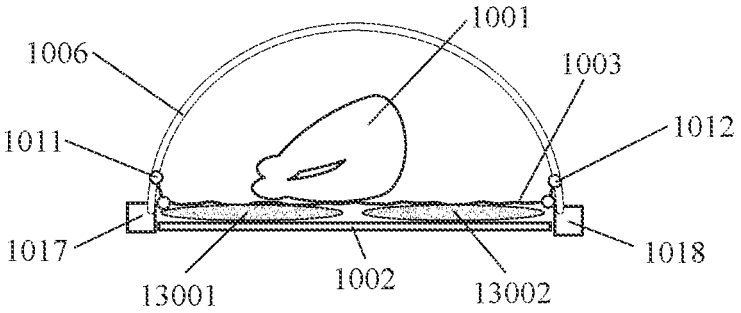
FIGS. 13 through 16 show four sequential side views of a second device, similar to the one in FIGS. 1 through 12, except that it further comprises right-side and left-side inflatable members which help to rotate, tilt, and/or pivot the flexible body support structure in its second configuration.
Figure 14:
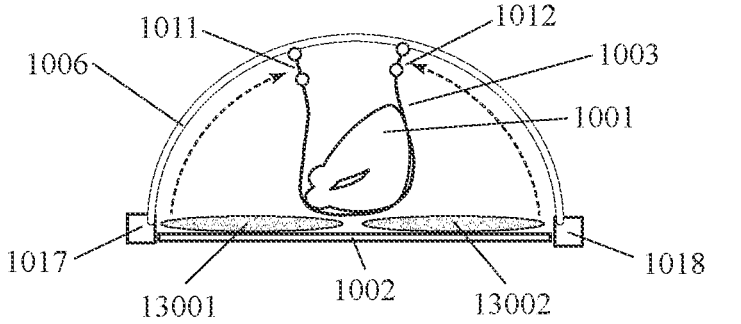
Figure 15:
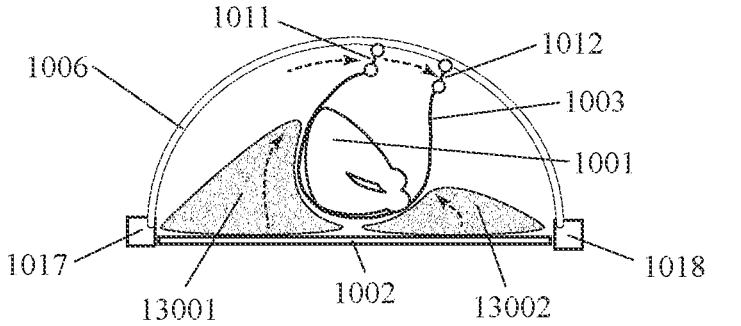
Figure 16:
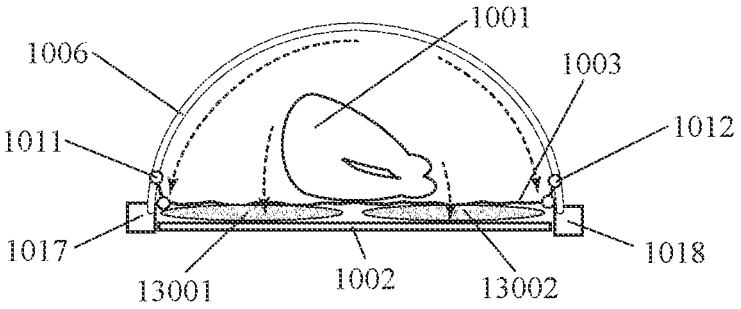

FIG. 13 shows a side view (looking at the foot of the bed) of a person lying on their right side at a first point in time, before the device is activated and before the person has been moved. FIG. 14 shows this side view (looking at the foot of the bed) of the person lying on their right side at a second point in time, after the device has been activated to lift up the sides of the support structure (e.g. sheet, a blanket, a pad, a net, a mesh, and a hammock) so as to at least partially enfold and/or wrap the person within that support structure. FIG. 15 shows this side view (looking at the foot of the bed) of the person lying on their right side at a third point in time, after the device has been activated to rotate, tilt, and/or pivot the support structure and the right-side and left-side inflatable members have been selectively inflated, thereby rotating, tilting, and/or pivoting the person within the support structure. FIG. 16 shows this side view (looking at the foot of the bed) of the person lying on their right side at a fourth point in time, after the inflatable members have been deflated and the support structure has unfolded and/or unwrapped the person, thereby releasing the person to lay on their left side.

In an example, a left-side inflatable member can be inflated more than a right-side inflatable member as a person is turned from lying on their right side to lying on their left side. In an example, a left-side inflatable member can be inflated more than a right-side inflatable member as a person is turned from lying on their right side to lying on their left side in order to rotate the person's torso in a clockwise direction (as viewed from the foot of the bed). In an example, a right-side inflatable member can be inflated more than a left-side inflatable member as a person is turned from lying on their left side to lying on their right side. In an example, a right-side inflatable member can be inflated more than a left-side inflatable member as a person is turned from lying on their left side to lying on their right side in order to rotate the person's torso in a counter-clockwise direction (as viewed from the foot of the bed).

In an example, a left-side inflatable member can be inflated less than a right-side inflatable member as a person is turned from lying on their right side to lying on their left side. In an example, a left-side inflatable member can be inflated less than a right-side inflatable member as a person is turned from lying on their right side to lying on their left side in order to rotate the person's torso in a clockwise direction (as viewed from the foot of the bed). In an example, a right-side inflatable member can be inflated less than a left-side inflatable member as a person is turned from lying on their left side to lying on their right side. In an example, a right-side inflatable member can be inflated less than a left-side inflatable member as a person is turned from lying on their left side to lying on their right side in order to rotate the person's torso in a counter-clockwise direction (as viewed from the foot of the bed).

In an example, a left-side inflatable member can be inflated more than a right-side inflatable member as a person is turned from lying on their right side to lying on their left side. In an example, a left-side inflatable member can be inflated more than a right-side inflatable member as a person is turned from lying on their right side to lying on their left side in order to rotate the person's torso in a counter-clockwise direction (as viewed from the foot of the bed). In an example, a right-side inflatable member can be inflated more than a left-side inflatable member as a person is turned from lying on their left side to lying on their right side. In an example, a right-side inflatable member can be inflated more than a left-side inflatable member as a person is turned from lying on their left side to lying on their right side in order to rotate the person's torso in a clockwise direction (as viewed from the foot of the bed).

In an example, a left-side inflatable member can be inflated less than a right-side inflatable member as a person is turned from lying on their right side to lying on their left side. In an example, a left-side inflatable member can be inflated less than a right-side inflatable member as a person is turned from lying on their right side to lying on their left side in order to rotate the person's torso in a counter-clockwise direction (as viewed from the foot of the bed). In an example, a right-side inflatable member can be inflated less than a left-side inflatable member as a person is turned from lying on their left side to lying on their right side. In an example, a right-side inflatable member can be inflated less than a left-side inflatable member as a person is turned from lying on their left side to lying on their right side in order to rotate the person's torso in a clockwise direction (as viewed from the foot of the bed).

If an example, an inflatable member on one side can be inflated first, and then the inflatable member on the other side can be inflated, as a person is turned from lying on one side to lie on their other side. In an example, a right-side inflatable member can be inflated as a left-side connector is moved (toward a central longitudinal axis of a mattress) in order to rotate, tilt, and/or pivot a person who is enfolded or wrapped within a folded flexible body support structure (in its second configuration). In an example, a left-side inflatable member can be inflated as a right-side connector is moved (toward a central longitudinal axis of a mattress) in order to rotate, tilt, and/or pivot a person who is enfolded or wrapped within a folded flexible body support structure (in its second configuration).

The example shown in FIGS. 13 through 16 includes right-side and left-side expandable members which are inflated or deflated with a gas. In an alternative example, right-side and left-side expandable members can be expanded or contracted by filling or draining a liquid. In this alternative example, right-side and left-side expandable members can be hydraulic members instead of inflatable members. Example variations discussed elsewhere in this disclosure or priority-linked disclosures can also be applied to this example where relevant.

FIGS. 17 through 24 show another example of a device to help avoid decubitus ulcers. This example is like the one shown in FIGS. 1 through 12, except that it has longitudinal arches, ribs, beams, or arms instead of lateral arches, ribs, beams, or arms. Also, the person wears a garment with pressure sensors. Also, in this example a flexible body support structure is directly attached to the arches, ribs, beams, or arms. The arches, ribs, beams, or arms move in order to change the flexible body support structure from its first (flat) configuration to its second (folded or wrapped) configuration.

FIGS. 17 through 24 show sequential views, from alternating perspectives, of an example of a device which helps a person in bed to avoid decubitus ulcers. This example comprises: a longitudinal flexible body support structure on which a person lies (wherein the support structure is selected from the group consisting of a sheet, blanket, pad, net, mesh, and hammock); wherein the support structure has a first configuration in which it is substantially flat and a second configuration in which it is folded along a longitudinal axis and/or wrapped at least partially around the person's body; and a plurality of actuators which change the support structure from its first configuration to its second configuration, or vice versa; wherein the person is moved from lying on their first side (wherein their first side is their right side or left side) to lying on their opposite side (wherein their opposite side is their left side if the first side is their right side or is their right side if their first side is their left side) as follows: (a) activating the actuators to change the support structure from the first configuration to the second configuration as the person is lying on their first side, thereby at least partially enfolding the person in the support structure; (b) activating the actuators to rotate, tilt, and/or pivot the support structure relative to a longitudinal axis, thereby rotating, tilting, and/or pivoting the person within the support structure; and (c) activating the actuators to change the support structure from the second configuration to the first configuration, thereby unfolding or unwrapping the support structure and releasing the person to lay on their second side.

Figure 17:
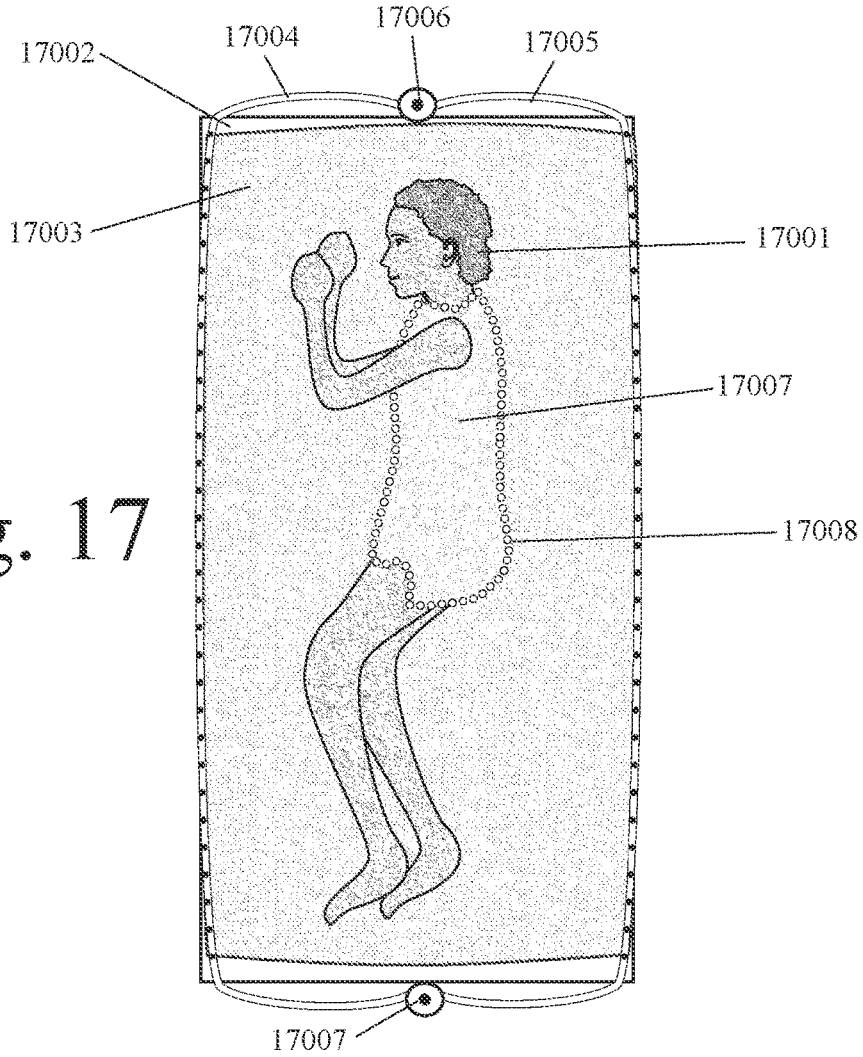
FIGS. 17 through 24 show sequential, different-perspective views of a third device, with a configuration-changing flexible body support structure attached to longitudinal arches, to help reduce decubitus ulcers on a person in bed.
Figure 18:
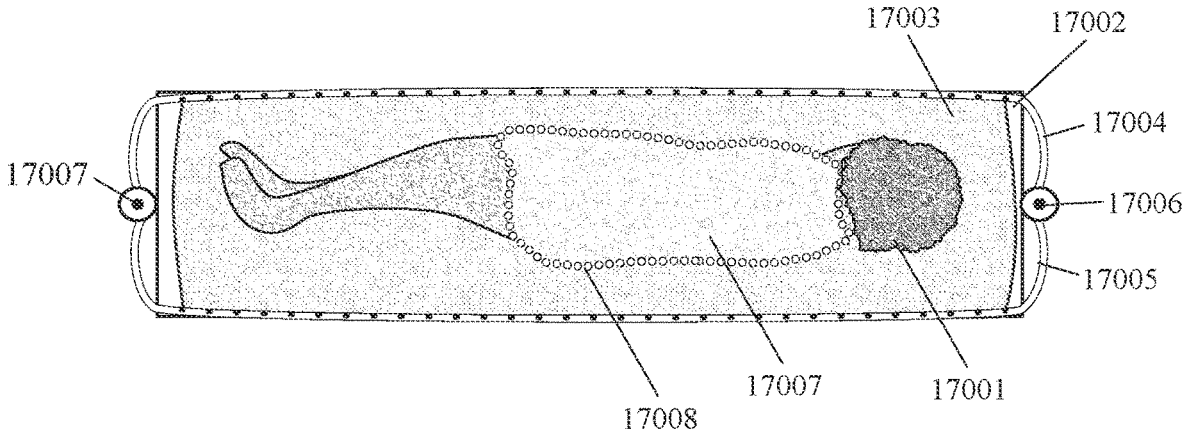

FIGS. 17 and 18 show top-down and oblique side views, respectively, of this example device at a first point in time. FIGS. 17 and 18 show a person 17001 lying on their right side on a flexible body support structure 17003. This support structure can be selected from the group consisting of: a sheet, a blanket, a pad, a net, a mesh, and a hammock. This support structure has a first configuration in which it is substantially flat as is shown in FIGS. 17 and 18. This support structure can also have a second configuration in which it is folded along a longitudinal axis and/or wrapped at least partially around the person's body as will be shown in subsequent figures.

In the example shown in FIGS. 17 and 18, the device further comprises a mattress 17002 below the flexible body support structure. In this example, the device further comprises two longitudinal arches, ribs, beams or arms 17004 and 17005 which are rotated, tilted, and/or pivoted by actuators 17006 and 17007. In this example, a flexible body support structure is directly attached to the longitudinal arches, ribs, beams or arms. In this example, the actuators move the arches, ribs, beams or arms, thereby also moving the flexible body support structure. The person wears a garment 17007 with pressure sensors 17008.

FIGS. 17 and 18 show top-down and oblique side views, respectively, of this example device at a first point in time. At this first time, the person is lying on their first side (e.g. right side in this example) on the longitudinal flexible body support structure. This is before the device has been activated to move the person.

Figure 19:
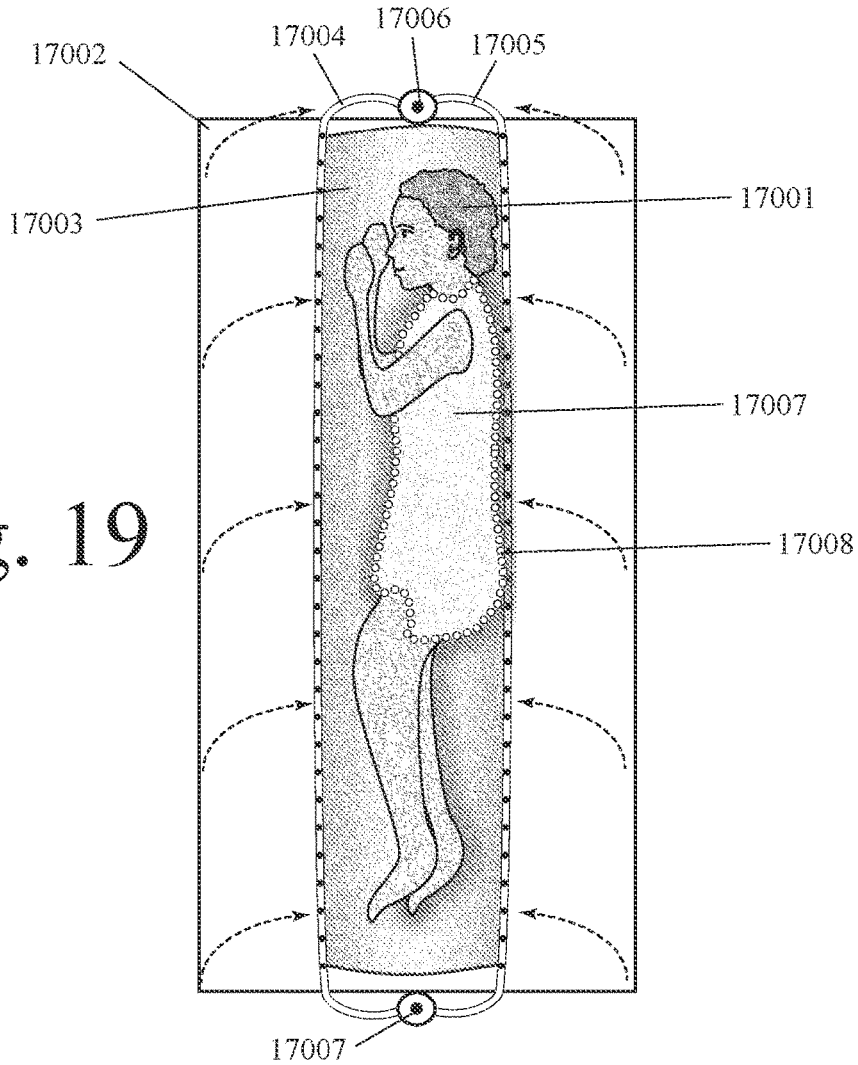
Figure 20:
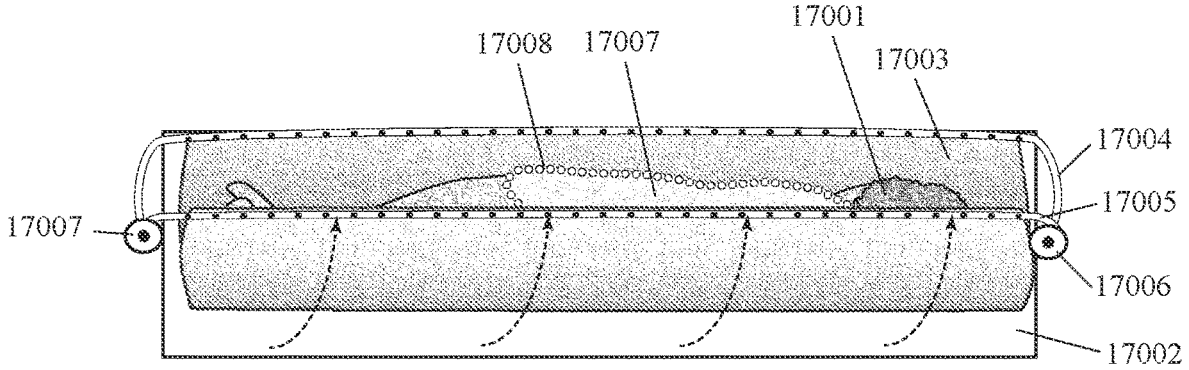

FIGS. 19 and 20 show top-down and oblique side views, respectively, of this example device at a second point in time. At this second time, the actuators have moved the two arches, ribs, beams or arms toward the center of the mattress. This at least partially enfolds or wraps the person in the support structure. In an example, this can partially or completely lift the person off the mattress. In an example, this can hold the lateral (right to left) axis of the person's torso in a substantially vertical orientation.

Figure 21:
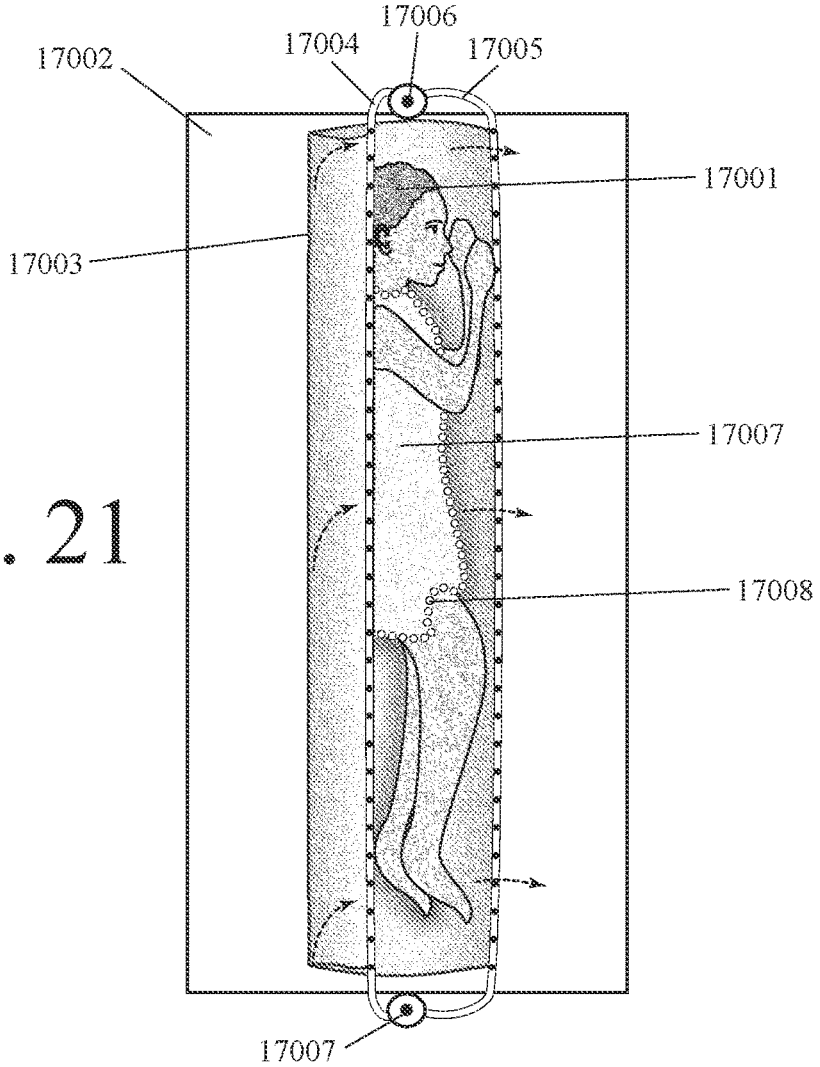
Figure 22:
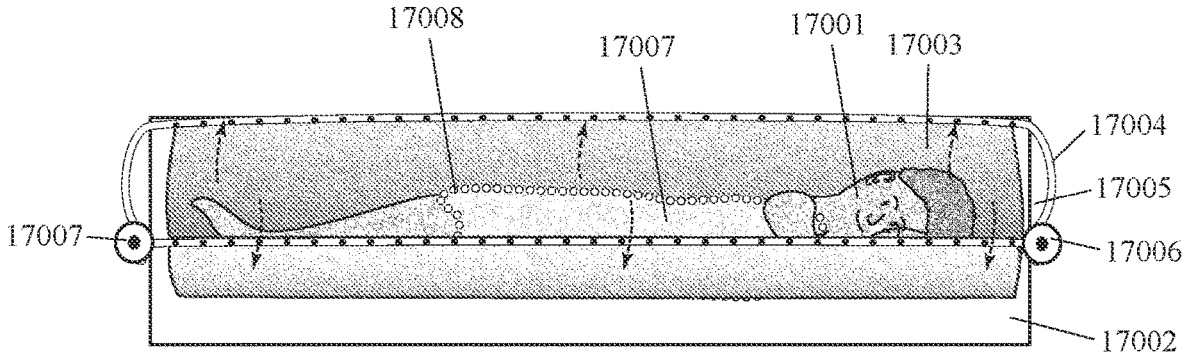

FIGS. 21 and 22 show top-down and oblique side views, respectively, of this example device at a third point in time. At this third time, the actuators have rotated, tilted, and/or pivoted the support structure relative to a (central) longitudinal axis of the support structure, thereby rotating, tilting, and/or pivoting the person within the support structure. This changes the direction in which the person faces from facing toward one side of the mattress (e.g. the left side) to facing toward the other side of the mattress (e.g. the right side).

Figure 23:
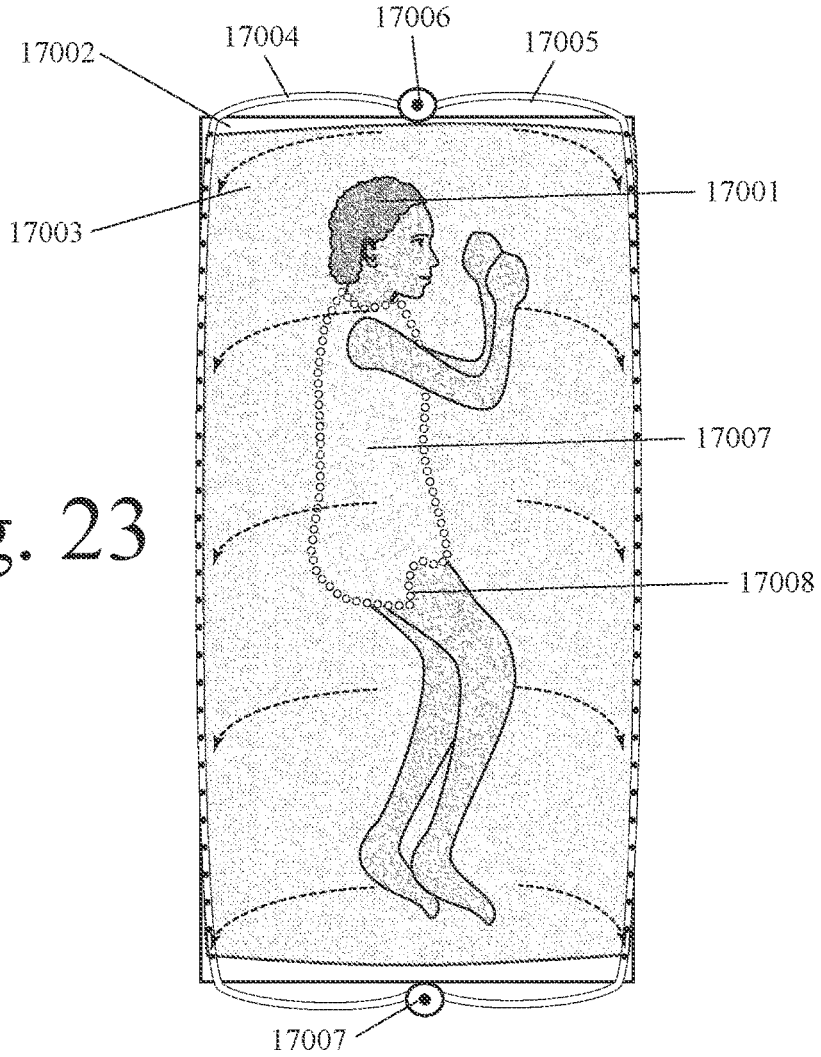
Figure 24:
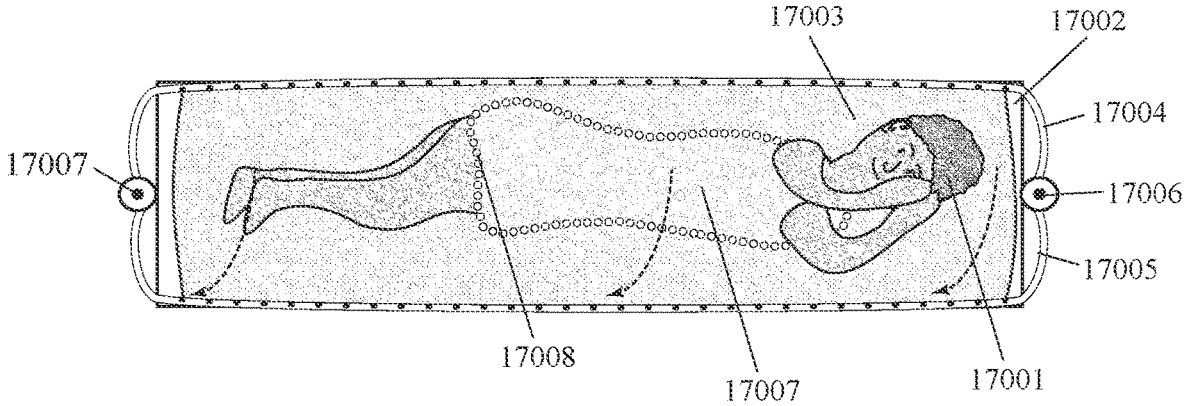

FIGS. 23 and 24 show top-down and oblique side views, respectively, of this example device at a fourth point in time. At this fourth time, the actuators have moved the support structure from its second (folded and/or wrapped) configuration back to its first (flat) configuration. This releases the person, who is now lays on their left side. The sequence of device motions shown in FIGS. 17 through 24 shows how the device can automatically turn a person from lying on their first side (e.g. their right side in this example) to lying on their opposite side (e.g. their left side in this example). Such a device can also move (e.g. turn) a person in the opposite direction, from lying on their left side to lying on their right side, using a symmetric sequence of motions and/or configurations.

In an alternative example, a device can have longitudinal arches, ribs, beams, and/or arms which longitudinally span a bed from head to foot (or vice versa). In an example, a flexible body support structure can be connected to longitudinal arches, ribs, beams, and/or arms by a plurality of connectors. In an example, a flexible body support structure can be directly attached to longitudinal arches, ribs, beams, and/or arms. In an example, channels in a flexible body support structure can slide onto longitudinal arches, ribs, beams, and/or arms. In an example, a plurality of longitudinal arches, ribs, beams, and/or arms can move and thereby move an attached flexible body support structure.

In an example, the left side (e.g. left edge) of a flexible body support surface can be attached to a first (left-side) longitudinal arch, rib, beam, and/or arm and the right side (e.g. right edge) of the support surface can be attached to a second (right-side) longitudinal arch, rib, beam, and/or arm. In an example, when the first (left-side) longitudinal arch, rib, beam, and/or arm is moved right toward the longitudinal center of the device and the second (right-side) longitudinal arch, rib, beam, and/or arm is moved left toward the longitudinal center of the device, then this changes the support surface from its first configuration to its second configuration—lifting the sides of the support surface and enfolding the person within the support surface. In an example, when the first (left-side) longitudinal arch, rib, beam, and/or arm is moved left away from the longitudinal center of the device and the second (right-side) longitudinal arch, rib, beam, and/or arm is moved right away from the longitudinal center of the device, then this changes the support surface from its second configuration back to its first configuration—lowering the sides of the support surface and letting the person down onto the support surface.

In an example, a plurality of longitudinal arches, ribs, beams, and/or arms can move laterally (e.g. left or right) with respect to a mattress and thereby move a flexible body support structure from its first configuration to its second configuration. In an example, a plurality of longitudinal arches, ribs, beams, and/or arms can rotate, tilt, and/or pivot around joints which are located at the head and foot of a bed. In an example, a plurality of longitudinal arches, ribs, beams, and/or arms can rotate, tilt, and/or pivot around joints which are centrally located at the head and foot of a bed. Example variations discussed elsewhere in this disclosure or priority-linked disclosures can also be applied to this example where relevant.

In variations on the examples herein, a "beam" can be further specified as an "arcuate beam." In variations on the examples herein, a "beam" can be alternatively specified as a "rib," "rod," "arch," or "arm." In variations on the examples herein, a "flexible support structure" or "support structure" can be alternatively specified as a "net," "mesh," "hammock," "sleeping bag," "mattress pad," "sling," "sheet," or "blanket." In variations on the examples herein, an actuator can be further specified as an "electromagnetic actuator," "pneumatic actuator," or "hydraulic actuator." In variations on the examples herein, a "cushion" can be alternatively specified as a "compartment," "bladder," "pad," or "pillow." In variations on the examples herein, an "expandable" member can be further specified as an "inflatable" member.

In variations on the examples herein, a device can be triggered to move a person at regular and/or periodic intervals in order to avoid prolonged periods of pressure on tissue on a given side of the person's body. In variations on the examples herein, a device can be triggered to move a person lying on their first (e.g. right) side to lying on their opposite (left or right) side at regular and/or periodic intervals in order to avoid prolonged periods of pressure on tissue on a given side of the person's body. In variations on the examples herein, a device can be triggered to move a person lying on their first (e.g. right) side to lying on their opposite (left or right) side at a periodic interval between 1 hour and 6 hours in order to avoid prolonged periods of pressure on tissue on a given side of the person's body. In variations on the examples herein, a device can be triggered to move a person lying on their first (e.g. right) side to lying on their opposite (left or right) side at a periodic interval, wherein the length of the period interval is based on data from one or more sensors selected from the group consisting of: body motion sensor; inertial sensor; stretch sensor; moisture or humidity sensor; temperature sensor; pressure sensor; tissue oxygenation sensor; electromagnetic energy sensor; spectroscopic or other light energy sensor; and sonic energy sensor.

In variations on the examples herein, a device can be triggered to move a person based on data from one or more environmental sensors (e.g. pressure sensors, motion sensors, temperature sensors, or moisture sensors) which are incorporated into a support structure which is under the person's body and/or embedded into a garment which is worn by the person. In variations on the examples herein, a device can be triggered to move a person based on data from one or more biometric sensors (e.g. tissue oxygenation sensors, body temperature sensors, or blood flow sensors) which are incorporated into a support structure which is under the person's body and/or embedded into a garment which is worn by the person. In variations on the examples herein, a device can be triggered to move a person based on data from one or more sensors selected from the group consisting of: body motion sensor; inertial sensor; stretch sensor; moisture or humidity sensor; temperature sensor; pressure sensor; tissue oxygenation sensor; electromagnetic energy sensor; spectroscopic or other light energy sensor; and sonic energy sensor.

In variations on the examples herein, a device can be triggered to move a person based on data from one or more sensors which are incorporated into a support structure, wherein the sensors are selected from the group consisting of: body motion sensor; inertial sensor; stretch sensor; moisture or humidity sensor; temperature sensor; pressure sensor; tissue oxygenation sensor; electromagnetic energy sensor; spectroscopic or other light energy sensor; and sonic energy sensor. In variations on the examples herein, a device can be triggered to move a person based on data from one or more sensors which are incorporated into an article of clothing or garment, wherein the sensors are selected from the group consisting of: body motion sensor; inertial sensor; stretch sensor; moisture or humidity sensor; temperature sensor; pressure sensor; tissue oxygenation sensor; electromagnetic energy sensor; spectroscopic or other light energy sensor; and sonic energy sensor.

In variations on the examples herein, a device can be triggered to move a person based on analysis of images from a camera. In variations on the examples herein, a device can be triggered to move based on data from one or more environmental sensors (e.g. pressure sensors, motion sensors, temperature sensors, or moisture sensors) which are incorporated into a support structure which is under the person's body and/or embedded into a garment which is worn by the person. In variations on the examples herein, a device can be triggered to move based on data from one or more biometric sensors (e.g. tissue oxygenation sensors, body temperature sensors, or blood flow sensors) which are incorporated into a support structure which is under the person's body and/or embedded into a garment which is worn by the person. In variations on the examples herein, a device can be triggered to move based on data from one or more sensors selected from the group consisting of: body motion sensor; inertial sensor; stretch sensor; moisture or humidity sensor; temperature sensor; pressure sensor; tissue oxygenation sensor; electromagnetic energy sensor; spectroscopic or other light energy sensor; and sonic energy sensor.

In variations on the examples herein, a device can be triggered to move based on data from one or more sensors which are incorporated into a support structure, wherein the sensors are selected from the group consisting of: body motion sensor; inertial sensor; stretch sensor; moisture or humidity sensor; temperature sensor; pressure sensor; tissue oxygenation sensor; electromagnetic energy sensor; spectroscopic or other light energy sensor; and sonic energy sensor. In variations on the examples herein, a device can be triggered to move based on data from one or more sensors which are incorporated into an article of clothing or garment, wherein the sensors are selected from the group consisting of: body motion sensor; inertial sensor; stretch sensor; moisture or humidity sensor; temperature sensor; pressure sensor; tissue oxygenation sensor; electromagnetic energy sensor; spectroscopic or other light energy sensor; and sonic energy sensor. In variations on the examples herein, a device can be triggered to move based on analysis of images from a video camera.

In an example, a device which helps a person to avoid decubitus ulcers can comprise: a support structure (such as a mattress) on which a person lies, wherein the support structure further comprises a plurality of height-adjustable portions whose heights can be individually adjusted; a camera which records images which are analyzed to determine the location of a selected part of the person's body on the support structure at a selected time; wherein the heights of the portions which are below the selected part of the person's body at the selected time are set lower than the heights of the rest of the portions. Alternatively, a device to help a person in bed to avoid decubitus ulcers can comprise: a support structure (such as a mattress) on which a person lies, wherein the support structure further comprises a plurality of inflated portions (e.g. cells, compartments, bladders, or columns) whose inflation levels can be individually adjusted; a camera which records images which are analyzed to determine the location of a selected part of the person's body on the support structure at a selected time; wherein the inflated portions which are below the selected part of the person's body at the selected time are inflated less than the rest of the inflated portions.

A device to help a person in bed to avoid decubitus ulcers can also comprise: a flexible support structure (such as a net, mesh, hammock, sling, sheet, blanket, mattress pad, folding mattress, articulating mattress, or shape-changing mattress) with a longitudinal axis, wherein a person lies on the flexible support structure on their right side or on their left side at different times, wherein the support structure has a first configuration which is substantially flat, wherein the support structure has a second configuration with a concavity which faces toward a selected (e.g. right or left) side and the person's body is at least partially within the concavity, and wherein the support structure has a third configuration with a concavity which faces toward the opposite (e.g. left or right) side and the person's body is at least partially within the concavity; a camera; and a plurality of actuators which are triggered at least in part by analysis of images from the camera to move the support structure from its first configuration to its second configuration to its third configuration and then back to its first configuration. Alternatively, a device to help a person in bed to avoid decubitus ulcers can comprise: a concave flexible support structure (e.g. net, mesh, hammock, sling, sheet, or blanket) on which a person lies; a first arch which spans over the width of the support structure, wherein the first arch is less than two feet away from the head of the support structure, wherein two corners or edges of the support structure are connected to the first arch; a second arch which spans over the width of the support structure, wherein the second arch is less than two feet away from the foot of the support structure, wherein two other corners or edges of the support structure are connected to the second arch, and wherein the support structure is suspended between the first arch and the second arch; and a plurality of actuators which move the locations of the connections between the support structure and the arches along (tracks on) the arches, thereby changing the slope and/or shape of the support structure suspended between the first and second arches, thereby helping the person to turn from lying on their first (e.g. right) side to lying on their second (e.g. left) side.

In an example, a device which can help to prevent decubitus ulcers can comprise: a longitudinal flexible support structure on which a person lies, wherein the support structure further comprises a head portion which is closer to the person's head and a foot portion which is closer to the person's foot; a first arcuate beam which curves over the width of the support structure, wherein corners (or edges or sides) of the head portion of the support structure are connected to the first beam at a plurality of connections; a second arcuate beam which curves over the width of the support structure, wherein corners (or edges or sides) of the foot portion of the support structure are connected to the second arcuate beam at a plurality of connections; and a plurality of actuators which move the connections on the first arcuate beam and the connections on the second arcuate beam; wherein the plurality of actuators move the connections in the following sequential manner; firstly, the actuators move the connections on the first arcuate beam closer together and the connections on the second arcuate beam closer together, thereby gently folding the support structure around the person's body as the person is lying on their first side; secondly, the actuators jointly move the connections on the first arcuate beam along the first arcuate beam and jointly move the connections on the second arcuate beam along the second arcuate beam, thereby rotating and/or tilting the person's body; and thirdly, the actuators move the connections on the first arcuate beam farther apart and move the connections on the second arcuate beam farther apart, thereby gently unfolding the support structure from the person's body and leaving the person lying on their second side. Alternatively, a device to help a person in bed to avoid decubitus ulcers can comprise: a concave flexible support structure (e.g. net, mesh, hammock, sling, sheet, or blanket) on which a person lies; a first arcuate beam which spans (in an arc) over and across the width of the support structure, wherein the first arcuate beam is less than two feet away from the head of the support structure, wherein two sides or edges of the support structure are connected to the first arcuate beam; a second arcuate beam which spans (in an arc) over and across the width of the support structure, wherein the second arcuate beam is less than two feet away from the foot of the support structure, wherein two other sides or edges of the support structure are connected to the second arcuate beam, and wherein the support structure is suspended between the first arcuate beam and the second arcuate beam; and a plurality of actuators which move the locations of the connections between the support structure and the arcuate beams, thereby changing the slope and/or shape of the support structure suspended between the first and second arcuate beams, thereby helping the person to turn from lying on their first (e.g. right) side to lying on their second (e.g. left) side.

In another example, a device to help a person in bed to avoid decubitus ulcers can comprise: a flexible support structure (e.g. net, mesh, hammock, sling, sheet, or blanket) on which a person lies; a first arcuate beam which spans (in an arc) over and across the width of the support structure, wherein two corners or edges of the support structure are connected to the first arcuate beam; a second arcuate beam which spans (in an arc) over and across the width of the support structure, wherein the first arcuate beam is closer to the head of the support structure than the second arcuate beam, wherein two other corners or edges of the support structure are connected to the second arcuate beam, and wherein the support structure is suspended between the first arcuate beam and the second arcuate beam; and a plurality of actuators which move the connections between the support structure and the same arcuate beam closer together or farther apart, thereby changing the slope and/or shape of the support structure suspended between the first and second arcuate beams, and thereby helping the person to turn from lying on their first (e.g. right) side to lying on their second (e.g. left) side. Alternatively, a device to help a person in bed to avoid decubitus ulcers can comprise: a longitudinal flexible support structure on which a person lies, wherein the support structure further comprises a head portion which is closer to the person's head and a foot portion which is closer to the person's foot; a first beam which spans the width of the support structure, wherein corners (or edges) of the head portion of the support structure are connected to the first beam at a plurality of connections; a second beam which spans the width of the support structure, wherein corners (or edges) of the foot portion of the support structure are connected to the second beam at a plurality of connections; and a plurality of actuators which move the connections on the first beam and the connections on the second beam; wherein the plurality of actuators move the connections in the following sequential manner; firstly, the actuators move the connections on the first beam closer together and the connections on the second beam closer together, thereby gently folding the support structure around the person's body as the person is lying on their first side; secondly, the actuators jointly move the connections on the first beam along the first beam and jointly move the connections on the second beam along the second beam, thereby rotating and/or tilting the person's body; and thirdly, the actuators move the connections on the first beam farther apart and move the connections on the second beam farther apart, thereby gently unfolding the support structure from the person's body and leaving the person lying on their second side.

In an example, a device which helps a person in bed to avoid decubitus ulcers can comprise: a bed mattress with a concave upper surface on which a person lies; a first inflatable compartment (or cushion) with an inflation level which varies over time on a first (right or left) side of the mattress; a second inflatable compartment (or cushion) with an inflation level which varies over time on a second (left or right) side of the mattress; wherein the first and second inflatable compartments are both inflated during a first time period, but the first compartment is inflated more than the second compartment; wherein the first and second inflatable compartments are both deflated during a second time period, but the first compartment is deflated more than the second compartment; and wherein the person is moved from lying on their first (e.g. right) side to lying on their second (e.g. left) side during the first and second time periods by sequential inflation and deflation of the first and second inflatable compartments. Alternatively, a device to help a person in bed to avoid decubitus ulcers can comprise: an article of clothing which is worn by a person lying in a bed; a first set of one or more pressure sensors integrated into a first portion of the article of clothing; a second set of one or more pressure sensors integrated into a second portion of the article of clothing; a first porous array of inflatable micro-bladders integrated into the first portion of the article of clothing; a second porous array of inflatable micro-bladders integrated into the second portion of the article of clothing; wherein the first net or mesh is inflated based on pressure level and/or duration measured by the first set of one or more pressure sensors; and wherein the second net or mesh is inflated based on pressure level and/or duration measured by the second set of one or more pressure sensors.

For example, a device to help a person in bed to avoid decubitus ulcers can comprise: an article of clothing which is worn by a person lying in a bed; a first set of one or more pressure sensors integrated into a first portion of the article of clothing; a second set of one or more pressure sensors integrated into a second portion of the article of clothing; a first nested array of inflatable micro-bladders integrated into the first portion of the article of clothing; a second nested array of inflatable micro-bladders integrated into the second portion of the article of clothing; wherein the first net or mesh is inflated based on pressure level and/or duration measured by the first set of one or more pressure sensors; and wherein the second net or mesh is inflated based on pressure level and/or duration measured by the second set of one or more pressure sensors. Alternatively, a device to help a person in bed to avoid decubitus ulcers can comprise: an article of clothing which is worn by a person lying in a bed; a first set of one or more pressure sensors integrated into a first portion of the article of clothing; a second set of one or more pressure sensors integrated into a second portion of the article of clothing; a first porous grid of inflatable micro-bladders integrated into the first portion of the article of clothing; a second porous grid of inflatable micro-bladders integrated into the second portion of the article of clothing; wherein the first net or mesh is inflated based on pressure level and/or duration measured by the first set of one or more pressure sensors; and wherein the second net or mesh is inflated based on pressure level and/or duration measured by the second set of one or more pressure sensors.

In another example, a device which helps a person in bed to avoid decubitus ulcers can comprise: an article of clothing which is worn by a person lying in a bed; a first set of one or more pressure sensors integrated into a first portion of the article of clothing; a second set of one or more pressure sensors integrated into a second portion of the article of clothing; a first porous grid of inflatable micro-bubbles integrated into the first portion of the article of clothing; a second porous grid of inflatable micro-bubbles integrated into the second portion of the article of clothing; wherein the first net or mesh is inflated based on pressure level and/or duration measured by the first set of one or more pressure sensors; and wherein the second net or mesh is inflated based on pressure level and/or duration measured by the second set of one or more pressure sensors. Alternatively, a device to help a person in bed to avoid decubitus ulcers can comprise: an article of clothing which is worn by a person lying in a bed; a first set of one or more pressure sensors on a first portion of the article of clothing; a second set of one or more pressure sensors on a second portion of the article of clothing; a first inflatable net or mesh on the first portion of the article of clothing; a second inflatable net or mesh on the second portion of the article of clothing; wherein the first net or mesh is inflated based on data from the first set of one or more pressure sensors; and wherein the second net or mesh is inflated based on data from the second set of one or more pressure sensors.

In an example, a device to help a person in bed to avoid decubitus ulcers can comprise: an article of clothing which is worn by a person lying in a bed; a first set of one or more pressure sensors on a first portion or section of the article of clothing; a second set of one or more pressure sensors on a second portion or section of the article of clothing; a first concentric array of inflatable micro-bladders on the first portion or section of the article of clothing; a second concentric array of inflatable micro-bladders on the second portion or section of the article of clothing; wherein the first net or mesh is inflated based on pressure level and/or duration measured by the first set of one or more pressure sensors; and wherein the second net or mesh is inflated based on pressure level and/or duration measured by the second set of one or more pressure sensors. Alternatively, a device to help a person in bed to avoid decubitus ulcers can comprise: an article of clothing which is worn by a person lying in a bed; a first set of one or more pressure sensors on a first portion or section of the article of clothing; a second set of one or more pressure sensors on a second portion or section of the article of clothing; a first radial array of inflatable micro-bladders on the first portion or section of the article of clothing; a second radial array of inflatable micro-bladders on the second portion or section of the article of clothing; wherein the first net or mesh is inflated based on pressure level and/or duration measured by the first set of one or more pressure sensors; and wherein the second net or mesh is inflated based on pressure level and/or duration measured by the second set of one or more pressure sensors.

In another embodiment, a device to help a person in bed to avoid decubitus ulcers can comprise: an article of clothing which is worn by a person lying in a bed; a first set of one or more pressure sensors on a first portion or section of the article of clothing; a second set of one or more pressure sensors on a second portion or section of the article of clothing; a first porous grid of inflatable micro-chambers on the first portion or section of the article of clothing; a second porous grid of inflatable micro-chambers on the second portion or section of the article of clothing; wherein the first net or mesh is inflated based on pressure level and/or duration measured by the first set of one or more pressure sensors; and wherein the second net or mesh is inflated based on pressure level and/or duration measured by the second set of one or more pressure sensors. Alternatively, a device which can help to prevent decubitus ulcers can comprise: an article of clothing which is worn by a person lying in a bed; a first set of one or more pressure sensors which is attached to a first area of the article of clothing; a second set of one or more pressure sensors which is attached to a second area of the article of clothing; a first porous but inflatable net or mesh which is attached to the first area of the article of clothing; a second porous but inflatable net or mesh which is attached to the second area of the article of clothing; wherein the first net or mesh is inflated based on data from the first set of one or more pressure sensors; and wherein the second net or mesh is inflated based on data from the second set of one or more pressure sensors.

In another example, a device to help a person in bed to avoid decubitus ulcers can comprise: an article of clothing which is worn by a person lying in a bed; a first set of one or more pressure sensors which is attached to a first area of the article of clothing; a second set of one or more pressure sensors which is attached to a second area of the article of clothing; a first porous but inflatable net or mesh which is attached to the first area of the article of clothing; a second porous but inflatable net or mesh which is attached to the second area of the article of clothing; wherein the first net or mesh is inflated based on pressure level and/or duration measured by the first set of one or more pressure sensors; and wherein the second net or mesh is inflated based on pressure level and/or duration measured by the second set of one or more pressure sensors. Alternatively, a device which helps a person in bed to avoid decubitus ulcers can comprise: an article of clothing which is worn by a person lying in a bed; a first set of one or more pressure sensors which is woven into a first area of the article of clothing; a second set of one or more pressure sensors which is woven into a second area of the article of clothing; a first porous but inflatable net or mesh which is woven into the first area of the article of clothing; a second porous but inflatable net or mesh which is woven into the second area of the article of clothing; wherein the first net or mesh is inflated based on pressure level and/or duration measured by the first set of one or more pressure sensors; and wherein the second net or mesh is inflated based on pressure level and/or duration measured by the second set of one or more pressure sensors.

In an example, a device to help a person in bed to avoid decubitus ulcers can comprise: a flexible and breathable (e.g. porous to gas and liquid) upper support surface (e.g. sheet, pad, blanket, net, or mesh) on which a sleeping person lies; a flexible and breathable (e.g. porous to gas and liquid) middle support surface (e.g. sheet, pad, blanket, net, or mesh) below the upper support surface, wherein the middle support surface is automatically moved along a first (e.g. longitudinal or lateral) axis by one or more actuators, wherein the middle support surface has a first surface portion with a first elasticity level and an arcuate (e.g. circular) second surface portion with a second elasticity level, wherein the second elasticity level is greater than the first elasticity level, and wherein the second surface portion is smaller than (and nested within) the first surface portion; and a flexible and breathable (e.g. porous to gas and liquid) lower support surface (e.g. sheet, pad, blanket, net, or mesh) below the middle support surface, wherein the lower support surface is automatically moved along a second axis by one or more actuators, wherein the second axis is perpendicular to the first axis, wherein the middle support surface has a third surface portion with a third elasticity level and an arcuate (e.g. circular) fourth surface portion with a fourth elasticity level, wherein the fourth elasticity level is greater than the third elasticity level, wherein the fourth surface portion is smaller than (and nested within) the third surface portion, and wherein middle support surface and the lower support surface are moved so as to overlap the second surface portion and the fourth surface portion, thereby creating a localized surface portion with greater elasticity below a selected part of the sleeping person's body that has a pressure ulcer and/or is particularly vulnerable to developing a pressure ulcer.

Alternatively, a device to help a person in bed to avoid decubitus ulcers can comprise: a flexible and breathable (e.g. porous to gas and liquid) upper support surface (e.g. sheet, pad, blanket, net, or mesh) on which a sleeping person lies; a flexible and breathable (e.g. porous to gas and liquid) middle support surface (e.g. sheet, pad, blanket, net, or mesh) below the upper support surface, wherein the middle support surface is automatically moved along a first (e.g. longitudinal or lateral) axis by one or more actuators, wherein the middle support surface has a first surface portion with a first durometer level and an arcuate (e.g. circular) second surface portion with a second durometer level, wherein the second durometer level is lower than the first durometer level, and wherein the second surface portion is smaller than (and nested within) the first surface portion; and a flexible and breathable (e.g. porous to gas and liquid) lower support surface (e.g. sheet, pad, blanket, net, or mesh) below the middle support surface, wherein the lower support surface is automatically moved along a second axis by one or more actuators, wherein the second axis is perpendicular to the first axis, wherein the middle support surface has a third surface portion with a third durometer level and an arcuate (e.g. circular) fourth surface portion with a fourth durometer level, wherein the fourth durometer level is lower than the third durometer level, wherein the fourth surface portion is smaller than (and nested within) the third surface portion, and wherein middle support surface and the lower support surface are moved so as to overlap the second surface portion and the fourth surface portion, thereby creating a localized surface portion with lower durometer below a selected part of the sleeping person's body that has a pressure ulcer and/or is particularly vulnerable to developing a pressure ulcer.

For example, a device to help a person in bed to avoid decubitus ulcers can comprise: a flexible and breathable (e.g. porous to gas and liquid) upper support surface (e.g. sheet, pad, blanket, net, or mesh) on which a sleeping person lies; a flexible and breathable (e.g. porous to gas and liquid) middle support surface (e.g. sheet, pad, blanket, net, or mesh) below the upper support surface, wherein the middle support surface is automatically moved along a first (e.g. longitudinal or lateral) axis by one or more actuators, wherein the middle support surface has a first surface portion with a first stretchability level and an arcuate (e.g. circular) second surface portion with a second stretchability level, wherein the second stretchability level is greater than the first stretchability level, and wherein the second surface portion is smaller than (and nested within) the first surface portion; and a flexible and breathable (e.g. porous to gas and liquid) lower support surface (e.g. sheet, pad, blanket, net, or mesh) below the middle support surface, wherein the lower support surface is automatically moved along a second axis by one or more actuators, wherein the second axis is perpendicular to the first axis, wherein the middle support surface has a third surface portion with a third stretchability level and an arcuate (e.g. circular) fourth surface portion with a fourth stretchability level, wherein the fourth stretchability level is greater than the third stretchability level, wherein the fourth surface portion is smaller than (and nested within) the third surface portion, and wherein middle support surface and the lower support surface are moved so as to overlap the second surface portion and the fourth surface portion, thereby creating a localized surface portion with greater stretchability below a selected part of the sleeping person's body that has a pressure ulcer and/or is particularly vulnerable to developing a pressure ulcer.

Alternatively, a device to help a person in bed to avoid decubitus ulcers can comprise: a flexible and breathable (e.g. porous to gas and liquid) upper support surface (e.g. sheet, pad, blanket, net, or mesh) on which a sleeping person lies; a flexible and breathable (e.g. porous to gas and liquid) middle support surface (e.g. sheet, pad, blanket, net, or mesh) below the upper support surface, wherein the middle support surface is automatically moved along a first (e.g. longitudinal or lateral) axis by one or more actuators, wherein the middle support surface has a first surface portion with a first flexibility level and an arcuate (e.g. circular) second surface portion with a second flexibility level, wherein the second flexibility level is greater than the first flexibility level, and wherein the second surface portion is smaller than (and nested within) the first surface portion; and a flexible and breathable (e.g. porous to gas and liquid) lower support surface (e.g. sheet, pad, blanket, net, or mesh) below the middle support surface, wherein the lower support surface is automatically moved along a second axis by one or more actuators, wherein the second axis is perpendicular to the first axis, wherein the middle support surface has a third surface portion with a third flexibility level and an arcuate (e.g. circular) fourth surface portion with a fourth flexibility level, wherein the fourth flexibility level is greater than the third flexibility level, wherein the fourth surface portion is smaller than (and nested within) the third surface portion, and wherein middle support surface and the lower support surface are moved so as to overlap the second surface portion and the fourth surface portion, thereby creating a localized surface portion with greater stretchability below a selected part of the sleeping person's body that has a pressure ulcer and/or is particularly vulnerable to developing a pressure ulcer.

In another example, a device to help a person in bed to avoid decubitus ulcers can comprise: a flexible and breathable (e.g. porous to gas and liquid) upper support surface (e.g. sheet, pad, blanket, net, or mesh) on which a sleeping person lies; a flexible and breathable (e.g. porous to gas and liquid) middle support surface (e.g. sheet, pad, blanket, net, or mesh) below the upper support surface, wherein the middle support surface is suspended between first and second rollers; wherein the middle support surface is automatically moved between the first and second rollers by one or more actuators, wherein the middle support surface has a first opening (or hole); and a flexible and breathable (e.g. porous to gas and liquid) lower support surface (e.g. sheet, pad, blanket, net, or mesh) below the middle support surface, wherein the lower support surface is suspended between third and fourth rollers; wherein the lower support surface is automatically moved between the third and fourth rollers, wherein the middle support surface has a second opening (or hole), and wherein middle support surface and the lower support surface are moved so as to overlap the first and second openings (or holes), thereby creating a localized opening (or hole) below a selected part of the sleeping person's body that has a pressure ulcer and/or is particularly vulnerable to developing a pressure ulcer. Alternatively, a device which helps a person in bed avoid decubitus ulcers can comprise: a flexible and breathable (e.g. porous to gas and liquid) upper support surface (e.g. sheet, pad, blanket, net, or mesh) on which a sleeping person lies; a flexible and breathable (e.g. porous to gas and liquid) middle support surface (e.g. sheet, pad, blanket, net, or mesh) below the upper support surface, wherein the middle support surface is suspended between first and second rollers; wherein the middle support surface is manually moved between the first and second rollers, wherein the middle support surface has a first surface portion with a first elasticity level and a second surface portion with a second elasticity level, wherein the second elasticity level is greater than the first elasticity level, and wherein the second surface portion is smaller than (and nested within) the first surface portion; and a flexible and breathable (e.g. porous to gas and liquid) lower support surface (e.g. sheet, pad, blanket, net, or mesh) below the middle support surface, wherein the lower support surface is suspended between third and fourth rollers; wherein the lower support surface is manually moved between the third and fourth rollers, wherein the middle support surface has a third surface portion with a third elasticity level and a fourth surface portion with a fourth elasticity level, wherein the fourth elasticity level is greater than the third elasticity level, wherein the fourth surface portion is smaller than (and nested within) the third surface portion, and wherein middle support surface and the lower support surface are moved so as to overlap the second surface portion and the fourth surface portion, thereby creating a localized surface portion with greater elasticity below a selected part of the sleeping person's body that has a pressure ulcer and/or is particularly vulnerable to developing a pressure ulcer.

A device to help a person in bed to avoid decubitus ulcers can comprise: a flexible upper support surface on which a sleeping person lies; a flexible middle support surface below the upper support surface, wherein the middle support surface is automatically moved along a first axis by one or more actuators, wherein the middle support surface has a first surface portion with a first elasticity level and a second surface portion with a second elasticity level, wherein the second elasticity level is greater than the first elasticity level, and wherein the second surface portion is smaller than the first surface portion; and a flexible lower support surface below the middle support surface, wherein the lower support surface is automatically moved along a second axis by one or more actuators, wherein the second axis is perpendicular to the first axis, wherein the middle support surface has a third surface portion with a third elasticity level and a fourth surface portion with a fourth elasticity level, wherein the fourth elasticity level is greater than the third elasticity level, wherein the fourth surface portion is smaller than the third surface portion, and wherein middle support surface and the lower support surface are moved so as to overlap the second surface portion and the fourth surface portion, thereby creating a localized surface portion with greater elasticity below a selected part of the sleeping person's body that has a pressure ulcer and/or is particularly vulnerable to developing a pressure ulcer. Alternatively, a device which can help to prevent decubitus ulcers can comprise: a flexible support structure (such as a net, mesh, sling, hammock, pad, sheet, or blanket) on which a person lies; a laterally-moving loop of flexible material with an uneven surface which is under the flexible support structure, wherein the loop comprises an upper portion which moves in a selected lateral direction (e.g. right-to-left or left-to-right) and a lower portion which moves in the opposite lateral direction (e.g. left-to-right or right-to-left); and a plurality of actuators which lift the flexible support structure up off the loop of flexible material, move (and/or rotate) the loop of flexible material laterally, and then lower the flexible support structure back down onto the loop of flexible material.

In another embodiment, a device to help a person in bed to avoid decubitus ulcers can comprise: a flexible support structure (such as a net, mesh, sling, hammock, pad, sheet, or blanket) on which a person lies; a laterally-moving loop of padding which is under the flexible support structure, wherein the loop comprises an upper portion which moves in a selected lateral direction (e.g. right-to-left or left-to-right) and a lower portion which moves in the opposite lateral direction (e.g. left-to-right or right-to-left); a plurality of actuators which lift the flexible support structure up off the loop of padding, move (and/or rotate) the loop of padding laterally, and then lower the flexible support structure back down onto the loop of padding; and a sanitizing or disinfecting mechanism which sanitizes or disinfects the loop of padding as it passes through the lower portion of the loop. Alternatively, a device to help a person in bed to avoid decubitus ulcers can comprise: a flexible support structure (such as a net, mesh, sling, hammock, pad, sheet, or blanket) on which a person lies; a laterally-moving loop of padding which is under the flexible support structure, wherein the loop comprises an upper portion which moves in a selected lateral direction (e.g. right-to-left or left-to-right) and a lower portion which moves in the opposite lateral direction (e.g. left-to-right or right-to-left); a plurality of actuators which lift the flexible support structure up off the loop of padding, move (and/or rotate) the loop of padding laterally, and then lower the flexible support structure back down onto the loop of padding; and a padding-reconditioning mechanism, wherein the padding-reconditioning mechanism reconditions the loop of padding when it passes through the lower portion; and wherein the padding-reconditioning mechanism performs one of more functions selected from the group consisting of: drying or dehumidifying the padding (e.g. using thermal energy); sanitizing or disinfecting the padding (e.g. using light energy or microwave energy); cleaning the padding (e.g. using soap and water; and fluffing or expanding the padding (e.g. using positive or negative air pressure).

In another example, a device to help a person in bed to avoid decubitus ulcers can comprise: a flexible support surface (such as a flexible net, mesh, sling, hammock, pad, sheet, or blanket) on which a person lies; a laterally-scrolling loop of padding (such as a loop of compressible foam or a loop of compressible textile padding) which is under the upper support structure; two rollers, one roller closer to the right side of the support surface and one roller closer to the left side of the support surface, wherein the laterally-scrolling loop of padding loops around the two rollers and scrolls laterally between the two rollers; and a plurality of actuators; and using at least one actuator to lift the flexible support surface up off the loop of padding; (b) using at least one actuator to scroll the loop of padding laterally, thereby changing which portion of the loop of padding is directly underneath a selected location on the person's body; and then (c) using at least one actuator to lower the flexible support surface back down onto the loop of padding. Alternatively, a device to help a person in bed to avoid decubitus ulcers can comprise: a flexible support structure (such as a net, mesh, sling, hammock, pad, sheet, or blanket) on which a person lies; a longitudinally-moving loop of flexible material with an uneven surface which is under the flexible support structure, wherein the loop comprises an upper portion which moves in a selected longitudinal direction (e.g. head-to-toe or toe-to-head) and a lower portion which moves in the opposite longitudinal direction (e.g. toe-to-head or head-to-toe); and a plurality of actuators which lift the flexible support structure up off the loop of flexible material, move (and/or rotate) the loop of flexible material longitudinally, and then lower the flexible support structure back down onto the loop of flexible material.

In an example, a device which helps a person to avoid decubitus ulcers can comprise: a flexible support structure (such as a net, mesh, sling, hammock, pad, sheet, or blanket) on which a person lies; a longitudinally-moving loop of padding which is under the flexible support structure, wherein the loop comprises an upper portion which moves in a selected longitudinal direction (e.g. head-to-toe or toe-to-head) and a lower portion which moves in the opposite longitudinal direction (e.g. toe-to-head or head-to-toe); a plurality of actuators which lift the flexible support structure up off the loop of padding, move (and/or rotate) the loop of padding longitudinally, and then lower the flexible support structure back down onto the loop of padding; and a sanitizing or disinfecting mechanism which sanitizes or disinfects the loop of padding as it passes through the lower portion of the loop. Alternatively, a device to help a person in bed to avoid decubitus ulcers can comprise: a flexible support structure (such as a net, mesh, sling, hammock, pad, sheet, or blanket) on which a person lies; a longitudinally-moving loop of padding which is under the flexible support structure, wherein the loop comprises an upper portion which moves in a selected longitudinal direction (e.g. head-to-toe or toe-to-head) and a lower portion which moves in the opposite longitudinal direction (e.g. toe-to-head or head-to-toe); a plurality of actuators which lift the flexible support structure up off the loop of padding, move (and/or rotate) the loop of padding longitudinally, and then lower the flexible support structure back down onto the loop of padding; and a padding-reconditioning mechanism, wherein the padding-reconditioning mechanism reconditions the loop of padding when it passes through the lower portion; and wherein the padding-reconditioning mechanism performs one of more functions selected from the group consisting of: drying or dehumidifying the padding (e.g. using thermal energy); sanitizing or disinfecting the padding (e.g. using light energy or microwave energy); cleaning the padding (e.g. using soap and water; and fluffing or expanding the padding (e.g. using positive or negative air pressure).

For example, a device which helps a person in bed avoid decubitus ulcers can comprise: a flexible support structure (such as a net, mesh, sling, hammock, pad, sheet, or blanket) on which a person lies; a longitudinally-moving textile loop which is under the flexible support structure, wherein the loop comprises an upper portion which moves in a selected longitudinal direction (e.g. head-to-toe) and a lower portion which moves in the opposite longitudinal direction (e.g. toe-to-head); and a plurality of actuators which sequentially lift the flexible support structure up off the loop, move (and/or rotate) the loop longitudinally, and then lower the flexible support structure back down onto the loop. Alternatively, a device to help a person in bed to avoid decubitus ulcers can comprise: a flexible support structure (such as a net, mesh, sling, hammock, pad, sheet, or blanket) on which a person lies; a longitudinally-moving undulating padded loop which is under the flexible support structure, wherein the loop comprises an upper portion which moves in a selected longitudinal direction (e.g. head-to-toe) and a lower portion which moves in the opposite longitudinal direction (e.g. toe-to-head); and a plurality of actuators which sequentially lift the flexible support structure up off the loop, move (and/or rotate) the loop longitudinally, and then lower the flexible support structure back down onto the loop.

In another example, a device to help a person in bed to avoid decubitus ulcers can comprise: a flexible net, mesh, sling, hammock, pad, sheet, or blanket on which a person lies; a longitudinally-scrolling loop of padding which is under the upper support structure; and a plurality of actuators; and using at least one actuator to lift the flexible net, mesh, sling, hammock, pad, sheet, or blanket up off the lower support structure; (b) using at least one actuator to scroll the loop of padding longitudinally, thereby changing which portion of the loop of padding is directly underneath a selected location on the person's body; and then (c) using at least one actuator to lower the flexible net, mesh, sling, hammock, pad, sheet, or blanket back down onto the lower support structure. Alternatively, a device to help a person in bed to avoid decubitus ulcers can comprise: a flexible support structure (such as a net, mesh, sling, hammock, pad, sheet, or blanket) on which a person lies; a loop of padding which is under the flexible support structure; a plurality of actuators which lift the flexible support structure up off the loop of padding, move (and/or rotate) the loop of padding (laterally or longitudinally), and then lower the flexible support structure back down onto the loop of padding; and a reconditioning mechanism, wherein the reconditioning mechanism reconditions one portion of the loop of padding at a time at a location where the person's body is not pressing against the loop of padding.

A device to help a person in bed to avoid decubitus ulcers can comprise: a flexible net, mesh, sling, hammock, pad, sheet, or blanket on which a person lies; a loop of padding which is under the upper support structure; and a plurality of actuators; and using at least one actuator to lift the flexible net, mesh, sling, hammock, pad, sheet, or blanket up off the lower support structure; (b) using at least one actuator to scroll the loop of padding longitudinally, thereby changing which portion of the loop of padding is directly underneath a selected location on the person's body; and then (c) using at least one actuator to lower the flexible net, mesh, sling, hammock, pad, sheet, or blanket back down onto the lower support structure. Alternatively, a device which can help to prevent decubitus ulcers can comprise: a mattress on which a person lies; a lower first-side cushion on a first (e.g. right or left) side of the person; an upper first-side cushion which is also on the first side of the person, but above the lower first-side cushion; a lower second-side cushion on a second (e.g. left or right) side of the person; an upper second-side cushion which is also on the second side of the person, but above the lower second-side cushion; wherein the person is turned from lying on their first (e.g. right) side to lying on their second (e.g. left) side by inflating and deflating the cushions, wherein inflation and deflation of cushions on the first vs. second sides is asymmetric with respect to a vertical plane between them, and wherein inflation and deflation of lower vs. upper cushions is asymmetric with respect to a horizontal plane between them.

In an example, a device to help a person in bed to avoid decubitus ulcers can comprise: a mattress on which a person lies; a lower first-side cushion on a first (e.g. right or left) side of the person; an upper first-side cushion which is also on the first side of the person, but above the lower first-side cushion; a lower second-side cushion on a second (e.g. left or right) side of the person; an upper second-side cushion which is also on the second side of the person, but above the lower second-side cushion; wherein the person is turned from lying on their first (e.g. right) side to lying on their second (e.g. left) side by inflating and deflating the cushions, wherein the level of inflation (and deflation) of cushions on the first vs. second sides is asymmetric with respect to a vertical plane between them, and wherein the level of inflation (and deflation) of lower vs. upper cushions is asymmetric with respect to a horizontal plane between them. Alternatively, a device which helps a person in bed to avoid decubitus ulcers can comprise: a mattress on which a person lies; a lower first-side cushion on a first (e.g. right or left) side of the person; an upper first-side cushion which is also on the first side of the person, but above the lower first-side cushion; a lower second-side cushion on a second (e.g. left or right) side of the person; an upper second-side cushion which is also on the second side of the person, but above the lower second-side cushion; wherein the person is turned from lying on their first (e.g. right) side to lying on their second (e.g. left) side by inflating and deflating the cushions, and wherein the lower cushions are inflated first and the upper cushions are inflated second.

In another example, a device to help a person in bed to avoid decubitus ulcers can comprise: an upper support structure (such as a flexible net, mesh, sling, hammock, pad, sheet, or blanket) on which a person lies; a lower support structure (such as a loop of compressible foam or textile) which is under the upper support structure; and a plurality of actuators; and (a) using at least one actuator to lift the upper support structure up off the lower support structure; (b) using at least one actuator to scroll and/or rotate the lower support structure (e.g. laterally or longitudinally), thereby changing which portion of the lower support structure is directly underneath a selected location on the person's body; and then (c) using at least one actuator to lower the upper support structure back down onto the lower support structure. Alternatively, a device which helps a person in bed avoid decubitus ulcers can comprise: an upper support structure (such as a flexible net, mesh, sling, hammock, pad, sheet, or blanket) on which a person lies; a lower support structure (such as a moving foam layer, foam loop, textile layer, or textile loop) which is under the upper support structure; and a plurality of actuators; and (a) using at least one actuator to lift the upper support structure up off the lower support structure; (b) using at least one actuator to move (e.g. shift, scroll, and/or rotate) the lower support structure (e.g. laterally, longitudinally, or radially), thereby changing which portion of the lower support structure is directly underneath a selected location on the person's body; and then (c) using at least one actuator to lower the upper support structure back down onto the lower support structure.

A device to help a person in bed to avoid decubitus ulcers can comprise: an upper support surface on which a person lies; a lower support surface below the upper support surface; and a plurality of cushions around the person's torso; wherein the person is turned from lying on one side to the other side by the following sequence—the cushions are inflated, the upper support surface is tilted and/or rotated between 90 and 180 degrees around its longitudinal axis in a first (clockwise or counter-clockwise) direction, the cushions are deflated, and the upper support surface is tilted and/or rotated between 90 and 180 degrees around its longitudinal axis in the opposite (counter-clockwise or clockwise) direction. Alternatively, a device to help a person in bed to avoid decubitus ulcers can comprise: an upper support surface on which a person lies; a lower support surface below the upper support surface; and inflatable cushions on the right and left sides of lower support surface;

wherein the cushions are inflated on both sides of the person, the upper support surface is tilted and/or rotated, and the cushions are deflated.

For example, a device to help a person in bed to avoid decubitus ulcers can comprise: a longitudinal flexible body support surface (such as a net, mesh, pad, sheet, or blanket) on which a person lies; a mattress under the support surface, wherein the mattress further comprises right-side inflatable compartment and a left-side inflatable compartment; and a plurality of actuators; wherein the person is moved from lying on their first (e.g. right) side to lying on their second (e.g. left) side in the following steps (a) lifting the right and left sides of the support surface using the actuators, thereby wrapping the support surface at least partially around the person's torso and lifting the person who was lying on their first (e.g. right) side at least partially up off the mattress with the lateral axis of their torso being substantially vertical; (b) inflating the second side compartment so that the second-side inflatable compartment pushes against the support surface and tilts, pivots, and/or rotates the person's body around a longitudinal axis; and then (c) lowering the right and left sides of the support surface using the actuators, thereby unwrapping the support surface from around the person's torso and lowering the person down onto the mattress lying on their second (e.g. left) side. Alternatively, a device to help a person in bed to avoid decubitus ulcers can comprise: a longitudinal flexible body support surface (such as a net, mesh, pad, sheet, or blanket) on which a person lies; a mattress under the support surface, wherein the mattress further comprises right-side inflatable compartment and a left-side inflatable compartment; and a plurality of actuators; wherein the person is moved from lying on their first (e.g. right) side to lying on their second (e.g. left) side in the following steps (a) lifting the right and left sides of the support surface using the actuators, thereby wrapping the support surface at least partially around the person's torso and lifting the person who was lying on their first (e.g. right) side at least partially up off the mattress; (b) inflating the second side compartment so that the second-side inflatable compartment pushes against the support surface and tilts, pivots, and/or rotates the person's body around a longitudinal axis; (c) lowering the right and left sides of the support surface using the actuators, thereby unwrapping the support surface from around the person's torso and lowering the person down onto the mattress lying on their second (e.g. left) side; and then (d) deflating the second side compartment.

In another example, a device which can help to prevent decubitus ulcers can comprise: an upper support surface on which a sleeping person lies; a middle support surface below the upper support surface, wherein the middle support surface has a first surface portion with a first elasticity level and a second surface portion with a second elasticity level, wherein the second elasticity level is greater than the first elasticity level, and wherein the second surface portion is smaller than the first surface portion; and a lower support surface below the middle support surface, wherein the middle support surface has a third surface portion with a third elasticity level and a fourth surface portion with a fourth elasticity level, wherein the fourth elasticity level is greater than the third elasticity level, wherein the fourth surface portion is smaller than the third surface portion, and wherein middle support surface and the lower support surface are moved so as to overlap the second surface portion and the fourth surface portion, thereby creating a localized surface portion with greater elasticity below a selected part of the sleeping person's body that has a pressure ulcer and/or is particularly vulnerable to developing a pressure ulcer. Alternatively, a device to help a person in bed to avoid decubitus ulcers can comprise: an upper support surface on which a sleeping person lies; a middle support surface below the upper support surface, wherein the middle support surface has a first surface portion with a first elasticity level and a second surface portion with a second elasticity level, wherein the second elasticity level is greater than the first elasticity level, and wherein the second surface portion is smaller than the first surface portion; and a lower support surface below the middle support surface, wherein the middle support surface has a third surface portion with a third elasticity level and a fourth surface portion with a fourth elasticity level, wherein the fourth elasticity level is greater than the third elasticity level, wherein the fourth surface portion is smaller than the third surface portion, and wherein the middle support surface and the lower support surface are moved to align the second surface portion and the fourth surface portion to create a localized area with greater elasticity below a selected part of the sleeping person's body that has a pressure ulcer and/or is particularly vulnerable to developing a pressure ulcer.

In an example, a device which helps a person in bed to avoid decubitus ulcers can comprise: an upper support surface on which a sleeping person lies; a middle support surface below the upper support surface, wherein the middle support surface has a first surface portion with a first elasticity level and a second surface portion with a second elasticity level, wherein the second elasticity level is greater than the first elasticity level, and wherein the second surface portion is smaller than the first surface portion; and a lower support surface below the middle support surface, wherein the middle support surface has a third surface portion with a third elasticity level and a fourth surface portion with a fourth elasticity level, wherein the fourth elasticity level is greater than the third elasticity level, wherein the fourth surface portion is smaller than the third surface portion, and wherein the middle support surface and the lower support surface are manually moved to overlap the second surface portion and the fourth surface portion to create a localized area with greater elasticity below a selected part of the sleeping person's body that has a pressure ulcer and/or is particularly vulnerable to developing a pressure ulcer. Alternatively, a device to help a person in bed to avoid decubitus ulcers can comprise: a flexible support surface (such as a flexible net, mesh, sling, hammock, pad, sheet, or blanket) on which a person lies; a moving layer of padding (such as a layer of compressible foam or textile padding) which is under the upper support structure; and a plurality of actuators; and using at least one actuator to lift the flexible support surface up off the loop of padding; (b) using at least one actuator to shift the layer of padding laterally, thereby changing which portion of the layer of padding is directly underneath a selected location on the person's body; and then (c) using at least one actuator to lower the flexible support surface back down onto the layer of padding.

In another embodiment, a device to help a person in bed to avoid decubitus ulcers can comprise: a flexible support surface (such as a flexible net, mesh, sling, hammock, pad, sheet, or blanket) on which a person lies; a moving layer of padding (such as a layer of compressible foam or textile padding) which is under the upper support structure; and a plurality of actuators; and using at least one actuator to lift the flexible support surface up off the loop of padding; (b) using at least one actuator to rotate the layer of padding radially, thereby changing which portion of the layer of padding is directly underneath a selected location on the person's body; and then (c) using at least one actuator to lower the flexible support surface back down onto the layer of padding. Alternatively, a device to help a person in bed to avoid decubitus ulcers can comprise: a support structure on which a person lies; a plurality of actuators which change the cross-sectional shape of the support structure from flat to concave, or vice versa; a garment worn by the person; and one or more sensors on the garment selected from the group consisting of motion sensor, pressure sensor, and moisture sensor; wherein the plurality of actuators are triggered to change the cross-sectional shape of the support structure from flat to concave, then tilt and/or rotate the support structure, and then change the cross-sectional shape of the support structure back to flat—based on data from the one or more sensors.

In another example, a device to help a person in bed to avoid decubitus ulcers can comprise: a flexible support structure on which a sleeping person lies, wherein the support structure has a longitudinal axis, wherein the support structure has a first configuration in which it is substantially flat and a second configuration in which it is folded and/or wrapped around a portion of the person's torso; a plurality of actuators which change the support structure from its first configuration to its second configuration, or vice versa; wherein a person is moved from lying on their first (e.g. right) side to lying on their second (e.g. left) side by: (a) using the actuators to change the support structure from its first configuration to its second configuration as the person lies on their first (e.g. right) side; (b) using the actuators to slowly rotate and/or tilt the support structure relative to a longitudinal axis, thereby also slowly rotating and/or tilting the person's body which is partially enfolded within the support structure; and (c) then using the actuators to change the support structure from its second configuration to its first configuration, thereby leaving the person lying on their second (e.g. left) side. Alternatively, a device which helps a person in bed avoid decubitus ulcers can comprise: a support structure (such as a mattress) on which a person lies, wherein the support structure further comprises a concentric array of compressible rings; a plurality of actuators which move the concentric array of compressible rings; and a camera which records images which are analyzed to determine the location of a selected part of the person's body at a selected time; wherein the concentric array of compressible rings is moved so that its center is under the selected part of the person's body.

In an example, a device to help a person in bed to avoid decubitus ulcers can comprise: a support structure (such as a mattress) on which a person lies, wherein the support structure further comprises a concentric array of foam rings; a plurality of actuators which move the concentric array of foam rings; and a camera which records images which are analyzed to determine the location of a selected part of the person's body at a selected time; wherein the concentric array of foam rings is moved so that its center is under the selected part of the person's body. Alternatively, a device which helps a person in bed avoid decubitus ulcers can comprise: a support structure (such as a mattress) on which a person lies, wherein the support structure further comprises a concentric array of inflated rings; a plurality of actuators which move the concentric array of inflated rings; a plurality of actuators which moves the concentric array of inflated rings; a garment (or dressing) worn by the person, wherein the garment (or dressing) further comprises an electromagnetic energy emitter; and a plurality of electromagnetic energy sensors which are used to determine the location of the at least one electromagnetic energy emitter; wherein the concentric array of inflated rings is moved so that its center is under the electromagnetic energy emitter.

For example, a device to help a person in bed to avoid decubitus ulcers can comprise: a longitudinal flexible support structure on which a person lies; a plurality of arches which span laterally over the support structure, wherein the support structure is connected to the arches at a plurality of movable connections, and wherein the support structure is suspended between the arches; and a plurality of actuators which move the connections; wherein moving the connections changes the slope and/or shape of the support structure which, in turn, helps the person to move from lying on their first (e.g. right) side to lying on their second (e.g. left) side. Alternatively, a device which helps a person in bed avoid decubitus ulcers can comprise: a longitudinal flexible support structure (such as a reinforced sheet, pad, blanket, net, mesh, or sling) on which a person lies; a plurality of beams (or ribs) which laterally span the support structure above the support structure, wherein the support structure is connected to the beams at a plurality of connections which can be moved along the beams (or ribs); and a plurality of actuators which move the connections along the beams (or ribs); wherein moving the connections along the beams (or ribs) changes the slope and/or shape of the support structure which, in turn, helps the person to move from lying on their first (e.g. right) side to lying on their second (e.g. left) side.

In another example, a device to help a person in bed to avoid decubitus ulcers can comprise: a longitudinal flexible support structure on which a person lies; a plurality of beams which span laterally over the support structure, wherein the support structure is connected to the beams at a plurality of movable connections; and a plurality of actuators which move the connections closer together or farther apart in a sequential manner; wherein moving the connections closer together or farther apart in a sequential manner changes the slope and/or shape of the support structure in a sequential manner which, in turn, helps the person to move from lying on their first (e.g. right) side to lying on their second (e.g. left) side by gently lifting the person from lying on their first side and gently lowering them onto their second side. Alternatively, a device to help a person in bed to avoid decubitus ulcers can comprise: a longitudinal flexible support structure on which a person lies; a plurality of beams which span laterally over the support structure, wherein corners of the support structure are connected to the beams at a plurality of movable connections; and a plurality of actuators which move the connections closer together and farther apart; wherein moving the connections closer together and farther apart changes the slope and/or shape of the support structure in a sequential manner which, in turn, helps the person to move from lying on their first (e.g. right) side to lying on their second (e.g. left) side.

In another embodiment, a device to help a person in bed to avoid decubitus ulcers can comprise: a longitudinal flexible support structure on which a person lies; a plurality of beams which span laterally over the support structure, wherein the support structure is connected to the beams at a plurality of movable connections; and a plurality of actuators which move the connections closer together or farther apart; wherein moving the connections closer together or farther apart changes the slope and/or shape of the support structure which, in turn, helps the person to move from lying on their first (e.g. right) side to lying on their second (e.g. left) side. Alternatively, a device which can help to prevent decubitus ulcers can comprise: a longitudinal flexible support structure on which a person lies; a plurality of beams which span laterally over the support structure, wherein corners of the support structure are connected to the beams at a plurality of movable connections; and a plurality of actuators which move the connections of laterally-aligned corners of the support structure closer together and farther apart; wherein moving these connections closer together and farther apart changes the slope and/or shape of the support structure which, in turn, helps the person to move from lying on their first (e.g. right) side to lying on their second (e.g. left) side.

A device to help a person in bed to avoid decubitus ulcers can comprise: a longitudinal flexible support structure on which a person lies; a plurality of beams which span laterally over the support structure, wherein corners (and/or sides) of the support structure are connected to the beams at a plurality of movable connections; and a plurality of actuators which move the connections; wherein the plurality of actuators move the connections in the following three-step sequence—firstly, the actuators move the connections so as to fold the support structure around the person's body as they lie on their first side; secondly, the actuators move the connections so as to rotate and/or tilt the person's body; and then thirdly, the actuators move the connections so as to unfold the support structure from the person's body, leaving them lying on their second side. Alternatively, a device which helps a person in bed to avoid decubitus ulcers can comprise: a longitudinal flexible support structure on which a person lies; a plurality of beams which span laterally over the support structure, wherein corners of the support structure are connected to the beams at a plurality of movable connections; and a plurality of actuators which move the connections; wherein moving the connections changes the slope and/or shape of the support structure which, in turn, helps the person to move from lying on their first (e.g. right) side to lying on their second (e.g. left) side.

In another example, a device to help a person in bed to avoid decubitus ulcers can comprise: a longitudinal flexible support structure on which a person lies; a plurality of beams which span laterally over the support structure, wherein the support structure is connected to the beams at a plurality of movable connections; and a plurality of actuators which move the connections; wherein moving the connections changes the slope and/or shape of the support structure which, in turn, helps the person to move from lying on their first (e.g. right) side to lying on their second (e.g. left) side. Alternatively, a device which can help to prevent decubitus ulcers can comprise: a longitudinal flexible support structure on which a person lies; a plurality of beams which span laterally over the support structure, wherein the support structure is connected to the beams at a plurality of movable connections; and a plurality of actuators which move the connections; wherein moving the connections enfolds the support structure around the person's body and turns the person from lying on their first (e.g. right) side to lying on their second (e.g. left) side.

In an example, a device to help a person in bed to avoid decubitus ulcers can comprise: a longitudinal flexible support structure on which a person lies; a plurality of beams which span laterally over the support structure, wherein the support structure is connected to the beams at a plurality of movable connections; and a plurality of actuators which raise or lower the connections; wherein raising or lowering the connections changes the slope and/or shape of the support structure which, in turn, helps the person to move from lying on their first (e.g. right) side to lying on their second (e.g. left) side. Alternatively, a device to help a person in bed to avoid decubitus ulcers can comprise: a support structure on which a person lies, wherein the support structure further comprises a plurality of adjustable portions (e.g. cells, columns, bladders, or compartments) whose sizes and/or shapes can be individually adjusted; a plurality of electromagnetic energy sensors; and a garment (or dressing) which is worn by the person, wherein the garment (or dressing) further comprises an electromagnetic energy emitter, wherein the adjustable portions which are within a selected distance (e.g. between 2" and 12") from the electromagnetic energy emitter at a selected time are identified by the electromagnetic energy sensors, and wherein the sizes and/or shapes of the identified adjustable portions at the selected time are adjusted relative to the sizes and/or shapes of the other adjustable portions.

In another example, a device to help a person in bed to avoid decubitus ulcers can comprise: one or more garments which are worn by a person who lies in a bed, wherein the garments further comprise electromagnetic markers on pant legs and shirt sleeves; a plurality of electromagnetic sensors which detect the locations of the markers; a human-to-computer interface (e.g. voice command interface) which is controlled by the person; a first soft support structure with one or more openings into which the person can place their knees; a second soft support structure with one or more openings into which the person can place their elbows; wherein the support structures engage the person's knees and elbows if the person gives the appropriate command and the sensors indicate that the person's knees and elbows are properly positioned; and wherein the support structures are simultaneously and gently moved, spanning an arc in 3D space, from a first (right or left) side of the bed to a second (left or right) side of the bed, thereby gently moving the person from lying on their first (e.g. right) side to lying on their second (e.g. left) side at their command. Alternatively, a device which helps a person to avoid decubitus ulcers can comprise: one or more garments which are worn by a person who lies in a bed, wherein the garments further comprise electromagnetic markers on pant legs and torso; a plurality of electromagnetic sensors which detect the locations of the markers; a human-to-computer interface (e.g. voice command interface) which is controlled by the person; a first soft support structure with one or more openings into which the person can place their knees; a second soft support structure with one or more openings into which the person can place their torso; wherein the support structures engage the person's knees and torso if the person gives the appropriate command and the sensors indicate that the person's knees and torso are properly positioned; and wherein the support structures are simultaneously and gently moved, spanning an arc in 3D space, from a first (right or left) side of the bed to a second (left or right) side of the bed, thereby gently moving the person from lying on their first (e.g. right) side to lying on their second (e.g. left) side at their command.

For example, a device to help a person in bed to avoid decubitus ulcers can comprise: one or more garments which are worn by a person who lies in a bed, wherein the garments further comprise electromagnetic markers on pant legs and torso; a plurality of electromagnetic sensors which detect the locations of the markers; a human-to-computer interface (e.g. voice command interface) which is controlled by the person; a first sling structure onto which the person can place their knees; a second sling structure onto which the person can place their torso; wherein the sling structures move (a) if the person gives the appropriate command and (b) if the sensors indicate that the person's knees and torso are properly positioned in the support structures; and wherein the support structures are moved in arc in 3D space from a first (right or left) side of the bed to a second (left or right) side of the bed, thereby gently moving the person from lying on their first (e.g. right) side to lying on their second (e.g. left) side at their command. Alternatively, a device which can help to prevent decubitus ulcers can comprise: one or more garments which are worn by a person who lies in a bed, wherein the garments further comprise electromagnetic markers on pant legs and torso; a plurality of electromagnetic sensors which detect the locations of the markers; a human-to-computer interface (e.g. voice command interface) which is controlled by the person; a first set of robotic arms which gently engages the person's knees; a second set of robotic arms which gently engage the person's torso; wherein the robotic arms move the person's knees and torso in a sequence of at least five gradual and limited moves, along an arcuate path in 3D space, from a first (right or left) side of the bed to a second (right or left) side of the bed: (a) if the person gives the appropriate command to continue for each of the five sequential gradual and limited moves; and (b) if the sensors indicate that the person's knees and torso are properly positioned for each of the five sequential gradual and limited moves.

In an example, a device to help a person in bed to avoid decubitus ulcers can comprise: one or more garments which are worn by a person who lies in a bed, wherein the garments further comprise electromagnetic markers on pant legs and shirt sleeves; a plurality of electromagnetic sensors which detect the locations of the markers; a human-to-computer interface (e.g. voice command interface) which is controlled by the person; a first soft C-shaped structure into which the person can place their knees; a second soft C-shaped structure into which the person can place their elbows; wherein the support structures move (a) if the person gives the appropriate command and (b) if the sensors indicate that the person's knees and elbows are properly positioned in the support structures; and wherein the support structures are moved, spanning an arc in 3D space, from a first (right or left) side of the bed to a second (left or right) side of the bed, thereby gently moving the person from lying on their first (e.g. right) side to lying on their second (e.g. left) side at their command. Alternatively, a device which helps a person in bed avoid decubitus ulcers can comprise: one or more garments which are worn by a person who lies in a bed, wherein the garments further comprise electromagnetic markers on pant legs and shirt sleeves; a plurality of electromagnetic sensors which detect the locations of the markers; a human-to-computer interface (e.g. voice command interface) which is controlled by the person; a first set of robotic arms which gently engages the person's knees; a second set of robotic arms which gently engage the person's elbows; wherein the robotic arms move the person's knees and elbows, in an arcuate manner, from a first (right or left) side of the bed to a second (right or left) side of the bed: (a) if the person gives the appropriate command; and (b) if the sensors indicate that the person's knees and elbows are properly positioned.

In an example, a device to help a person in bed to avoid decubitus ulcers can comprise: a longitudinal flexible support structure on which a person lies; a plurality of lateral beams (or ribs) which laterally span the width of the support structure above the support structure, wherein the right and left sides (or edges or corners) of the support structure are connected to right and left sides, respectively, of the lateral beams; a longitudinal beam which spans longitudinally under a central portion of the support structure and which is connected to the support structure; and a plurality of actuators which move the connections between the support structure and the lateral beams, thereby changing the slope and/or shape of the support structure to help the person to move from lying on their first (e.g. right) side to lying on their second (e.g. left) side. Alternatively, a device to help a person in bed to avoid decubitus ulcers can comprise: a plurality of longitudinal cords; a plurality of lateral cords; wherein the longitudinal cords and the lateral cords together create an orthogonal mesh or grid which supports a sleeping person's body; and a plurality of actuators which move (selected) longitudinal cords in a lateral manner and move (selected) lateral cords in a longitudinal manner in order to create an opening (or hole) in the mesh or grid at a selected location; wherein the selected location is located under a portion of the sleeping person's body which has a pressure ulcer or is particularly vulnerable to getting a pressure ulcer.

In another example, a device to help a person in bed to avoid decubitus ulcers can comprise: a plurality of longitudinal flexible strips; a plurality of lateral flexible strips; wherein the longitudinal flexible strips and the lateral flexible strips together form an orthogonal mesh or grid which supports a sleeping person's body; and a plurality of actuators which move selected longitudinal strips apart from each other and move selected lateral strips apart from each other in order to enlarge a quadrilateral-shaped opening in the mesh or grid at a selected location; wherein the selected location is located under a portion of the sleeping person's body which has a pressure ulcer or is particularly vulnerable to getting a pressure ulcer. Alternatively, a device which helps a person in bed to avoid decubitus ulcers can comprise: a plurality of longitudinal strips; a plurality of lateral strips; wherein the longitudinal strips and the lateral strips are woven together create an orthogonal mesh or grid which supports a sleeping person's body; and a plurality of actuators which move (selected) longitudinal strips away from each other and move (selected) lateral strips away from each other in order to create an opening (or hole) in the mesh or grid at a selected location; wherein the selected location is located under a portion of the sleeping person's body which has a pressure ulcer or is particularly vulnerable to getting a pressure ulcer.

A device to help a person in bed to avoid decubitus ulcers can comprise: a plurality of longitudinal strips; a plurality of lateral strips; wherein the longitudinal strips and the lateral strips together create an orthogonal mesh or grid which supports a sleeping person's body; and a plurality of actuators which move (selected) longitudinal strips apart from each other and move (selected) lateral strips apart from each other in order to create a quadrilateral-shaped opening in the mesh or grid at a selected location; wherein the selected location is located under a portion of the sleeping person's body which has a pressure ulcer or is particularly vulnerable to getting a pressure ulcer. Alternatively, a device which helps a person in bed to avoid decubitus ulcers can comprise: a plurality of porous longitudinal strips; a plurality of porous lateral strips; wherein the longitudinal strips and the lateral strips together create an orthogonal porous mesh or grid which supports a sleeping person's body; and a plurality of actuators which move (selected) longitudinal strips in a lateral manner and move (selected) lateral strips in a longitudinal manner in order to create an opening (or hole) in the mesh or grid at a selected location; wherein the selected location is located under a portion of the sleeping person's body which has a pressure ulcer or is particularly vulnerable to getting a pressure ulcer.

In another example, a device to help a person in bed to avoid decubitus ulcers can comprise: a plurality of porous longitudinal strips; a plurality of porous lateral strips; wherein the longitudinal strips and the lateral strips together create an orthogonal porous mesh or grid which supports a sleeping person's body; and a plurality of actuators which move (selected) longitudinal strips and move (selected) lateral strips to create an opening (or hole) in the mesh or grid at a selected location; wherein the selected location is located under a portion of the sleeping person's body which has a pressure ulcer or is particularly vulnerable to getting a pressure ulcer. Alternatively, a device which can help to prevent decubitus ulcers can comprise: a longitudinal flexible support structure (such as a reinforced sheet, blanket, pad, mesh, net, or sling) on which a person lies; a right side longitudinal beam to the right of the support structure; a left side longitudinal beam to the left of the support structure; and a central longitudinal beam under a central portion of the support structure; wherein the support structure is attached to the right side, left side, and central longitudinal beams; and a plurality of actuators which move the right side and left side beams closer together and then farther apart, thereby changing the slope and/or shape of the support structure and helping the person to move from lying on their first (e.g. right) side to lying on their second (e.g. left) side.

For example, a device to help a person in bed to avoid decubitus ulcers can comprise: a longitudinal flexible support structure (such as a reinforced sheet, blanket, pad, mesh, net, or sling) on which a person lies; a right side longitudinal beam to the right of the support structure; a left side longitudinal beam to the left of the support structure; and a central longitudinal beam under a central portion of the support structure; wherein the support structure is attached to the right side, left side, and central longitudinal beams; and a plurality of actuators which move the beams closer together or farther apart in a sequential manner, thereby changing the slope and/or shape of the support structure in a sequential manner and helping the person to move from lying on their first (e.g. right) side to lying on their second (e.g. left) side. Alternatively, a device to help a person in bed to avoid decubitus ulcers can comprise: a longitudinal flexible support structure on which a person lies; a right side longitudinal beam to the right of the support structure; a left side longitudinal beam to the left of the support structure; and a central longitudinal beam under a central portion of the support structure; wherein the support structure is attached to the right side, left side, and central longitudinal beams; and a plurality of actuators which move the right side and left side beams closer together and then farther apart, thereby changing the slope and/or shape of the support structure and helping the person to move from lying on their first (e.g. right) side to lying on their second (e.g. left) side.

In another embodiment, a device to help a person in bed to avoid decubitus ulcers can comprise: a longitudinal flexible support structure on which a person lies; a right-side cushion (or pillow) to the right of the person; a left-side cushion (or pillow) to the left of the person; wherein the person is turned from lying on their first (e.g. right) side to lying on their second (e.g. left) side by—moving the right-side and left-side cushions (or pillows) toward the person in a laterally-asymmetric manner, tilting and/or rotating the right-side and left-side cushions around their longitudinal axes, and moving the right-side and left-side cushions away from the person in a laterally-asymmetric manner. Alternatively, a device which helps a person in bed avoid decubitus ulcers can comprise: a longitudinal flexible support structure on which a person lies; a right-side inflatable cushion (or pillow); a left-side inflatable cushion (or pillow); wherein the right-side and left-side cushions are asymmetrically inflated around the person, then tilted and/or rotated, and then deflated.

In another example, a device to help a person in bed to avoid decubitus ulcers can comprise: a longitudinal flexible support structure on which a person lies; a right-side inflatable cushion; a left-side inflatable cushion, wherein the right-side and left-side cushions are inflated during a first period of time, wherein the right-side and left-side cushions are deflated during a second period of time, wherein a first cushion is inflated more than a second cushion during the first period of time, and wherein the second cushion is inflated more than the first cushion during the second period of time. Alternatively, a device which can help to prevent decubitus ulcers can comprise: a longitudinal flexible support structure on which a person lies; a right-side inflatable lateral-wedge-shaped chamber on the right side of the support structure; a left-side inflatable lateral-wedge-shaped chamber on the left side of the support structure; wherein the right-side and left-side chambers are inflated during a first period of time; wherein the right-side and left-side chambers are deflated during a second period of time; wherein a first chamber on a first selected side is inflated more rapidly than a second chamber on a second side during the first period of time; and wherein the first chamber is deflated more rapidly than the second chamber during the second period of time.

In an example, a device to help a person in bed to avoid decubitus ulcers can comprise: a longitudinal flexible support structure on which a person lies; a right-side inflatable lateral-wedge-shaped chamber on the right side of the support structure; a left-side inflatable lateral-wedge-shaped chamber on the left side of the support structure; wherein the right-side and left-side chambers are moved toward the person and inflated during a first period of time; and wherein the right-side and left-side chambers are deflated and moved away from the person during a second period of time. Alternatively, a device which helps a person in bed to avoid decubitus ulcers can comprise: a longitudinal flexible support structure on which a person lies; a right-side inflatable longitudinal air compartment on the right side of the support structure; a left-side inflatable longitudinal air compartment on the left side of the support structure; wherein the right-side and left-side air compartments are inflated during a first period of time; wherein the right-side and left-side air compartments are deflated during a second period of time; wherein a first air compartment on a first selected side is inflated more rapidly than a second air compartment on a second side during the first period of time; and wherein the first air compartment is deflated more rapidly than the second air compartment during the second period of time.

In another example, a device to help a person in bed to avoid decubitus ulcers can comprise: a longitudinal flexible support structure on which a person lies; a right-side inflatable longitudinal air compartment on the right side of the support structure; a left-side inflatable longitudinal air compartment on the left side of the support structure; wherein the right-side and left-side air compartments are inflated during a first period of time; wherein the right-side and left-side air compartments are deflated during a second period of time; wherein a first air compartment on a first selected side is inflated to a larger size than a second air compartment on a second side. Alternatively, a device to help a person in bed to avoid decubitus ulcers can comprise: a longitudinal flexible support structure on which a person lies; a right-side inflatable longitudinal cushion on the right side of the support structure; a left-side inflatable longitudinal cushion on the left side of the support structure; wherein the right-side and left-side cushions are inflated during a first period of time; wherein the right-side and left-side cushions are deflated during a second period of time; wherein a first cushion on a first (right or left) side is inflated to a larger size than a second cushion on a second (left or right) side.

In another embodiment, a device to help a person in bed to avoid decubitus ulcers can comprise: a longitudinal flexible body support surface (such as a net, mesh, pad, sheet, or blanket) on which a person lies; a right-side inflatable member (such as a compartment, bladder, cushion, or wedge) and a left-side inflatable member (such as a compartment, bladder, cushion, or wedge) under the support surface; a mattress under the support surface; and a plurality of actuators; wherein the person is moved from lying on their first (e.g. right) side to lying on their second (e.g. left) side in the following steps (a) lifting the right and left sides of the support surface using the actuators, thereby wrapping the support surface at least partially around the person's torso and lifting the person who was lying on their first (e.g. right) side at least partially up off the mattress with the lateral axis of their torso being substantially vertical; (b) inflating the second side inflatable member so that the second-side inflatable member pushes against the support surface and tilts, pivots, and/or rotates the person's body around a longitudinal axis; and then (c) lowering the right and left sides of the support surface using the actuators, thereby unwrapping the support surface from around the person's torso and lowering the person down onto the mattress lying on their second (e.g. left) side.

Alternatively, a device which can help to prevent decubitus ulcers can comprise: a longitudinal flexible body support surface (such as a net, mesh, pad, sheet, or blanket) on which a person lies; a right-side inflatable member (such as a compartment, bladder, cushion, or wedge) and a left-side inflatable member (such as a compartment, bladder, cushion, or wedge) under the support surface; a mattress under the support surface; and a plurality of actuators; wherein the person is moved from lying on their first (e.g. right) side to lying on their second (e.g. left) side as follows (a) lifting the right and left edges of the support surface using the actuators, thereby wrapping the support surface at least partially around the person's torso and lifting the person who was lying on their first (e.g. right) side at least partially up off the mattress; (b) inflating the right-side and/or left-side inflatable members such that one or both of the inflatable members push against the side of the support surface, thereby tilting, pivoting, and/or rotating the person's body around a longitudinal axis; and then (c) lowering the right and left edges of the support surface using the actuators, thereby unwrapping the support surface from being around the person's torso and lowering the person down onto the mattress lying on their second (e.g. left) side.

For example, a device to help a person in bed to avoid decubitus ulcers can comprise: a longitudinal flexible body support surface (such as a net, mesh, pad, sheet, or blanket) on which a person lies; a right-side inflatable member (such as a compartment, bladder, cushion, or wedge) and a left-side inflatable member (such as a compartment, bladder, cushion, or wedge) under the support surface; a mattress under the support surface; and a plurality of actuators; wherein the person is moved from lying on their first (e.g. right) side to lying on their second (e.g. left) side as follows (a) lifting the right and left edges of the support surface using the actuators, thereby wrapping the support surface at least partially around the person's torso and lifting the person who was lying on their first (e.g. right) side at least partially up off the mattress; (b) inflating the right-side and/or left-side inflatable members such that one or both of the inflatable members push against the side of the support surface, thereby tilting, pivoting, and/or rotating the person's body around a longitudinal axis; (c) lowering the right and left edges of the support surface using the actuators, thereby unwrapping the support surface from being around the person's torso and lowering the person down onto the mattress lying on their second (e.g. left) side; and then (d) deflating the right-side and/or left-side inflatable members. Alternatively, a device which helps a person to avoid decubitus ulcers can comprise: a longitudinal flexible body support surface (such as a net, mesh, pad, sheet, or blanket) on which a person lies; a right-side inflatable wedge and a left-side inflatable wedge under the support surface; and a plurality of actuators; wherein the person is moved from lying on their first (e.g. right) side to lying on their second (e.g. left) side in the following steps (a) lifting the right and left sides of the support surface using the actuators, thereby wrapping the support surface at least partially around the person's torso and lifting the person who was lying on their first (e.g. right) side at least partially up off the mattress with the lateral axis of their torso being substantially vertical; (b) inflating the second side (opposite the first side) inflatable wedge so that the second-side inflatable compartment pushes against the support surface and tilts, pivots, and/or rotates the person's body around a longitudinal axis; and then (c) lowering the right and left sides of the support surface using the actuators, thereby unwrapping the support surface from around the person's torso and lowering the person down onto the mattress lying on their second (e.g. left) side.

In another example, a device to help a person in bed to avoid decubitus ulcers can comprise: a longitudinal flexible body support surface (such as a net, mesh, pad, sheet, or blanket) on which a person lies; a right-side inflatable wedge and a left-side inflatable wedge under the support surface; and a plurality of actuators; wherein the person is moved from lying on their first (e.g. right) side to lying on their second (e.g. left) side in the following steps (a) lifting the right and left sides of the support surface using the actuators, thereby lifting the person who was lying on their first (e.g. right) side at least partially up off the mattress; (b) inflating the second side (opposite the first side) inflatable wedge so that the second-side inflatable compartment pushes against the support surface and tilts, pivots, and/or rotates the person's body around a longitudinal axis; (c) lowering the right and left sides of the support surface using the actuators, thereby lowering the person down onto the mattress lying on their second (e.g. left) side; and then (d) deflating the second side inflatable wedge. Alternatively, a device which helps a person in bed avoid decubitus ulcers can comprise: a longitudinal flexible support structure on which a person lies; a right-side inflatable wedge-shaped cushion (or pillow); a left-side inflatable wedge-shaped cushion (or pillow); wherein the right-side and left-side cushions are moved toward the person and asymmetrically inflated during a first period of time; wherein the right-side and left-side cushions are deflated and moved away from the person during a second period of time.

A device to help a person in bed to avoid decubitus ulcers can comprise: a longitudinal flexible support structure on which a person lies; a right-side inflatable wedge-shaped cushion, wherein the narrower side of the cushion faces toward the person's body; a left-side inflatable wedge-shaped cushion; wherein the narrower side of the cushion faces toward the person's body, wherein the right-side and left-side cushions are inflated during a first period of time, wherein the right-side and left-side cushions are deflated during a second period of time, wherein a first cushion is inflated more than a second cushion during the first period of time, and wherein the second cushion is inflated more than the first cushion during the second period of time. Alternatively, a device to help a person in bed to avoid decubitus ulcers can comprise: a reinforced sheet (or blanket or pad) on which a person lies; a right-side longitudinal beam (or arm) to which the right side of the sheet is attached; a left-side longitudinal beam (or arm) to which the left side of the sheet is attached; a central longitudinal beam (or arm) to which a central longitudinal portion of the sheet is attached; and a plurality of actuators which move the right-side and left-side longitudinal beams (or arms) closer together or farther apart, in a sequential manner, thereby changing the shape of the sheet and helping the person to move from lying on their first (e.g. right) side to lying on their second (e.g. left) side.

In another example, a device to help a person in bed to avoid decubitus ulcers can comprise: a reinforced sheet (or blanket or pad) on which a person lies; a right-side longitudinal beam (or arm) to which the right side of the sheet is attached; a left-side longitudinal beam (or arm) to which the left side of the sheet is attached; a central longitudinal beam (or arm) to which a central longitudinal portion of the sheet is attached; and a plurality of actuators which move the longitudinal beams (or arms) closer together or farther apart, in a sequential manner, thereby changing the shape of the sheet and helping the person to move from lying on their first (e.g. right) side to lying on their second (e.g. left) side. Alternatively, a device which helps a person in bed to avoid decubitus ulcers can comprise: a reinforced sheet (or blanket or pad) on which a person lies; a right-side longitudinal beam (or arm) to which the right side of the sheet is attached; a left-side longitudinal beam (or arm) to which the left side of the sheet is attached; a central longitudinal beam (or arm) to which a central longitudinal portion of the sheet is attached; and a plurality of actuators which move the longitudinal beams (or arms) closer together or farther apart, thereby enfolding around a portion of the persons torso, moving the person from lying on their first (e.g. right) side to lying on their second (e.g. left) side, and unfolding from around the portion of the person's torso.

In an example, a device to help a person in bed to avoid decubitus ulcers can comprise: a longitudinal flexible support structure on which a person lies; a right-side longitudinal cushion along the right side of the support structure; a left-side longitudinal cushion along the left side of the support structure; wherein the right-side and left-side cushions are inflated during a first period of time; wherein the right-side and left-side cushions are deflated during a second period of time; wherein a first cushion on a first selected side is inflated more than a second cushion on a second side during the first period of time; and wherein the first cushion is deflated more than the second cushion during the second period of time. Alternatively, a device which can help to prevent decubitus ulcers can comprise: a first arcuate beam (or rib) which arcs over the width of a bed on which a person lies; a second arcuate beam (or rib) which arcs over the width of the bed, wherein the first beam is closer to the head of the bed than the second arcuate beam; a flexible support structure whose corners (or sides) are connected to the first beam and the second beam; and a plurality of actuators move the locations of the connections between the support structure and the first and second beams, thereby changing the slope and/or shape of the support structure which, in turn, helps the person to turn from lying on their first (e.g. right) side to lying on their second (e.g. left) side.

In an example, a device to help a person in bed to avoid decubitus ulcers can comprise: a first body support surface with a first configuration in which it is below a person's (lower) torso and a second configuration in which it is above a person's (lower) torso, wherein the first body support surface is in its first configuration during a first period of time and in its second configuration during a second period of time; a second body support surface with a third configuration in which it is below the person's (lower) torso and a fourth configuration in which it is above the person's (lower) torso, wherein the second body support surface is in its fourth configuration during the first period of time and in its third configuration during the second period of time; and a plurality of actuators, wherein the actuators rotate the first body support surface from its first configuration to its second configuration and rotate the second body support surface from its fourth configuration to its third configuration.

Alternatively, a device which helps a person in bed to avoid decubitus ulcers can comprise: a first pivoting (and/or rotating) arcuate rib which spans from a first pivot joint at the foot of a bed to a second pivot joint at the head of the bed, wherein the first pivoting arcuate rib has a concave shape which opens toward the bed mattress, wherein the first pivoting arcuate rib has a first configuration in which it spans (from the foot of the bed to the head of the bed) around a portion of the perimeter of the bed mattress and the plane of its concavity is substantially horizontal, wherein the first pivoting arcuate rib has a second configuration in which it spans (from the foot of the bed to the head of the bed) over the bed mattress and the plane of its concavity is substantially vertical, and wherein the first pivoting arcuate rib is manually (or automatically using at least one actuator) pivoted (and/or rotated) from its first configuration to its second configuration, or vice versa; a second pivoting (and/or rotating) arcuate rib which spans from the first pivot joint at the foot of a bed to the second pivot joint at the head of the bed, wherein the second pivoting arcuate rib has a concave shape which opens toward the bed mattress, wherein the second pivoting arcuate rib has a third configuration in which it spans (from the foot of the bed to the head of the bed) around a portion of the perimeter of the bed mattress and the plane of its concavity is substantially horizontal, wherein the second pivoting arcuate rib has a fourth configuration in which it spans (from the foot of the bed to the head of the bed) over the bed mattress and the plane of its concavity intersects a horizontal plane at an angle greater than 45 degrees, and wherein the second pivoting arcuate rib is manually (or automatically using at least one actuator) pivoted (and/or rotated) from its third configuration to its fourth configuration, or vice versa; and a flexible support structure (e.g. reinforced sheet, blanket, pad, net, mesh, strap, or sling) on which a person lies, wherein a first (e.g. right or left) side of the support structure is attached to the first pivoting arcuate rib and a second (e.g. left or right) side of the support structure is attached to the second pivoting arcuate rib, and wherein changing the first pivoting arcuate rib from its first configuration to its second configuration (or vice versa) and changing the second pivoting arcuate rib from its third configuration to its fourth configuration (or vice versa) assists in turning (or automatically turns) the person from lying on their first (e.g. right or left) side to lying on their second (e.g. left or right) side.

In another example, a device to help a person in bed to avoid decubitus ulcers can comprise: a first pivoting (and/or rotating) C-shaped rib which spans from a first pivot joint at the foot of a bed to a second pivot joint at the head of the bed, wherein the first pivoting C-shaped rib has a concave shape which opens toward the bed mattress, wherein the first pivoting C-shaped rib has a first configuration in which it spans (from the foot of the bed to the head of the bed) around a portion of the perimeter of the bed mattress and the plane of its concavity is substantially horizontal, wherein the first pivoting C-shaped rib has a second configuration in which it spans (from the foot of the bed to the head of the bed) over the bed mattress and the plane of its concavity is substantially vertical, and wherein the first pivoting C-shaped rib is manually (or automatically using at least one actuator) pivoted (and/or rotated) from its first configuration to its second configuration, or vice versa; a second pivoting (and/or rotating) C-shaped rib which spans from the first pivot joint at the foot of a bed to the second pivot joint at the head of the bed, wherein the second pivoting C-shaped rib has a concave shape which opens toward the bed mattress, wherein the second pivoting C-shaped rib has a third configuration in which it spans (from the foot of the bed to the head of the bed) around a portion of the perimeter of the bed mattress and the plane of its concavity is substantially horizontal, wherein the second pivoting C-shaped rib has a fourth configuration in which it spans (from the foot of the bed to the head of the bed) over the bed mattress and the plane of its concavity intersects a horizontal plane at an angle greater than 45 degrees, and wherein the second pivoting C-shaped rib is manually (or automatically using at least one actuator) pivoted (and/or rotated) from its third configuration to its fourth configuration, or vice versa; and a flexible support structure (e.g. reinforced sheet, blanket, pad, net, mesh, strap, or sling) on which a person lies, wherein a first (e.g. right or left) side of the support structure is attached to the first pivoting C-shaped rib and a second (e.g. left or right) side of the support structure is attached to the second pivoting C-shaped rib, and wherein changing the first pivoting C-shaped rib from its first configuration to its second configuration (or vice versa) and changing the second pivoting C-shaped rib from its third configuration to its fourth configuration (or vice versa) assists in turning (or automatically turns) the person from lying on their first (e.g. right or left) side to lying on their second (e.g. left or right) side.

Alternatively, a device to help a person in bed to avoid decubitus ulcers can comprise: a first pivoting (and/or rotating) rib which spans from a (laterally-central) pivot joint at the foot of a bed to a (laterally-central) pivot joint at the head of the bed, wherein the first pivoting rib has a concave shape which opens toward the bed mattress, wherein the first pivoting rib has a first configuration in which it spans (from the foot of the bed to the head of the bed) around a portion of the perimeter of the bed mattress and the plane of its concavity is substantially horizontal, wherein the first pivoting rib has a second configuration in which it spans (from the foot of the bed to the head of the bed) over the bed mattress and the plane of its concavity is substantially vertical, and wherein the first pivoting rib is manually (or automatically using at least one actuator) pivoted (and/or rotated) from its first configuration to its second configuration, or vice versa; a second pivoting (and/or rotating) rib which spans from a (laterally-central) pivot joint at the foot of a bed to a (laterally-central) pivot joint at the head of the bed, wherein the second pivoting rib has a concave shape which opens toward the bed mattress, wherein the second pivoting rib has a third configuration in which it spans (from the foot of the bed to the head of the bed) around a portion of the perimeter of the bed mattress and the plane of its concavity is substantially horizontal, wherein the second pivoting rib has a fourth configuration in which it spans (from the foot of the bed to the head of the bed) over the bed mattress and the plane of its concavity is substantially vertical, and wherein the second pivoting rib is manually (or automatically using at least one actuator) pivoted (and/or rotated) from its third configuration to its fourth configuration, or vice versa; and a flexible support structure (e.g. reinforced sheet, blanket, pad, net, mesh, strap, or sling) on which a person lies, wherein a first (e.g. right or left) side of the support structure is attached to the first pivoting rib and a second (e.g. left or right) side of the support structure is attached to the second pivoting rib, and wherein changing the first pivoting rib from its first configuration to its second configuration (or vice versa) and changing the second pivoting rib from its third configuration to its fourth configuration (or vice versa) assists in turning (or automatically turns) the person from lying on their first (e.g. right or left) side to lying on their second (e.g. left or right) side.

For example, a device to help a person in bed to avoid decubitus ulcers can comprise: a first pivoting (and/or rotating) rib which spans from a pivot joint at the foot of a bed to a pivot joint at the head of the bed, wherein the first pivoting rib has a concave shape which opens toward the bed mattress, wherein the first pivoting rib has a first configuration in which it spans (from the foot of the bed to the head of the bed) around a portion of the perimeter of the bed mattress, wherein the first pivoting rib has a second configuration in which it spans (from the foot of the bed to the head of the bed) over the bed mattress, and wherein the first pivoting rib is manually (or automatically using at least one actuator) pivoted (and/or rotated) from its first configuration to its second configuration, or vice versa; a second pivoting (and/or rotating) rib which spans from a pivot joint at the foot of a bed to a pivot joint at the head of the bed, wherein the second pivoting rib has a concave shape which opens toward the bed mattress, wherein the second pivoting rib has a third configuration in which it spans (from the foot of the bed to the head of the bed) around a portion of the perimeter of the bed mattress, wherein the second pivoting rib has a fourth configuration in which it spans (from the foot of the bed to the head of the bed) over the bed mattress, and wherein the second pivoting rib is manually (or automatically using at least one actuator) pivoted (and/or rotated) from its third configuration to its fourth configuration, or vice versa; and a flexible support structure (e.g. reinforced sheet, blanket, pad, net, mesh, strap, or sling) on which a person lies, wherein a first (e.g. right or left) side of the support structure is attached to the first pivoting rib and a second (e.g. left or right) side of the support structure is attached to the second pivoting rib, wherein the support structure spans the entire foot longitudinal half of the bed mattress but does not span the entire head half longitudinal half of the bed mattress, and wherein changing the first pivoting rib from its first configuration to its second configuration (or vice versa) and changing the second pivoting rib from its third configuration to its fourth configuration (or vice versa) assists in turning (or automatically turns) the person from lying on their first (e.g. right or left) side to lying on their second (e.g. left or right) side.

Alternatively, a device which can help to prevent decubitus ulcers can comprise: a first pivoting (and/or rotating) rib which spans from a pivot joint at the foot of a bed to a pivot joint at the head of the bed, wherein the first pivoting rib has a concavity which opens toward the bed mattress, wherein the first pivoting rib has a first configuration in which it spans around a first (e.g. right or left) side of the bed mattress and the plane of its concavity is substantially horizontal, wherein the first pivoting rib has a second configuration in which it spans over the bed mattress and the plane of its concavity is substantially vertical, and wherein the first pivoting rib is manually (or automatically using at least one actuator) pivoted (and/or rotated) from its first configuration to its second configuration, or vice versa; a second pivoting (and/or rotating) rib which spans from a pivot joint at the foot of a bed to a second pivot joint at the head of the bed, wherein the second pivoting rib has a concavity which opens toward the bed mattress, wherein the second pivoting rib has a third configuration in which it spans around a second (e.g. left or right) side of the bed mattress and the plane of its concavity is substantially horizontal, wherein the second pivoting rib has a fourth configuration in which it spans over the bed mattress and the plane of its concavity intersects a horizontal plane at an angle greater than 45 degrees, and wherein the second pivoting rib is manually (or automatically using at least one actuator) pivoted (and/or rotated) from its third configuration to its fourth configuration, or vice versa; and a flexible support structure (e.g. reinforced sheet, blanket, pad, net, mesh, strap, or sling) on which a person lies, wherein a first (e.g. right or left) side of the support structure is attached to the first pivoting rib and a second (e.g. left or right) side of the support structure is attached to the second pivoting rib, and wherein changing the first pivoting rib from its first configuration to its second configuration (or vice versa) and changing the second pivoting rib from its third configuration to its fourth configuration (or vice versa) assists in turning (or automatically turns) the person from lying on their first (e.g. right or left) side to lying on their second (e.g. left or right) side.

In another example, a device to help a person in bed to avoid decubitus ulcers can comprise: a first pivoting (and/or rotating) rib which spans from a pivot joint at the lateral center of the foot of a bed to a pivot joint at the lateral center of the head of the bed, wherein the first pivoting rib has a concavity which opens toward the bed mattress, wherein the first pivoting rib has a first configuration in which it spans around a first (e.g. right or left) side of the bed mattress, wherein the first pivoting rib has a second configuration in which it spans over the bed mattress, and wherein the first pivoting rib is manually (or automatically using at least one actuator) pivoted (and/or rotated) from its first configuration to its second configuration, or vice versa; a second pivoting (and/or rotating) rib which spans from a pivot joint at the lateral center of the foot of a bed to a second pivot joint at the lateral center of the head of the bed, wherein the second pivoting rib has a concavity which opens toward the bed mattress, wherein the second pivoting rib has a third configuration in which it spans around a second (e.g. left or right) side of the bed mattress, wherein the second pivoting rib has a fourth configuration in which it spans over the bed mattress, and wherein the second pivoting rib is manually (or automatically using at least one actuator) pivoted (and/or rotated) from its third configuration to its fourth configuration, or vice versa; and a flexible support structure (e.g. reinforced sheet, blanket, pad, net, mesh, strap, or sling) on which a person lies, wherein a first (e.g. right or left) side of the support structure is attached to the first pivoting rib and a second (e.g. left or right) side of the support structure is attached to the second pivoting rib, and wherein changing the first pivoting rib from its first configuration to its second configuration (or vice versa) and changing the second pivoting rib from its third configuration to its fourth configuration (or vice versa) assists in turning (or automatically turns) the person from lying on their first (e.g. right or left) side to lying on their second (e.g. left or right) side.

Alternatively, a device which helps a person in bed avoid decubitus ulcers can comprise: a first pivoting (and/or rotating) rib which spans from a rotating joint at the foot of a bed to a rotating joint at the head of the bed, wherein the first pivoting rib has a concavity which opens toward a bed mattress, wherein the first pivoting rib has a first configuration in which it spans around a first (e.g. right or left) side of the bed mattress, wherein the first pivoting rib has a second configuration in which it spans over the bed mattress, and wherein the first pivoting rib is manually (or automatically using at least one actuator) pivoted (and/or rotated) from its first configuration to its second configuration, or vice versa; a second pivoting (and/or rotating) rib which spans from a rotating joint at the foot of a bed to a rotating joint at the head of the bed, wherein the second pivoting rib has a concavity which opens toward the bed mattress, wherein the second pivoting rib has a third configuration in which it spans around a second (e.g. left or right) side of the bed mattress, wherein the second pivoting rib has a fourth configuration in which it spans over the bed mattress, and wherein the second pivoting rib is manually (or automatically using at least one actuator) pivoted (and/or rotated) from its third configuration to its fourth configuration, or vice versa; and a flexible support structure (e.g. reinforced sheet, blanket, pad, net, mesh, strap, or sling) on which a person lies, wherein a first (e.g. right or left) side of the support structure is attached to the first pivoting rib and a second (e.g. left or right) side of the support structure is attached to the second pivoting rib, and wherein changing the first pivoting rib from its first configuration to its second configuration (or vice versa) and changing the second pivoting rib from its third configuration to its fourth configuration (or vice versa) assists in turning (or automatically turns) the person from lying on their first (e.g. right or left) side to lying on their second (e.g. left or right) side.

In an example, a device to help a person in bed to avoid decubitus ulcers can comprise: a first pivoting (and/or rotating) rib which spans from a first pivot joint at the foot of a bed to a second pivot joint at the head of the bed, wherein the first pivoting rib has a concave shape which opens toward the bed mattress, wherein the first pivoting rib has a first configuration in which it spans (from the foot of the bed to the head of the bed) around a portion of the perimeter of the bed mattress and the plane of its concavity is substantially horizontal, wherein the first pivoting rib has a second configuration in which it spans (from the foot of the bed to the head of the bed) over the bed mattress and the plane of its concavity is substantially vertical, and wherein the first pivoting rib is manually (or automatically using at least one actuator) pivoted (and/or rotated) from its first configuration to its second configuration, or vice versa; a second pivoting (and/or rotating) rib which spans from the first pivot joint at the foot of a bed to the second pivot joint at the head of the bed, wherein the second pivoting rib has a concave shape which opens toward the bed mattress, wherein the second pivoting rib has a third configuration in which it spans (from the foot of the bed to the head of the bed) around a portion of the perimeter of the bed mattress and the plane of its concavity is substantially horizontal, wherein the second pivoting rib has a fourth configuration in which it spans (from the foot of the bed to the head of the bed) over the bed mattress and the plane of its concavity intersects a horizontal plane at an angle greater than 45 degrees, and wherein the second pivoting rib is manually (or automatically using at least one actuator) pivoted (and/or rotated) from its third configuration to its fourth configuration, or vice versa; and a flexible support structure (e.g. reinforced sheet, blanket, pad, net, mesh, strap, or sling) on which a person lies, wherein a first (e.g. right or left) side of the support structure is attached to the first pivoting rib and a second (e.g. left or right) side of the support structure is attached to the second pivoting rib, and wherein changing the first pivoting rib from its first configuration to its second configuration (or vice versa) and changing the second pivoting rib from its third configuration to its fourth configuration (or vice versa) assists in turning (or automatically turns) the person from lying on their first (e.g. right or left) side to lying on their second (e.g. left or right) side.

Alternatively, a device which can help to prevent decubitus ulcers can comprise: a first pivoting (and/or rotating) square-wave-shaped rib which spans from a first pivot joint at the foot of a bed to a second pivot joint at the head of the bed, wherein the first pivoting square-wave-shaped rib has a concave shape which opens toward the bed mattress, wherein the first pivoting square-wave-shaped rib has a first configuration in which it spans (from the foot of the bed to the head of the bed) around a portion of the perimeter of the bed mattress and the plane of its concavity is substantially horizontal, wherein the first pivoting square-wave-shaped rib has a second configuration in which it spans (from the foot of the bed to the head of the bed) over the bed mattress and the plane of its concavity is substantially vertical, and wherein the first pivoting square-wave-shaped rib is manually (or automatically using at least one actuator) pivoted (and/or rotated) from its first configuration to its second configuration, or vice versa; a second pivoting (and/or rotating) square-wave-shaped rib which spans from the first pivot joint at the foot of a bed to the second pivot joint at the head of the bed, wherein the second pivoting square-wave-shaped rib has a concave shape which opens toward the bed mattress, wherein the second pivoting square-wave-shaped rib has a third configuration in which it spans (from the foot of the bed to the head of the bed) around a portion of the perimeter of the bed mattress and the plane of its concavity is substantially horizontal, wherein the second pivoting square-wave-shaped rib has a fourth configuration in which it spans (from the foot of the bed to the head of the bed) over the bed mattress and the plane of its concavity intersects a horizontal plane at an angle greater than 45 degrees, and wherein the second pivoting square-wave-shaped rib is manually (or automatically using at least one actuator) pivoted (and/or rotated) from its third configuration to its fourth configuration, or vice versa; and a flexible support structure (e.g. reinforced sheet, blanket, pad, net, mesh, strap, or sling) on which a person lies, wherein a first (e.g. right or left) side of the support structure is attached to the first pivoting square-wave-shaped rib and a second (e.g. left or right) side of the support structure is attached to the second pivoting square-wave-shaped rib, and wherein changing the first pivoting square-wave-shaped rib from its first configuration to its second configuration (or vice versa) and changing the second pivoting square-wave-shaped rib from its third configuration to its fourth configuration (or vice versa) assists in turning (or automatically turns) the person from lying on their first (e.g. right or left) side to lying on their second (e.g. left or right) side.

A device to help a person in bed to avoid decubitus ulcers can comprise: a first plurality of parallel flexible strips; a second plurality of parallel flexible strips; a third plurality of parallel flexible strips; wherein the first, second, and third pluralities of parallel flexible strips are woven together to create a hexagonal mesh or grid which supports a sleeping person's body; and a plurality of actuators which move selected strips apart from each other in order to enlarge a hexagonal-shaped opening in the mesh or grid at a selected location; wherein the selected location is located under a portion of the sleeping person's body which has a pressure ulcer or is particularly vulnerable to getting a pressure ulcer. Alternatively, a device to help a person in bed to avoid decubitus ulcers can comprise: a first plurality of parallel flexible strips; a second plurality of parallel flexible strips; wherein the first and second pluralities of parallel flexible strips are woven together to create an orthogonal mesh or grid which supports a sleeping person's body; and a plurality of actuators which move selected strips apart from each other in order to enlarge a quadrilateral-shaped opening in the mesh or grid at a selected location; wherein the selected location is located under a portion of the sleeping person's body which has a pressure ulcer or is particularly vulnerable to getting a pressure ulcer.

In another example, a device to help a person in bed to avoid decubitus ulcers can comprise: a first roller (or tube) at the head a bed (or bed mattress); a second roller (or tube) at the foot of the bed; one or more actuators; and a plurality of moving loops, wherein each loop has longitudinal variation in thickness, wherein an upper portion of each loop spans the length of the bed between the rollers in a first direction; wherein a lower portion of each moving loop spans the length of the bed between the rollers in a second direction; and wherein each loop is rotated around the rollers by the one or more actuators. Alternatively, a device which helps a person in bed to avoid decubitus ulcers can comprise: a first roller (or tube) at the head a bed (or bed mattress); a second roller (or tube) at the foot of the bed; one or more actuators; and a plurality of moving sinusoidal loops, wherein each loop has sinusoidal variation in thickness, wherein an upper portion of each loop spans the length of the bed between the rollers in a first direction; wherein a lower portion of each moving loop spans the length of the bed between the rollers in a second direction; and wherein each loop is rotated around the rollers by the one or more actuators.

In an example, a device to help a person in bed to avoid decubitus ulcers can comprise: a first roller (or tube) at the head a bed (or bed mattress); a second roller (or tube) at the foot of the bed; one or more actuators; and a plurality of moving loops, wherein each loop has longitudinal variation in thickness, wherein an upper portion of each loop spans the length of the bed between the rollers in a first direction; wherein a lower portion of each moving loop spans the length of the bed between the rollers in a second direction; wherein each loop is rotated around the rollers by the one or more actuators; and wherein different loops are moved and/or rotated in different directions. Alternatively, a device which helps a person to avoid decubitus ulcers can comprise: a first roller (or tube) at the head a bed (or bed mattress); a second roller (or tube) at the foot of the bed; one or more actuators; and a plurality of moving sinusoidal loops, wherein each loop has sinusoidal variation in thickness, wherein an upper portion of each loop spans the length of the bed between the rollers in a first direction; wherein a lower portion of each moving loop spans the length of the bed between the rollers in a second direction; wherein each loop is rotated around the rollers by the one or more actuators; and wherein different loops are moved and/or rotated in different directions.

In another example, a device to help a person in bed to avoid decubitus ulcers can comprise: a first roller (or tube) at the head a bed (or bed mattress); a second roller (or tube) at the foot of the bed; one or more actuators; and a plurality of moving loops, wherein each loop has longitudinal variation in thickness, wherein an upper portion of each loop spans the length of the bed between the rollers in a first direction; wherein a lower portion of each moving loop spans the length of the bed between the rollers in a second direction; wherein each loop is rotated around the rollers by the one or more actuators; and wherein adjacent loops are moved and/or rotated in opposite longitudinal directions. Alternatively, a device which helps a person in bed avoid decubitus ulcers can comprise: a first roller (or tube) at the head a bed (or bed mattress); a second roller (or tube) at the foot of the bed; one or more actuators; and a plurality of moving sinusoidal loops, wherein each loop has sinusoidal variation in thickness, wherein an upper portion of each loop spans the length of the bed between the rollers in a first direction; wherein a lower portion of each moving loop spans the length of the bed between the rollers in a second direction; wherein each loop is rotated around the rollers by the one or more actuators; and wherein adjacent loops are moved and/or rotated in opposite longitudinal directions.

For example, a device to help a person in bed to avoid decubitus ulcers can comprise: a first roller (or tube) on a first (e.g. right) side of a bed (or bed mattress); a second roller (or tube) on a second (e.g. left) side of the bed; one or more actuators; and a plurality of moving loops, wherein each loop has lateral variation in thickness, wherein an upper portion of each loop spans the width of the bed between the rollers in a first direction; wherein a lower portion of each moving loop spans the width of the bed between the rollers in a second direction; and wherein each loop is rotated around the rollers by the one or more actuators. Alternatively, a device to help a person in bed to avoid decubitus ulcers can comprise: a first roller (or tube) on a first (e.g. right) side of a bed (or bed mattress); a second roller (or tube) on a second (e.g. left) side of the bed; one or more actuators; and a plurality of moving sinusoidal loops, wherein each loop has sinusoidal variation in thickness, wherein an upper portion of each loop spans the width of the bed between the rollers in a first direction; wherein a lower portion of each moving loop spans the width of the bed between the rollers in a second direction; and wherein each loop is rotated around the rollers by the one or more actuators.

In another embodiment, a device to help a person in bed to avoid decubitus ulcers can comprise: a first roller (or tube) on a first (e.g. right) side of a bed (or bed mattress); a second roller (or tube) on a second (e.g. left) side of the bed; one or more actuators; and a plurality of moving loops, wherein each loop has lateral variation in thickness, wherein an upper portion of each loop spans the width of the bed between the rollers in a first direction; wherein a lower portion of each moving loop spans the width of the bed between the rollers in a second direction; wherein each loop is rotated around the rollers by the one or more actuators; and wherein different loops are moved and/or rotated in different directions. Alternatively, a device which can help to prevent decubitus ulcers can comprise: a first roller (or tube) on a first (e.g. right) side of a bed (or bed mattress); a second roller (or tube) on a second (e.g. left) side of the bed; one or more actuators; and a plurality of moving sinusoidal loops, wherein each loop has sinusoidal variation in thickness, wherein an upper portion of each loop spans the width of the bed between the rollers in a first direction; wherein a lower portion of each moving loop spans the width of the bed between the rollers in a second direction; wherein each loop is rotated around the rollers by the one or more actuators; and wherein different loops are moved and/or rotated in different directions.

In another example, a device to help a person in bed to avoid decubitus ulcers can comprise: a first roller (or tube) on a first (e.g. right) side of a bed (or bed mattress); a second roller (or tube) on a second (e.g. left) side of the bed; one or more actuators; and a plurality of moving loops, wherein each loop has lateral variation in thickness, wherein an upper portion of each loop spans the width of the bed between the rollers in a first direction; wherein a lower portion of each moving loop spans the width of the bed between the rollers in a second direction; wherein each loop is rotated around the rollers by the one or more actuators; and wherein adjacent loops are moved and/or rotated in opposite lateral directions. Alternatively, a device which helps a person in bed to avoid decubitus ulcers can comprise: a first roller (or tube) on a first (e.g. right) side of a bed (or bed mattress); a second roller (or tube) on a second (e.g. left) side of the bed; one or more actuators; and a plurality of moving sinusoidal loops, wherein each loop has sinusoidal variation in thickness, wherein an upper portion of each loop spans the width of the bed between the rollers in a first direction; wherein a lower portion of each moving loop spans the width of the bed between the rollers in a second direction; wherein each loop is rotated around the rollers by the one or more actuators; and wherein adjacent loops are moved and/or rotated in opposite lateral directions.

In an example, a device to help a person in bed to avoid decubitus ulcers can comprise: a first support surface with a first configuration in which it is below a person's (lower) torso and a second configuration in which it is above a person's (lower) torso, wherein the first support surface is in its first configuration during a first period of time and in its second configuration during a second period of time; a second support surface with a third configuration in which it is below the person's (lower) torso and a fourth configuration in which it is above the person's (lower) torso, wherein the second support surface is in its fourth configuration during the first period of time and in its third configuration during the second period of time; and a plurality of actuators; wherein a person is turned from lying on their first (e.g. right or left) side to lying on their second (e.g. left or right side) in the following manner—the first support surface and/or second support surface is inflated; the actuators rotate the first body support surface from its first configuration to its second configuration and rotate the second body support surface from its fourth configuration to its third configuration, and the first support surface and/or the second support surface is deflated. Alternatively, a device which can help to prevent decubitus ulcers can comprise: a first support surface with a first configuration in which it is below a person's (lower) torso and a second configuration in which it is above a person's (lower) torso, wherein the first support surface is in its first configuration during a first period of time and in its second configuration during a second period of time; a second support surface with a third configuration in which it is below the person's (lower) torso and a fourth configuration in which it is above the person's (lower) torso, wherein the second support surface is in its fourth configuration during the first period of time and in its third configuration during the second period of time; and a plurality of actuators; wherein a person is turned from lying on their first (e.g. right or left) side to lying on their second (e.g. left or right side) in the following manner—the second support surface is inflated; the actuators rotate the first body support surface from its first configuration to its second configuration and rotate the second body support surface from its fourth configuration to its third configuration, and the second support surface is deflated.

In another example, a device to help a person in bed to avoid decubitus ulcers can comprise: a first support surface with a first configuration in which it is below a person's (lower) torso and a second configuration in which it is above a person's (lower) torso, wherein the first support surface is in its first configuration during a first period of time and in its second configuration during a second period of time; a second support surface with a third configuration in which it is below the person's (lower) torso and a fourth configuration in which it is above the person's (lower) torso, wherein the second support surface is in its fourth configuration during the first period of time and in its third configuration during the second period of time; and a plurality of actuators; wherein a person is turned from lying on their first (e.g. right or left) side to lying on their second (e.g. left or right side) in the following manner—the second support surface is inflated; the actuators rotate the first body support surface from its first configuration to its second configuration and rotate the second body support surface from its fourth configuration to its third configuration, and the first support surface is deflated. Alternatively, a device to help a person in bed to avoid decubitus ulcers can comprise: a concave bed mattress on which a person lies; an actuator which rotates and/or tilts the bed mattress around a longitudinal (head-to-toe) axis; wherein rotation and/or tilting of the bed mattress helps the person to turn from lying on their first (e.g. right) side to lying on their second (e.g. left) side; a right side cushion (or pillow or chamber) on the right side of the bed mattress; and a left side cushion (or pillow or chamber) on the left side of the bed mattress; wherein the right side cushion and/or the left side cushion are changed from a less-inflated configuration to more-inflated configurations, or vice versa; and wherein the right side cushion is in its more-inflated configuration longer than the left side cushion as the mattress is rotated and/or tilted in a counter-clockwise direction; and wherein the left side cushion is in its more-inflated configuration longer than the right side cushion as the mattress is rotated and/or tilted in a clockwise direction.

A device to help a person in bed to avoid decubitus ulcers can comprise: an arcuate bed mattress on which a person lies; an actuator which rotates and/or tilts the bed mattress around a longitudinal axis; wherein rotation and/or tilting of the bed mattress helps the person to turn from lying on their first (e.g. right) side to lying on their second (e.g. left) side; a right side cushion on the right side of the bed mattress; and a left side cushion on the left side of the bed mattress; wherein the inflation levels of the right side cushion and/or the left side cushion are automatically changed over time; wherein the right side cushion is more inflated or inflated longer than the left side cushion when the mattress is rotated and/or tilted in a clockwise direction; and wherein the left side cushion is more inflated or inflated longer than the right side cushion when the mattress is rotated and/or tilted in a counter-clockwise direction. Alternatively, a device which helps a person in bed to avoid decubitus ulcers can comprise: a bed mattress with a concave upper surface on which a person lies; an actuator which rotates and/or tilts the bed mattress in a clockwise or counter-clockwise direction around a longitudinal head-to-toe axis, wherein rotation and/or tilting of the bed mattress helps the person to turn from lying on a their first (e.g. right) side to their second (e.g. left) side; a first cushion on a first (right or left) side of the bed mattress with an inflation level which is automatically changed over time; a second cushion on a second (left or right) side of the bed mattress with an inflation level which is automatically changed over time; wherein the average inflation level of the first cushion is greater than the average inflation level of the second cushion as the mattress is rotated and/or tilted in a clockwise direction; and wherein the average inflation level of the second cushion is greater than the average inflation level of the first cushion as the mattress is rotated and/or tilted in a counter-clockwise direction.

For example, a device to help a person in bed to avoid decubitus ulcers can comprise: a garment which is worn by a person who lies in a bed, wherein the garment has selected portions (on the legs and sleeves) which are reinforced so that the fabric does not tear and/or the portion does not bind on a person's body when the portion is pulled; an electromagnetic sensor which detects the locations of the selected portions of the garment; at least one robotic arm which first gently grasps (or otherwise reversibly connects with) the selected portions of the garment and then gently pushes or pulls the selected portions (in an arc through space) from a first (right or left) side of the bed to a second (left or right) side of the bed, thereby moving the person from lying on their first (e.g. right) side to lying on their second (e.g. left) side. Alternatively, a device which can help to prevent decubitus ulcers can comprise: a flexible support structure (such as a net, mesh, sling, hammock, pad, sheet, or blanket) on which a person lies; an undulating loop of flexible material which is under the flexible support structure, wherein the loop comprises an upper portion which moves in a selected lateral direction (e.g. right-to-left) and a lower portion which moves in the opposite lateral direction (e.g. left-to-right); and a plurality of actuators which lift the flexible support structure up off the loop of flexible material, move (and/or rotate) the loop of flexible material laterally, and then lower the flexible support structure back down onto the loop of flexible material.

In another example, a device to help a person in bed to avoid decubitus ulcers can comprise: a lower first-side cushion (or pillow) on a first (e.g. right or left) side of the person; an upper first-side cushion (or pillow) which is also on the first side of the person, but above the lower first-side cushion; a lower second-side cushion (or pillow) on a second (e.g. left or right) side of the person; an upper second-side cushion (or pillow) which is also on the second side of the person, but above the lower second-side cushion; wherein the person is turned from lying on their first (e.g. right) side to lying on their second (e.g. left) side by: moving the first and second side lower cushions toward a first portion of the person's torso to hold the first portion of the torso in place; and asymmetrically moving the first and second side upper cushions to push a second portion of the person's torso in a lateral direction. Alternatively, a device which helps a person in bed to avoid decubitus ulcers can comprise: a lower first-side cushion on a first (e.g. right or left) side of the person; an upper first-side cushion which is also on the first side of the person, but above the lower first-side cushion; a lower second-side cushion on a second (e.g. left or right) side of the person; an upper second-side cushion which is also on the second side of the person, but above the lower second-side cushion; wherein the person is turned from lying on their first (e.g. right) side to lying on their second (e.g. left) side by inflation and deflation of the cushions, wherein inflation of the lower cushions holds a first portion of the person's torso in place, and wherein asymmetric inflation of the upper cushions pushes a second portion of the person's torso in a lateral direction.

In another embodiment, a method to help a person in bed to avoid decubitus ulcers can comprise: (a) detecting (based on image analysis or data from optical, pressure, stretch, or electromagnetic energy sensors) that a person in a bed is lying on their side on a mattress; and (b) if the person is lying on their side, temporarily inflating right and left side cushions and changing the mattress from a flat configuration to an arcuate configuration to help the person move from lying on their first (e.g. right) side to lying on their second (e.g. left) side. Alternatively, a method to help a person in bed to avoid decubitus ulcers can comprise: (a) detecting (based on image analysis or data from optical, pressure, stretch, or electromagnetic energy sensors) that a person in a bed is lying on their side on a mattress; and (b) if the person is lying on their side, temporarily rotating and/or tilting the mattress to help the person move from lying on their first (e.g. right) side to lying on their second (e.g. left) side.

In another example, a device to help a person in bed to avoid decubitus ulcers can comprise: a support structure (such as a mattress) on which a person lies, wherein the support structure further comprises a plurality of adjustable portions (e.g. cells, columns, bladders, or compartments) whose sizes and/or shapes can be individually adjusted, and wherein the support structure further comprises a plurality of electromagnetic energy sensors; and a garment (or dressing) which is worn by the person, wherein the garment (or dressing) further comprises at least one electromagnetic energy emitter, wherein a ring of adjustable portions surrounding, but not directly beneath, the electromagnetic energy emitter at a selected time are identified by the electromagnetic energy sensors, and wherein the sizes and/or shapes of the ring of adjustable portions near (e.g. within 6" of) the electromagnetic energy emitter at the selected time are increased relative to the sizes and/or shapes of the rest of the adjustable portions. Alternatively, a device to help a person in bed to avoid decubitus ulcers can comprise: a support structure on which a person lies, wherein the support structure further comprises a plurality of adjustable portions (e.g. cells, columns, bladders, or compartments) whose sizes can be selectively adjusted, and wherein the support structure further comprises a plurality of electromagnetic energy sensors; and a garment (or dressing) which is worn by the person, wherein the garment (or dressing) further comprises an electromagnetic energy emitter, wherein the adjustable portions which are below the electromagnetic energy emitter at a selected time are identified by the electromagnetic energy sensors, and wherein the sizes of the adjustable portions which are near (e.g. within 1" to 6" of) the electromagnetic energy emitter at the selected time are decreased relative to the sizes of the rest of the adjustable portions.

In another embodiment, a device to help a person in bed to avoid decubitus ulcers can comprise: a support structure on which a person lies, wherein the support structure further comprises a plurality of adjustable portions (e.g. cells, columns, bladders, or compartments) whose sizes can be selectively adjusted, and wherein the support structure further comprises a plurality of electromagnetic energy sensors; and a garment (or dressing) which is worn by the person, wherein the garment (or dressing) further comprises an electromagnetic energy emitter, wherein the adjustable portions which are below the electromagnetic energy emitter at a selected time are identified by the electromagnetic energy sensors, and wherein the sizes of the adjustable portions which are near (e.g. within 1" to 2" of) the electromagnetic energy emitter at the selected time are decreased relative to the sizes of the rest of the adjustable portions. Alternatively, a device which helps a person in bed avoid decubitus ulcers can comprise: a support structure on which a person lies, wherein the support structure further comprises a plurality of adjustable portions (e.g. cells, columns, bladders, or compartments) whose sizes can be selectively adjusted, and wherein the support structure further comprises a plurality of electromagnetic energy sensors; and a garment (or dressing) which is worn by the person, wherein the garment (or dressing) further comprises an electromagnetic energy emitter, wherein the adjustable portions which are below the electromagnetic energy emitter at a selected time are identified by the electromagnetic energy sensors, and wherein the sizes of the adjustable portions which are within 6" of the electromagnetic energy emitter at the selected time are decreased relative to the sizes of the rest of the adjustable portions.

In an example, a device to help a person in bed to avoid decubitus ulcers can comprise: a support structure on which a person lies, wherein the support structure further comprises a plurality of inflated portions (e.g. cells, columns, bladders, or compartments) whose inflation levels can be selectively adjusted, and wherein the support structure further comprises a plurality of electromagnetic energy sensors; and a garment (or dressing) which is worn by the person, wherein the garment (or dressing) further comprises an electromagnetic energy emitter, wherein the inflated portions which are farther than a selected distance (e.g. 6") from the electromagnetic energy emitter at a selected time are identified by the electromagnetic energy sensors, and wherein the inflation levels of the inflated portions which are farther than the selected distance from the electromagnetic energy emitter at the selected time are increased relative to the inflation levels of the inflated portions which are closer than the selected distance. Alternatively, a device which helps a person to avoid decubitus ulcers can comprise: a support structure on which a person lies, wherein the support structure further comprises a plurality of adjustable portions (e.g. cells, columns, bladders, or compartments) whose sizes can be individually adjusted, and wherein the support structure further comprises a plurality of electromagnetic energy sensors; and a garment (or dressing) which is worn by the person, wherein the garment (or dressing) further comprises an electromagnetic energy emitter, wherein the adjustable portions which are below the electromagnetic energy emitter at a selected time are identified by the electromagnetic energy sensors, and wherein the sizes of the adjustable portions which are not below the electromagnetic energy emitter at the selected time are increased relative to the sizes of the adjustable portions which are below the electromagnetic energy emitter.

In another example, a device to help a person in bed to avoid decubitus ulcers can comprise: a support structure on which a person lies, wherein the support structure further comprises a plurality of adjustable portions (e.g. cells, columns, bladders, or compartments) whose sizes can be selectively adjusted, and wherein the support structure further comprises a plurality of electromagnetic energy sensors; and a garment (or dressing) which is worn by the person, wherein the garment (or dressing) further comprises an electromagnetic energy emitter, wherein the adjustable portions which are below the electromagnetic energy emitter at a selected time are identified by the electromagnetic energy sensors, and wherein the sizes of the adjustable portions which are not below the electromagnetic energy emitter at the selected time are increased relative to the sizes of the adjustable portions which are below the electromagnetic energy emitter. Alternatively, a device which can help to prevent decubitus ulcers can comprise: a support structure on which a person lies, wherein the support structure further comprises a plurality of inflated portions (e.g. cells, compartments, bladders, or columns) whose inflation levels can be individually adjusted, and wherein the support structure further comprises a plurality of electromagnetic energy sensors; and a garment (or dressing) which is worn by the person, wherein the garment (or dressing) further comprises an electromagnetic energy emitter, wherein inflated portions which are near (e.g. within 6" of) the electromagnetic energy emitter at a selected time are identified by the electromagnetic energy sensors, and wherein the inflation levels of the inflated portions near the electromagnetic energy emitter at the selected time are reduced relative to the inflation levels of the rest of the inflated portions.

For example, a device to help a person in bed to avoid decubitus ulcers can comprise: a support structure on which a person lies, wherein the support structure further comprises a plurality of inflated portions (e.g. cells, compartments, bladders, or columns) whose inflation levels can be individually adjusted, and wherein the support structure further comprises a plurality of electromagnetic energy sensors; and a garment (or dressing) which is worn by the person, wherein the garment (or dressing) further comprises an electromagnetic energy emitter, wherein inflated portions which are near (e.g. within 6" of) the electromagnetic energy emitter at a selected time are identified by the electromagnetic energy sensors, and wherein the inflation levels of the inflated portions near the electromagnetic energy emitter at the selected time are reduced (by at least 20%) relative to the inflation levels of the rest of the inflated portions. Alternatively, a device to help a person in bed to avoid decubitus ulcers can comprise: a support structure on which a person lies, wherein the support structure further comprises a plurality of adjustable portions which each have a first configuration and a second configuration, wherein the second configuration is shorter than the first configuration, and wherein the support structure further comprises a plurality of electromagnetic energy sensors; and a garment (or dressing) which is worn by the person, wherein the garment (or dressing) further comprises at least one electromagnetic energy emitter, wherein the adjustable portions which are within a selected distance (e.g. within 2" to 6") from the electromagnetic energy emitter at a selected time are set to their second configurations but other adjustable portions are set to their first configurations.

In another example, a device to help a person in bed to avoid decubitus ulcers can comprise: a support structure on which a person lies, wherein the support structure further comprises a plurality of adjustable portions whose sizes can be individually adjusted, and wherein the support structure further comprises a plurality of electromagnetic energy sensors; and a garment (or dressing) which is worn by the person, wherein the garment (or dressing) further comprises at least one electromagnetic energy emitter, wherein the adjustable portions which are within a selected distance (between 1" and 6") from the electromagnetic energy emitter at a selected time are identified by the electromagnetic energy sensors, and wherein the sizes of the adjustable portions near (e.g. within 6" of) the electromagnetic energy emitter at the selected time are reduced relative to the sizes of the rest of the adjustable portions. Alternatively, a device which helps a person in bed to avoid decubitus ulcers can comprise: a support structure on which a person lies, wherein the support structure further comprises a plurality of adjustable portions whose sizes and/or shapes can be individually adjusted, and wherein the support structure further comprises a plurality of electromagnetic energy sensors; and a garment (or dressing) which is worn by the person, wherein the garment (or dressing) further comprises at least one electromagnetic energy emitter, wherein the adjustable portions which are within a selected distance (e.g. within 2" to 6") from the electromagnetic energy emitter at a selected time are identified by the electromagnetic energy sensors, and wherein the sizes and/or shapes of the adjustable portions near (e.g. within 6" of) the electromagnetic energy emitter at the selected time are adjusted relative to the sizes and/or shapes of the rest of the adjustable portions.

In an example, a device to help a person in bed to avoid decubitus ulcers can comprise: a support structure on which a person lies, wherein the support structure further comprises a plurality of adjustable portions whose sizes can be individually adjusted, and wherein the support structure further comprises a plurality of electromagnetic energy sensors; and a garment (or dressing) which is worn by the person, wherein the garment (or dressing) further comprises at least one electromagnetic energy emitter, wherein the adjustable portions which are within a selected distance (e.g. with the range of 1" to 6") from the electromagnetic energy emitter at a selected time are identified by the electromagnetic energy sensors, and wherein the sizes of the adjustable portions near (e.g. within 6" of) the electromagnetic energy emitter at the selected time are reduced relative to the sizes of the rest of the adjustable portions. Alternatively, a device which can help to prevent decubitus ulcers can comprise: a support structure on which a person lies, wherein the support structure further comprises a plurality of adjustable portions which each have a first configuration and a second configuration, wherein the second configuration is smaller than the first configuration, and wherein the support structure further comprises a plurality of electromagnetic energy sensors; and a garment (or dressing) which is worn by the person, wherein the garment (or dressing) further comprises at least one electromagnetic energy emitter, wherein the adjustable portions which are near (e.g. within 6" of) the electromagnetic energy emitter at a selected time are set to their second configurations but other adjustable portions are set to their first configurations.

A device to help a person in bed to avoid decubitus ulcers can comprise: a support structure on which a person lies, wherein the support structure further comprises a plurality of adjustable portions (e.g. cells, columns, bladders, or compartments) whose sizes and/or shapes can be individually adjusted; and a garment (or dressing) which is worn by the person, wherein the sizes and/or shapes of adjustable portions which are below (a selected section of) the garment at a given time are adjusted relative to the sizes and/or shapes of the rest of the adjustable portions. Alternatively, a device which helps a person in bed to avoid decubitus ulcers can comprise: a support structure on which a person lies, wherein the support structure further comprises a plurality of adjustable portions (e.g. cells, columns, bladders, or compartments) whose sizes and/or shapes can be individually adjusted; and a garment (or dressing) with a plurality of pressure sensors which is worn by the person, wherein the sizes and/or shapes of adjustable portions which are below (a selected section of) the garment at a given time are adjusted relative to the sizes and/or shapes of the rest of the adjustable portions.

In another example, a device to help a person in bed to avoid decubitus ulcers can comprise: a flexible support structure (such as a net, mesh, hammock, sling, sheet, blanket, mattress pad, folding mattress, articulating mattress, or shape-changing mattress) with a longitudinal axis, wherein a person lies on the flexible support structure on their right side or left side at a first point in time, wherein the support structure has a first configuration which is substantially flat and under the person's body, wherein the support structure has a second configuration with a right-side-facing concavity and wherein the person's body is at least partially within the concavity, and wherein the support structure has a third configuration with a left-side-facing concavity and wherein the person's body is at least partially within the concavity; and a plurality of actuators which move the support structure so that it transitions among its first, second, and third configurations. Alternatively, a device to help a person in bed to avoid decubitus ulcers can comprise: one or more garments which are worn by a person who lies in a bed, wherein the garments further comprise electromagnetic markers on the pant legs and torso; and a plurality of electromagnetic sensors which detect the locations of the markers on the pant legs and torso; and a human-to-computer interface (e.g. voice command interface); and a first support structure with a soft opening into which the person can place their torso; and a second support structure with a soft opening into which the person can place their legs; and wherein the first and second support structures are moved when the person gives the appropriate command via the human-to-computer interface and the person's legs and torso are properly positioned within the first and second support structures based on data from the plurality of electromagnetic energy sensors; and wherein the first and second support structures are moved in an arcuate manner from a first (right or left) side of the bed to a second (left or right) side of the bed, thereby gently moving the person from lying on their first (e.g. right) side to lying on their second (e.g. left) side.

In an example, a device to help a person in bed to avoid decubitus ulcers can comprise: a support structure (such as a mattress) on which a person lies, wherein the support structure further comprises a plurality of height-adjustable portions; and wherein the support structure further comprises a plurality of electromagnetic energy sensors; and a garment (or dressing) which is worn by the person, wherein the garment (or dressing) further comprises at least one electromagnetic energy emitter, wherein the height-adjustable portions which are below the electromagnetic energy emitter at a selected time are identified by the electromagnetic energy sensors, and wherein the heights of the height-adjustable portions which are below the electromagnetic energy emitter at the selected time are set lower than the heights of the rest of the height-adjustable portions. Alternatively, a device which can help to prevent decubitus ulcers can comprise: a support structure (such as a mattress) on which a person lies, wherein the support structure further comprises a plurality of height-adjustable portions; and wherein the support structure further comprises a plurality of electromagnetic energy sensors; and a garment (or dressing) which is worn by the person, wherein the garment (or dressing) further comprises at least one electromagnetic energy emitter, wherein the height-adjustable portions which are below the electromagnetic energy emitter at a selected time are identified by the electromagnetic energy sensors, and wherein the heights of the height-adjustable portions which within a selected distance (in the range of 1" to 6") from the electromagnetic energy emitter at the selected time are set lower than the heights of the rest of the height-adjustable portions.

In another example, a device to help a person in bed to avoid decubitus ulcers can comprise: one or more garments which are worn by a person who lies in a bed, wherein the one or more marked garments have first reinforced and/or padded portions on pant legs and second reinforces and/or padded portions on shirt sleeves; at least one (optical or electromagnetic) sensor which detects the locations of the portions; at least two robotic arms which simultaneously gently engage and move (e.g. push and/or pull) the portions in an arcuate manner from a first (right or left) side of the bed to a second (left or right) side of the bed, thereby gently moving the person from lying on their first (e.g. right) side to lying on their second (e.g. left) side. Alternatively, a device which helps a person in bed avoid decubitus ulcers can comprise: one or more marked garments which are worn by a person who lies in a bed, wherein the one or more marked garments have first markers on the pant legs and second markers on the shirt sleeves; at least one (optical or electromagnetic) sensor which detects the locations of the markers; at least two robotic arms which are programmed to gently engage and push the marked portions of the one or more garments in an arcuate manner from a first (right or left) side of the bed to a second (left or right) side of the bed, thereby moving the person from lying on their first (e.g. right) side to lying on their second (e.g. left) side.

For example, a device to help a person in bed to avoid decubitus ulcers can comprise: one or more marked garments which are worn by a person who lies in a bed, wherein the one or more marked garments have first markers on the pant legs and second markers on the shirt sleeves; at least one (optical or electromagnetic) sensor which detects the locations of the markers; at least two robotic arms which are programmed to gently engage and pull the marked portions of the one or more garments in an arcuate manner from a first (right or left) side of the bed to a second (left or right) side of the bed, thereby moving the person from lying on their first (e.g. right) side to lying on their second (e.g. left) side. Alternatively, a device which helps a person in bed to avoid decubitus ulcers can comprise: a concave mattress on which a person lies; at least one actuator which changes the curvature of concavity of the mattress; at least one inflatable cushion (or pillow or compartment) on a first (right or left) side of the mattress; at least one inflatable cushion (or pillow or compartment) on a second (left or right) side of the mattress; wherein the person is moved from lying on their first (e.g. right) side to lying on their second (e.g. left) side by inflating the cushion on the first side and/or the second side of the mattress and changing the curvature of the concavity of the mattress.

In another embodiment, a device to help a person in bed to avoid decubitus ulcers can comprise: an adjustably-concave mattress on which a person lies; at least one actuator which increases or decreases concavity of the mattress; at least one inflatable cushion (or compartment) on a first (right or left) side of the mattress; at least one inflatable cushion (or compartment) on a second (left or right) side of the mattress; wherein the person is moved from lying on their first (e.g. right) side to lying on their second (e.g. left) side by: inflating and deflating the cushions; and increasing and decreasing the concavity of the mattress. Alternatively, a device to help a person in bed to avoid decubitus ulcers can comprise: a laterally-concave mattress on which a person lies; at least one actuator which increases or decreases the curvature of lateral-concavity of the mattress; at least one inflatable cushion (or compartment) on a first (right or left) side of the mattress; at least one inflatable cushion (or compartment) on a second (left or right) side of the mattress; wherein the person is moved from lying on their first (e.g. right) side to lying on their second (e.g. left) side by inflating the cushion on the first side and/or the second side of the mattress and increasing the curvature of the lateral-concavity of the mattress.

In another example, a device to help a person in bed to avoid decubitus ulcers can comprise: a laterally-tiltable mattress on which a person lies; at least one actuator which laterally tilts the mattress; at least one cushion on a first (right or left) side of the mattress; at least one cushion on a second (left or right) side of the mattress; wherein the person is moved from lying on their first (e.g. right) side to lying on their second (e.g. left) side by moving one or both of the cushions and by laterally tilting the mattress. Alternatively, a device which helps a person to avoid decubitus ulcers can comprise: a smart mattress with a first configuration in which its lateral cross-sectional shape is flat and a second configuration in which its lateral cross-sectional shape is a concave conic section; at least one actuator which moves the mattress from its first configuration to its second configuration, or vice versa; inflatable cushions on the right and left sides of the smart mattress; and at least one air pump which inflates the cushions; wherein a person lying on the smart mattress is moved from lying on their first (e.g. right) side to lying on their second (e.g. left) side by inflation of the cushions by the at least one air pump and by movement of the mattress from its first configuration to its second configuration by the at least one actuator.

In an example, a device to help a person in bed to avoid decubitus ulcers can comprise: a smart mattress with a first configuration which is substantially (laterally) flat and a second configuration which is (laterally) concave; at least one actuator which moves the mattress from its first configuration to its second configuration, and vice versa; inflatable cushions (or pillows or chambers) on the right side and on the left side of the smart mattress; and at least one fluid pump which expands the cushions by filling them with fluid; wherein a person lying on the smart mattress is moved from lying on their first (e.g. right) side to lying on their second (e.g. left) side by expansion of the cushions and by movement of the mattress from its first configuration to its second configuration by the at least one actuator. Alternatively, a device which can help to prevent decubitus ulcers can comprise: a smart mattress with a first configuration which is substantially horizontal and a second configuration which is rotated and/or tilted between 10 and 45 degrees from horizontal around a longitudinal axis; at least one actuator which moves the mattress from its first configuration to its second configuration, and vice versa; inflatable cushions on the right and left sides of the smart mattress; and at least one air pump which inflates the cushions; wherein a person lying on the smart mattress is moved from lying on their first (e.g. right) side to lying on their second (e.g. left) side by inflation of the cushions by the at least one air pump and by movement of the mattress from its first configuration to its second configuration by the at least one actuator.

In another example, a device to help a person in bed to avoid decubitus ulcers can comprise: a smart mattress with a first configuration which is substantially flat and a second configuration with a laterally concave shape and cross-sectional variation in height between 6" and 24"; at least one actuator which moves the mattress from its first configuration to its second configuration, and vice versa; inflatable cushions on the right and left sides of the smart mattress; and at least one air pump which inflates the cushions; wherein a person lying on the smart mattress is moved from lying on their first (e.g. right) side to lying on their second (e.g. left) side by inflation of the cushions by the at least one air pump and by movement of the mattress from its first configuration to its second configuration by the at least one actuator. Alternatively, a device which helps a person in bed avoid decubitus ulcers can comprise: a smart mattress with a first configuration which is substantially horizontal and a second configuration which is rotated and/or tilted by an by an acute angle from horizontal around a longitudinal axis; at least one actuator which moves the mattress from its first configuration to its second configuration, or vice versa; inflatable cushions on the right and left sides of the smart mattress; and at least one air pump which inflates the cushions; wherein a person lying on the smart mattress is moved from lying on their first (e.g. right) side to lying on their second (e.g. left) side by inflation of the cushions by the at least one air pump and by movement of the mattress from its first configuration to its second configuration by the at least one actuator.

A device to help a person in bed to avoid decubitus ulcers can comprise: a longitudinal bed mattress on which a person lies, wherein the upper surface of the mattress has cross-sectional shape which is selected from the group consisting of—parabola, arc of a circle, arc of an ellipse, conic section, catenary, and concave; at least one actuator which rotates and/or tilts the mattress around its longitudinal axis, wherein rotation and/or tilting of the mattress helps the person to move from lying on their first (e.g. right) side to lying on their second (e.g. left) side; a first (right or left) side cushion which can have a more-expanded configuration or a less-expanded configuration; and a second (left or right) side cushion which can have a more-expanded configuration or a less-expanded configuration; wherein the first side cushion and the second side cushion are both in their more-expanded configurations during the rotation and/or tilting of the mattress in order to cushion (or dampen) motion of the person's body during rotation and/or tilting. Alternatively, a device which can help to prevent decubitus ulcers can comprise: a longitudinal bed mattress on which a person lies, wherein the upper surface of the mattress has cross-sectional shape selected from the group consisting of—parabola, arc of a circle, arc of an ellipse, conic section, catenary, and concave; at least one actuator which rotates and/or tilts the mattress around its longitudinal axis, wherein rotation and/or tilting of the mattress helps the person to move from lying on their first (e.g. right) side to lying on their second (e.g. left) side; a first (right or left) side cushion with a first level of inflation and/or expansion which varies over time; and a second (left or right) side cushion with a second level of inflation and/or expansion which varies over time; wherein the maximum first level is greater than the maximum second level during rotation and/or tilting of the mattress in a clockwise direction; and wherein the maximum second level is greater than the maximum first level during rotation and/or tilting of the mattress in a counter-clockwise direction.

For example, a device to help a person in bed to avoid decubitus ulcers can comprise: a longitudinal bed mattress on which a person lies, wherein the upper surface of the mattress has cross-sectional shape which is selected from the group consisting of—parabola, arc of a circle, arc of an ellipse, conic section, catenary, and concave; at least one actuator which rotates and/or tilts the mattress around its longitudinal axis, wherein rotation and/or tilting of the mattress helps the person to move from lying on their first (e.g. right) side to lying on their second (e.g. left) side; a first (right or left) side cushion with a more-expanded configuration at a first time or a less-expanded configuration at a second time; and a second (left or right) side cushion with a more-expanded configuration at the first time or a less-expanded configuration at the second time; wherein the first side cushion and the second side cushion are in their more-expanded configurations during the rotation and/or tilting of the mattress in order to cushion (or dampen) motion of the person's body during rotation and/or tilting. Alternatively, a device to help a person in bed to avoid decubitus ulcers can comprise: a longitudinal bed mattress on which a person lies, wherein the upper surface of the mattress has concave shape; at least one actuator which rotates and/or tilts the mattress around its longitudinal axis, wherein rotation and/or tilting of the mattress helps the person to move from lying on their first (e.g. right) side to lying on their second (e.g. left) side; a first inflated cushion within one foot of a first (right or left) side of the mattress; and a second inflated cushion within one foot of a second (left or right) side of the mattress; wherein the first cushion and the second cushion are sequentially inflated and deflated during the rotation and/or tilting of the mattress.

In another example, a device to help a person in bed to avoid decubitus ulcers can comprise: a mattress on which a person lies, wherein the mattress can be rotated and/or tilted around a longitudinal axis; at least one actuator which rotates and/or tilts the mattress; a first cushion on a first (right or left) side of the mattress; a second cushion on a second (left or right) side of the mattress; wherein the person is moved from lying on their first (e.g. right) side to lying on their second (e.g. left) side by—(a) moving a selected first or second cushion closer to the person's body, (b) tilting the mattress, and then (c) moving the selected first or second cushion away from the person's body. Alternatively, a device which helps a person in bed to avoid decubitus ulcers can comprise: a bed mattress on which a person lies, wherein the mattress has an upper surface with a chevron-shaped cross section and a longitudinal (e.g. head-to-toe) axis; at least one actuator, wherein the actuator rotates and/or tilts the bed mattress (in a clockwise or counter-clockwise manner) around the longitudinal axis, wherein the actuator rotates and/or tilts the mattress in a periodic manner to help the person switch back and forth in a periodic manner from lying on their first (e.g. right) side to lying on their second (e.g. left) side; and a first expandable (e.g. inflatable) cushion to the right of the longitudinal axis; and a second expandable (e.g. inflatable) cushion to the left the longitudinal axis; wherein the first and second expandable cushions are in expanded (e.g. inflated) configurations when the mattress is rotated and/or tilted.

In another embodiment, a device to help a person in bed to avoid decubitus ulcers can comprise: a bed mattress with a concave upper surface on which a person lies and a longitudinal (e.g. head to toe) axis; at least one actuator, wherein the actuator rotates and/or tilts the bed mattress around the longitudinal axis, and wherein rotation and/or tilting of the mattress helps the person to switch from lying on their first (e.g. right) side to lying on their second (e.g. left) side; a first expandable (e.g. inflatable) cushion (or compartment) to the right of the longitudinal axis; and a second expandable (e.g. inflatable) cushion (or compartment) to the left the longitudinal axis; wherein the first and second expandable cushions are in expanded (e.g. inflated) configurations as the mattress is rotated and/or tilted. Alternatively, a method to help a person in bed to avoid decubitus ulcers can comprise: detecting if a person who is lying on a flexible support structure (e.g. a net, mesh, hammock, sling, sheet, blanket, or mattress pad) is lying on their right side or on their left side at a first point in time; automatically activating actuators to move a right edge and a left edge of the flexible support structure closer together so as to at least partially wrap, bend, or enfold the person's torso with the flexible support structure; then automatically activating actuators to move the right edge and the left edge of the flexible support structure in the direction of the side (right or left) on which the person was lying at the first point in time; then automatically activating actuators to tilt and/or rotate the right and left edges of the flexible support structure away from the side (right or left) on which the person was lying at the first point in time; and then automatically activating actuators to move a right edge and a left edge of the flexible support structure farther apart so as to unwrap, unbend, or unfold the flexible support structure from around person's torso.

In another example, a method to help a person in bed to avoid decubitus ulcers can comprise: detecting (based on image analysis or data from optical, pressure, stretch, or electromagnetic energy sensors) that a person in a bed is lying on their first (e.g. right) side on a mattress; detecting (based on image analysis or data from optical, pressure, stretch, or electromagnetic energy sensors) that the person is awake; then, if the person is lying on their side and is awake, asking (via a speaker) the person if they would like to switch sides; receiving (via speech recognition) a response from the person; and then, if the person responds that they would like to switch sides, initiating movement of the mattress to help the person move from lying on their first (e.g. right) side to lying on their second (e.g. left) side. Alternatively, a method to help prevent decubitus ulcers can comprise: detecting (based on image analysis or data from optical, pressure, stretch, or electromagnetic energy sensors) that a person in a bed is lying on their first (e.g. right) side on a mattress; if the person is lying on their side, then asking (via a speaker) the person if they would like to switch sides; receiving (via speech recognition interface) a response from the person; and if the person responds that they would like to switch sides, then initiating movement of the mattress to help the person move from lying on their first (e.g. right) side to lying on their second (e.g. left) side.

In an example, a method to help a person in bed to avoid decubitus ulcers can comprise: detecting (based on image analysis or data from optical, pressure, stretch, or electromagnetic energy sensors) that a person in a bed is lying on their first (e.g. right) side on a mattress; if the person is lying on their side, then prompting the person with a light signal to indicate whether they would like to switch sides; if the person responds (e.g. via speech recognition interface) that they would like to switch sides, then rotating and/or tilting the mattress to help the person move from lying on their first (e.g. right) side to lying on their second (e.g. left) side. Alternatively, a device which can help to prevent decubitus ulcers can comprise: a longitudinal support structure (e.g. mattress) on which a person lies; inflatable chambers (e.g. cushions) along the right and left sides of the support structure; wherein the chambers are inflated on either side of the person so as to temporarily hold the person in place, the support structure is rotated around its longitudinal axis, and then the chambers are deflated to release the person. In another embodiment, a device to help a person in bed to avoid decubitus ulcers can comprise: a longitudinal support structure (such as a mattress) on which a person lies; inflatable chambers (or cushions or pillows) along the right and left sides of the support structure; wherein first the chambers are inflated, then the support structure is rotated between 160 and 200 degrees around its longitudinal axis, and then the chambers are deflated. Alternatively, a device which helps a person in bed to avoid decubitus ulcers can comprise: a mattress on which a person lies on their side; inflatable cushions on the right and left sides of the mattress; and a plurality of actuators; wherein first the cushions are inflated to hold the person on the mattress, then the mattress is tilted and/or rotated around its longitudinal axis, and then the cushions are deflated.

In another example, a method to help prevent decubitus ulcers can comprise: detecting if a person who is lying on a support structure with right side and left side inflatable chambers is lying on their side at a first point in time;

inflating the right side and left side inflatable chambers; rotating and/or tilting the support structure, around a longitudinal axis, from a first orientation to a second orientation, wherein the second orientation is rotated between 160 and 200 degrees from the first orientation; and then deflating the right side and left side inflatable chambers. Alternatively, a method to help a person in bed to avoid decubitus ulcers can comprise: detecting if a person who is lying on a flexible support structure (e.g. a net, mesh, hammock, sling, sheet, blanket, mattress pad, folding mattress, articulating mattress, or shape-changing mattress) is lying on their right side or on their left side at a first point in time; lifting the right and left edges of the flexible support structure which are located to the right and to the left of the person's body; lifting the right edge of the flexible support structure a first distance; lifting the left edge of the flexible support structure a second distance; wherein the first distance is less than the second distance if the person was lying on their right side at the first time; and wherein the first distance is greater than the second distance if the person was lying on their left side at the first time; thereby enfolding and/or wrapping the flexible support structure around a portion of the torso of the person's body; tilting and/or rotating the right and left edges of the flexible support structure to the left if the person was lying on their right side at the first time; or tilting and/or rotating the right and left edges of the flexible support structure to the right if the person was lying on their left side at the first time; moving the flexible support structure to the right if the person was lying on their right side at the first point in time or to the left if the person was lying on their left side at the first point in time; and lowering the right and left edges of the flexible support structure, thereby unfolding and/or unwrapping the flexible support structure from being around the portion of the person's torso, so that the person is now lying on their left side at a second time if the person had been lying on their right side at the first point in time, or so that the person is now lying on their right side at a second time if the person had been lying on their left side at the first point in time.

For example, a method to help prevent decubitus ulcers can comprise: detecting if a person who is lying on a flexible support structure (e.g. a net, mesh, hammock, sling, sheet, blanket, mattress pad, folding mattress, articulating mattress, or shape-changing mattress) is lying on their right side or on their left side at a first point in time; lifting the right and left edges of the flexible support structure which are located to the right and to the left of the person's body; lifting the right edge of the flexible support structure a first distance; lifting the left edge of the flexible support structure a second distance; wherein the first distance is less than the second distance if the person was lying on their right side at the first time; and wherein the first distance is greater than the second distance if the person was lying on their left side at the first time; thereby enfolding and/or wrapping the flexible support structure around a portion of the torso of the person's body; tilting and/or rotating the right and left edges of the flexible support structure to the left if the person was lying on their right side at the first time; or tilting and/or rotating the right and left edges of the flexible support structure to the right if the person was lying on their left side at the first time; and lowering the right and left edges of the flexible support structure, thereby unfolding and/or unwrapping the flexible support structure from being around the portion of the person's torso, so that the person is now lying on their left side at a second time if the person had been lying on their right side at the first point in time, or so that the person is now lying on their right side at a second time if the person had been lying on their left side at the first point in time. Alternatively, a method to help a person in bed to avoid decubitus ulcers can comprise: detecting if a person who is lying on a flexible support structure (e.g. a net, mesh, hammock, sling, sheet, blanket, mattress pad, folding mattress, articulating mattress, or shape-changing mattress) is lying on their right side or on their left side at a first point in time; lifting the right and left edges of the flexible support structure which are located to the right and to the left of the person's body; moving the right edge of the flexible support structure a first distance; moving the left edge of the flexible support structure a second distance; wherein the first distance is less than the second distance if the person was lying on their right side at the first time; and wherein the first distance is greater than the second distance if the person was lying on their left side at the first time; thereby enfolding and/or wrapping the flexible support structure around a portion of the torso of the person's body; moving the flexible support structure to the right if the person was lying on their right side at the first point in time or to the left if the person was lying on their left side at the first point in time; and lowering the right and left edges of the flexible support structure, thereby unfolding and/or unwrapping the flexible support structure from being around the portion of the person's torso, so that the person is now lying on their left side at a second time if the person had been lying on their right side at the first point in time, or so that the person is now lying on their right side at a second time if the person had been lying on their left side at the first point in time.

In another example, a method to help a person in bed to avoid decubitus ulcers can comprise: detecting if a person who is lying on a flexible support structure (e.g. a net, mesh, hammock, sling, sheet, blanket, mattress pad, folding mattress, articulating mattress, or shape-changing mattress) is lying on their right side or on their left side at a first point in time; lifting the right and left edges of the flexible support structure which are located to the right and to the left of the person's body; rotating the right side of the flexible support structure a first angle; rotating the left side of the flexible support structure a second angle; wherein the first angle is less than the second angle if the person was lying on their right side at the first time; and wherein the first angle is greater than the second angle if the person was lying on their left side at the first time; thereby enfolding and/or wrapping the flexible support structure around a portion of the torso of the person's body; tilting and/or rotating the right and left edges of the flexible support structure to the left if the person was lying on their right side at the first time; or tilting and/or rotating the right and left edges of the flexible support structure to the right if the person was lying on their left side at the first time; moving the flexible support structure to the right if the person was lying on their right side at the first point in time or to the left if the person was lying on their left side at the first point in time; and lowering the right and left edges of the flexible support structure, thereby unfolding and/or unwrapping the flexible support structure from being around the portion of the person's torso, so that the person is now lying on their left side at a second time if the person had been lying on their right side at the first point in time, or so that the person is now lying on their right side at a second time if the person had been lying on their left side at the first point in time.

Alternatively, a method to help a person in bed to avoid decubitus ulcers can comprise: detecting if a person who is lying on a flexible support structure (e.g. a net, mesh, hammock, sling, sheet, blanket, mattress pad, folding mattress, articulating mattress, or shape-changing mattress) is lying on their right side or on their left side at a first point in time; lifting the right and left edges of the flexible support structure which are located to the right and to the left of the person's body; rotating the right side of the flexible support structure a first angle; rotating the left side of the flexible support structure a second angle; wherein the first angle is less than the second angle if the person was lying on their right side at the first time; and wherein the first angle is greater than the second angle if the person was lying on their left side at the first time; thereby enfolding and/or wrapping the flexible support structure around a portion of the torso of the person's body; tilting and/or rotating the right and left edges of the flexible support structure to the left if the person was lying on their right side at the first time; or tilting and/or rotating the right and left edges of the flexible support structure to the right if the person was lying on their left side at the first time; and lowering the right and left edges of the flexible support structure, thereby unfolding and/or unwrapping the flexible support structure from being around the portion of the person's torso, so that the person is now lying on their left side at a second time if the person had been lying on their right side at the first point in time, or so that the person is now lying on their right side at a second time if the person had been lying on their left side at the first point in time.

In an example, a method to help prevent decubitus ulcers can comprise: detecting if a person who is lying on a flexible support structure is lying on their right side or on their left side at a first point in time; lifting up the right and left edges of the flexible support structure; wherein these edges are located to the right and to the left of the person's body, respectively; wherein during lifting the right edge of the flexible support structure is moved a first arcuate distance and the left edge of the flexible support structure is moved a second arcuate distance; wherein the first arcuate distance is greater than the second arcuate distance if the person was lying on their right side at the first time; wherein the first arcuate distance is less than the second arcuate distance if the person was lying on their left side at the first time; and wherein lifting causes the flexible support structure to be at least partially wrapped or enfolded around a portion of the person's torso; moving the flexible support structure to the right if the person was lying on their right side at the first point in time or moving the flexible support structure to the to the left if the person was lying on their left side at the first point in time; and lowering the previously-identified right and left edges of the flexible support structure; wherein during lowering the right edge of the flexible support structure is moved a third arcuate distance and the left edge of the flexible support structure is moved a fourth arcuate distance; wherein the third arcuate distance is less than the fourth arcuate distance if the person was lying on their right side at the first time and the third arcuate distance is greater than the fourth arcuate distance if the person was lying on their left side at the first time; wherein lowering unwraps or unfolds the flexible support structure from being around a portion of the person's torso; and wherein, after lowering, the person is now lying on their left side if they were originally lying on their right side at the first point in time or the person is now lying on their right side if they were originally lying on their left side at the first point in time.

Alternatively, a method to help a person in bed to avoid decubitus ulcers can comprise: detecting if a person who is lying on a flexible support structure is lying on their right side or on their left side at a first point in time; lifting up the right and left edges of the flexible support structure; wherein these edges are located to the right and to the left of the person's body, respectively; wherein during lifting the right edge of the flexible support structure is moved a first arcuate distance and the left edge of the flexible support structure is moved a second arcuate distance; wherein the first arcuate distance is greater than the second arcuate distance if the person was lying on their right side at the first time; wherein the first arcuate distance is less than the second arcuate distance if the person was lying on their left side at the first time; and wherein lifting causes the flexible support structure to be at least partially wrapped or enfolded around a portion of the person's torso; moving the flexible support structure to the right if the person was lying on their right side at the first point in time or moving the flexible support structure to the to the left if the person was lying on their left side at the first point in time; and lowering the previously-identified right and left edges of the flexible support structure; wherein during lowering the right edge of the flexible support structure is moved a third arcuate distance and the left edge of the flexible support structure is moved a fourth arcuate distance; wherein the third arcuate distance is greater than the fourth arcuate distance if the person was lying on their right side at the first time and the third arcuate distance is less than the fourth arcuate distance if the person was lying on their left side at the first time; wherein lowering unwraps or unfolds the flexible support structure from being around a portion of the person's torso; and wherein, after lowering, the person is now lying on their left side if they were originally lying on their right side at the first point in time or the person is now lying on their right side if they were originally lying on their left side at the first point in time.

In an example, a method to help prevent decubitus ulcers can comprise: detecting if a person who is lying on a flexible support structure is lying on their right side or on their left side at a first point in time; lifting up the right and left edges of the flexible support structure; wherein these edges are located to the right and to the left of the person's body, respectively; wherein during lifting the right edge of the flexible support structure is raised a first distance and the left edge of the flexible support structure is raised a second distance; wherein the first distance is greater than the second distance if the person was lying on their right side at the first time; wherein the first distance is less than the second distance if the person was lying on their left side at the first time; and wherein lifting causes the flexible support structure to be at least partially wrapped or enfolded around a portion of the person's torso; moving the flexible support structure to the right if the person was lying on their right side at the first point in time or moving the flexible support structure to the to the left if the person was lying on their left side at the first point in time; and lowering the previously-identified right and left edges of the flexible support structure; wherein during lowering the right edge of the flexible support structure is raised a third distance and the left edge of the flexible support structure is raised a fourth distance; wherein the third distance is less than the fourth distance if the person was lying on their right side at the first time and the third distance is greater than the fourth distance if the person was lying on their left side at the first time; wherein lowering unwraps or unfolds the flexible support structure from being around a portion of the person's torso; and wherein, after lowering, the person is now lying on their left side if they were originally lying on their right side at the first point in time or the person is now lying on their right side if they were originally lying on their left side at the first point in time.

Alternatively, a method to help a person in bed to avoid decubitus ulcers can comprise: detecting if a person who is lying on a flexible support structure is lying on their right side or on their left side at a first point in time; lifting up the right and left edges of the flexible support structure; wherein these edges are located to the right and to the left of the person's body, respectively; wherein during lifting the right edge of the flexible support structure is raised a first distance and the left edge of the flexible support structure is raised a second distance; wherein the first distance is greater than the second distance if the person was lying on their right side at the first time; wherein the first distance is less than the second distance if the person was lying on their left side at the first time; and wherein lifting causes the flexible support structure to be at least partially wrapped or enfolded around a portion of the person's torso; moving the flexible support structure to the right if the person was lying on their right side at the first point in time or moving the flexible support structure to the to the left if the person was lying on their left side at the first point in time; and lowering the previously-identified right and left edges of the flexible support structure; wherein during lowering the right edge of the flexible support structure is raised a third distance and the left edge of the flexible support structure is raised a fourth distance; wherein the third distance is greater than the fourth distance if the person was lying on their right side at the first time and the third distance is less than the fourth distance if the person was lying on their left side at the first time; wherein lowering unwraps or unfolds the flexible support structure from being around a portion of the person's torso; and wherein, after lowering, the person is now lying on their left side if they were originally lying on their right side at the first point in time or the person is now lying on their right side if they were originally lying on their left side at the first point in time.

In another example, a method to help prevent decubitus ulcers can comprise: detecting if a person who is lying on a flexible support structure (e.g. a net, mesh, hammock, sling, sheet, blanket, mattress pad, folding mattress, articulating mattress, or shape-changing mattress) is lying on their right side or on their left side at a first point in time; lifting up the right and left sides of the flexible support structure on either side of the person's body; moving the flexible support structure to the right if the person was lying on their right side at the first point in time or to the left if the person was lying on their left side at the first point in time; rotating and/or tilting the flexible support structure around a longitudinal axis; lowering the right and left sides of the flexible support structure on either side of the person's body, so that the person is then lying on their side opposite to the side on which they were lying at the first point in time. Alternatively, a method to help a person in bed to avoid decubitus ulcers can comprise: analyzing images from a camera to detect that a person's body is in a configuration in which the person is ready to be turned from lying on their first (e.g. right or left) side to lying on their second (e.g. left or right) side, wherein in this configuration the person is lying on their side with their arms crossed and/or folder over their torso; receiving a voice command (and/or voice response) from the person which confirms that the person is ready and willing to be turned from lying on their first side to lying on their second side; and sequentially inflating and deflating a cushion (or pillow or compartment) located to the right of the person and a cushion (or pillow or compartment) located to the left of the person, wherein this inflation and deflation tilts and/or rotates the person (around a longitudinal axis) so that the person is turned from lying on their first side to lying on their second side.

In an example, a method to help a person in bed to avoid decubitus ulcers can comprise: analyzing images from a plurality of electromagnetic energy sensors to detect that a person who is lying on a mattress has their body in a configuration which is ready to be turned from lying on their first (e.g. right or left) side to lying on their second (e.g. left or right) side, wherein in this configuration the person is lying on their side with their arms crossed and/or folder over their torso; receiving a voice command (and/or voice response) from the person which confirms that the person is ready and willing to be turned from lying on their first side to lying on their second side; and using a plurality of actuators to tilt and/or rotate the mattress in order to turn the person from lying on their first side to lying on their second side. Alternatively, a method to help a person in bed to avoid decubitus ulcers can comprise: analyzing images from a plurality of pressure sensors (e.g. on a mattress or in a garment) to detect that a person's body is in a configuration in which the person is ready to be turned from lying on their first (e.g. right or left) side to lying on their second (e.g. left or right) side, wherein in this configuration the person is lying on their side with their arms crossed and/or folder over their torso; receiving a voice command (and/or voice response) from the person which confirms that the person is ready and willing to be turned from lying on their first side to lying on their second side; and sequentially inflating and deflating a cushion (or pillow or compartment) located to the right of the person and a cushion (or pillow or compartment) located to the left of the person, wherein this inflation and deflation tilts and/or rotates the person (around a longitudinal axis) so that the person is turned from lying on their first side to lying on their second side.

In another example, a method to help prevent decubitus ulcers can comprise: analyzing images from a plurality of pressure sensors to detect that a person who is lying on a mattress has their body in a configuration which is ready to be turned from lying on their first (e.g. right or left) side to lying on their second (e.g. left or right) side, wherein in this configuration the person is lying on their side with their arms crossed and/or folder over their torso; receiving a voice command (and/or voice response) from the person which confirms that the person is ready and willing to be turned from lying on their first side to lying on their second side; and using a plurality of actuators to tilt and/or rotate the mattress in order to turn the person from lying on their first side to lying on their second side. Alternatively, a method to help a person in bed to avoid decubitus ulcers can comprise: analyzing images from one or more electromagnetic energy sensors (e.g. on a mattress or in a garment) to detect that a person's body is in a configuration in which the person is ready to be turned from lying on their first (e.g. right or left) side to lying on their second (e.g. left or right) side, wherein in this configuration the person is lying on their side with their arms crossed and/or folder over their torso; receiving a voice command (and/or voice response) from the person which confirms that the person is ready and willing to be turned from lying on their first side to lying on their second side; and sequentially inflating and deflating a cushion (or pillow or compartment) located to the right of the person and a cushion (or pillow or compartment) located to the left of the person, wherein this inflation and deflation tilts and/or rotates the person (around a longitudinal axis) so that the person is turned from lying on their first side to lying on their second side.

For example, a method to help prevent decubitus ulcers can comprise: analyzing images from one or more motion sensors to detect that a person's body is in a configuration in which the person is ready to be turned from lying on their first (e.g. right or left) side to lying on their second (e.g. left or right) side, wherein in this configuration the person is lying on their side with their arms crossed and/or folder over their torso; receiving a voice command (and/or voice response) from the person which confirms that the person is ready and willing to be turned from lying on their first side to lying on their second side; and sequentially inflating and deflating a cushion (or pillow or compartment) located to the right of the person and a cushion (or pillow or compartment) located to the left of the person, wherein this inflation and deflation tilts and/or rotates the person (around a longitudinal axis) so that the person is turned from lying on their first side to lying on their second side. Alternatively, a method to help a person in bed to avoid decubitus ulcers can comprise: analyzing images from one or more stretch sensors (e.g. in a garment) to detect that a person's body is in a configuration in which the person is ready to be turned from lying on their first (e.g. right or left) side to lying on their second (e.g. left or right) side, wherein in this configuration the person is lying on their side with their arms crossed and/or folder over their torso; receiving a voice command (and/or voice response) from the person which confirms that the person is ready and willing to be turned from lying on their first side to lying on their second side; and sequentially inflating and deflating a cushion (or pillow or compartment) located to the right of the person and a cushion (or pillow or compartment) located to the left of the person, wherein this inflation and deflation tilts and/or rotates the person (around a longitudinal axis) so that the person is turned from lying on their first side to lying on their second side.

In another embodiment, a device to help a person in bed to avoid decubitus ulcers can comprise: a flexible support structure (such as a net, mesh, hammock, sling, sheet, blanket, mattress pad, folding mattress, articulating mattress, or shape-changing mattress) with a longitudinal axis; wherein a person lies on the flexible support structure on their right side or on their left side at a first point in time; and a plurality of electromagnetic, pneumatic, or hydraulic actuators which raise and lower a right edge and a left edge of the flexible support structure; wherein the plurality of actuators periodically move the right edge and the left edge of the flexible support structure in the following sequence—raising the right edge and the left edge of the flexible support structure, thereby at least partially wrapping or enfolding the flexible support structure around at least a portion of the person's torso; moving the flexible support structure to the right if the person was lying on their right side at the first point in time or moving the flexible support structure to the left if the person was lying on their left side at the first point in time; tilting and/or rotating the flexible support structure around its longitudinal axis; and then lowering the right edge and the left edge of the flexible support structure, thereby unwrapping the flexible support structure from being around a portion of the person's torso. Alternatively, a device to help a person in bed to avoid decubitus ulcers can comprise: a bed mattress on which a person lies; wherein bed mattress has a shape which is selected from the group consisting of—parabola, arc of a circle, arc of an ellipse, conic section, catenary, and concave; an actuator which rotates and/or tilts the bed mattress around a longitudinal axis; wherein rotation and/or tilting of the bed mattress helps the person to turn from lying on their first (e.g. right) side to lying on their second (e.g. left) side; a right side cushion (or pillow or chamber) on the right side of the bed mattress; and a left side cushion (or pillow or chamber) on the left side of the bed mattress; wherein the right side cushion and/or the left side cushion can be changed from a less-inflated configuration or more-inflated configuration; and wherein the right side cushion is in its more-inflated configuration for a longer period of time than the left side cushion when the mattress is rotated and/or tilted in a clockwise direction; and wherein the left side cushion is in its more-inflated configuration for a longer period of time than the right side cushion when the mattress is rotated and/or tilted in a counter-clockwise direction.

In another example, a device to help a person in bed to avoid decubitus ulcers can comprise: an article of clothing which is worn by a person lying in a bed; wherein the article of clothing further comprises pressure sensors on selected areas of the article of clothing; and wherein the article of clothing further comprises a plurality of inflatable nets or meshes on different areas (or portions) of the article of clothing, wherein there is air flow through holes in the nets or meshes, and wherein an inflatable net or mesh on a selected area is inflated based on data from one or more pressure sensors on the selected area. Alternatively, a device which helps a person in bed avoid decubitus ulcers can comprise: a longitudinal mattress on which a sleeping person lies; wherein the mattress further comprises a plurality of movable longitudinal sections which collectively span a cross-section of the mattress; and a plurality of actuators, wherein the actuators change the angles between the movable longitudinal sections by rotating and/or tilting one or more of the movable longitudinal sections around one or more longitudinal axes, wherein the actuators change the angles between the movable longitudinal sections in a side-to-side sequence, and wherein sequential changes in the angles between the movable longitudinal sections help the person to move from lying on their first (e.g. right) side to lying on their second (e.g. left) side.

A device to help a person in bed to avoid decubitus ulcers can comprise: a longitudinal mattress on which a sleeping person lies; wherein the mattress further comprises a plurality of movable longitudinal sections which collectively span a cross-section of the mattress; and a plurality of actuators, wherein the actuators change the angles between the movable longitudinal sections by rotating and/or tilting one or more of the movable longitudinal sections around one or more longitudinal axes, wherein the actuators change the angles between the movable longitudinal sections in a side-to-side wave sequence; wherein sequential changes in the angles between the movable longitudinal sections help the person to move from lying on their first (e.g. right) side to lying on their second (e.g. left) side. Alternatively, a device which helps a person in bed to avoid decubitus ulcers can comprise: a longitudinal mattress on which a sleeping person lies; wherein the mattress further comprises a plurality of movable longitudinal sections which collectively span a cross-section of the mattress; and a plurality of actuators, wherein the actuators change the angles between the movable longitudinal sections by rotating and/or tilting one or more of the movable longitudinal sections around one or more longitudinal axes, creating an side-to-side undulating pattern; wherein the undulating side-to-side pattern helps the person to move from lying on their first (e.g. right) side to lying on their second (e.g. left) side.

In another example, a device to help a person in bed to avoid decubitus ulcers can comprise: a support structure on which a person lies; wherein the support structure further comprises a plurality of adjustable portions (e.g. cells, columns, bladders, or compartments) whose sizes and/or shapes can be individually adjusted; wherein the support structure further comprises a plurality of electromagnetic energy sensors which detect which adjustable portions are below (a selected part of) the person's body at a given time; and wherein the sizes and/or shapes of adjustable portions which are below (a selected part of) the person's body at a given time are adjusted relative to the sizes and/or shapes of the rest of the adjustable portions. Alternatively, a device which can help to prevent decubitus ulcers can comprise: a support structure on which a person lies; wherein the support structure further comprises a plurality of adjustable portions (e.g. cells, columns, bladders, or compartments) whose sizes and/or shapes can be individually adjusted; wherein the support structure further comprises a plurality of pressure sensors which detect which adjustable portions are below (a selected part of) the person's body at a given time; and wherein the sizes and/or shapes of adjustable portions which are below (a selected part of) the person's body at a given time are adjusted relative to the sizes and/or shapes of the rest of the adjustable portions.

In an example, a device to help a person in bed to avoid decubitus ulcers can comprise: a flexible support structure on which a sleeping person lies, wherein the support structure has a longitudinal axis; wherein the support structure has a first configuration in which it is substantially laterally flat and a second configuration in which it is partially laterally folded (along a longitudinal axis) around the person's body; a plurality of actuators which change the support structure from its first configuration to its second configuration, or vice versa; wherein a person is moved from lying on their first (e.g. right) side to lying on their second (e.g. left) side by: (a) activating actuators to change the support structure from its first configuration to its second configuration as the person is lying on their first side, enfolding the person in the support structure; (b) activating actuators to slowly rotate and/or tilt the support structure relative to a longitudinal axis, thereby also slowly rotating and/or tilting the person within the support structure; and (c) activating the actuators to change the support structure from its second configuration to its first configuration, thereby unfolding the support structure and releasing the person lying on their second side. Alternatively, a device to help a person in bed to avoid decubitus ulcers can comprise: a flexible support structure on which a sleeping person lies, wherein the support structure has a longitudinal axis; wherein the support structure has a first configuration in which it is substantially laterally flat and a second configuration in which it is partially laterally folded (along a longitudinal axis) around the person's body; a voice command interface; a plurality of actuators which change the support structure from its first configuration to its second configuration, or vice versa; wherein a person is moved from lying on their first (e.g. right) side to lying on their second (e.g. left) side when the person requests such a move via the voice command interface; wherein a person is moved from lying on their first (e.g. right) side to lying on their second (e.g. left) side by: (a) activating actuators to change the support structure from its first configuration to its second configuration as the person is lying on their first side; (b) activating actuators to slowly rotate and/or tilt the support structure relative to a longitudinal axis, thereby slowly rotating and/or tilting the person enfolded within the support structure; and (c) activating the actuators to change the support structure from its second configuration to its first configuration, resulting in the person is lying on their second side.

For example, a device to help a person in bed to avoid decubitus ulcers can comprise: a bed mattress on which a person lies; wherein the upper surface of a cross-section of the bed mattress has a shape which is selected from the group consisting of—parabola, arc of a circle, arc of an ellipse, conic section, catenary, and concave; an actuator which rotates and/or tilts the bed mattress around a longitudinal (head-to-toe) axis; wherein rotation and/or tilting of the bed mattress helps the person to turn from lying on their first (e.g. right) side to lying on their second (e.g. left) side; a right side cushion (or pillow or chamber) on the right side of the bed mattress; and a left side cushion (or pillow or chamber) on the left side of the bed mattress; wherein the inflation levels of the right side cushion and/or the left side cushion are automatically changed over time; wherein the right side cushion is more inflated than the left side cushion when the mattress is rotated and/or tilted in a first direction; and wherein the left side cushion is more inflated than the right side cushion when the mattress is rotated and/or tilted in a second direction. Alternatively, a device which helps a person to avoid decubitus ulcers can comprise: a bed mattress on which a person lies; wherein the upper surface of a cross-section of the bed mattress has a shape which is selected from the group consisting of—parabola, arc of a circle, arc of an ellipse, conic section, catenary, and concave; an actuator which rotates and/or tilts the bed mattress around a longitudinal (head-to-toe) axis; wherein rotation and/or tilting of the bed mattress helps the person to turn from lying on their first (e.g. right) side to lying on their second (e.g. left) side; a right side cushion on the right side of the bed mattress; and a left side cushion on the left side of the bed mattress; wherein the inflation levels of the right side cushion and/or the left side cushion are automatically changed over time; wherein the right side cushion is more inflated than the left side cushion when the mattress is rotated and/or tilted in a counter-clockwise manner; and wherein the left side cushion is more inflated than the right side cushion when the mattress is rotated and/or tilted in a clockwise manner.

In another example, a device to help a person in bed to avoid decubitus ulcers can comprise: a bed mattress on which a person lies; wherein the upper surface of a cross-section of the bed mattress has a shape which is selected from the group consisting of—parabola, arc of a circle, arc of an ellipse, conic section, catenary, and concave; an actuator which rotates and/or tilts the bed mattress around a longitudinal (head-to-toe) axis; wherein rotation and/or tilting of the bed mattress helps the person to turn from lying on their first (e.g. right) side to lying on their second (e.g. left) side; a right-side cushion (or pillow) on the right side of the bed mattress; and a left-side cushion (or pillow) on the left side of the bed mattress; wherein the right-side cushion and/or the left side cushion can be changed from a less-inflated configuration to a more-inflated configuration; and wherein the right-side cushion is in its more-inflated configuration when the mattress is rotated and/or tilted to the right; and wherein the left-side cushion is in its more-inflated configuration when the mattress is rotated and/or tilted to the left. Alternatively, a device which can help to prevent decubitus ulcers can comprise: a support structure (such as a mattress) on which a person lies, wherein the support structure further comprises a plurality of height-adjustable solenoids whose heights can be individually adjusted; a camera which records images which are analyzed to determine the location of a selected part of the person's body on the support structure at a selected time; wherein the heights of the solenoids which are below the selected part of the person's body at the selected time are set lower than the heights of the rest of the solenoids.

In another embodiment, a device to help a person in bed to avoid decubitus ulcers can comprise: a support structure (such as a mattress) on which a person lies, wherein the support structure further comprises a plurality of inflated portions (e.g. cells, compartments, bladders, or columns) whose inflation levels can be individually adjusted; a camera which records images which are analyzed to identify the areas where the person's body rests on the support structure at a selected time; wherein the inflated portions which are below the identified areas at the selected time are inflated less than the rest of the inflated portions. Alternatively, a device which helps a person in bed avoid decubitus ulcers can comprise: a flexible support structure (e.g. net, mesh, hammock, sling, sheet, or blanket) on which a person lies; a first arch which curves over the width of the support structure, wherein the first arch is less than two feet away from the head of the support structure, wherein two sides or edges of the support structure are connected to the first arch; a second arch which curves over the width of the support structure, wherein the second arch is less than two feet away from the foot of the support structure, wherein two other sides or edges of the support structure are connected to the second arch, and wherein the support structure is suspended between the first arch and the second arch; and a plurality of actuators which move the connections between the support structure and the arches, thereby changing the slope and/or shape of the support structure and helping the person to turn from lying on their first (e.g. right) side to lying on their second (e.g. left) side.

In another example, a device to help a person in bed to avoid decubitus ulcers can comprise: a longitudinal flexible support structure on which a person lies, wherein the support structure further comprises a head portion which is closer to the person's head and a foot portion which is closer to the person's foot; a first arcuate beam which arcs over the width of the support structure, wherein corners (or edges or sides) of the head portion of the support structure are connected to the first arcuate beam at a plurality of connections; a second arcuate beam which arcs over the width of the support structure, wherein corners (or edges or sides) of the foot portion of the support structure are connected to the second arcuate beam at a plurality of connections; and a plurality of actuators which move the connections on the first arcuate beam and the connections on the second arcuate beam; wherein the plurality of actuators move the connections in the following sequence—firstly, the actuators move the connections on the first arcuate beam closer together and the connections on the second arcuate beam closer together, thereby gently folding the support structure around the person's body as the person lies on their first (e.g. right or left) side; secondly, the actuators jointly move the connections on the first arcuate beam along the first arcuate beam and jointly move the connections on the second arcuate beam along the second arcuate beam, thereby rotating and/or tilting the upper portion of the person's body toward their second (e.g. left or right) side; and thirdly, the actuators move the connections on the first arcuate beam farther apart and move the connections on the second arcuate beam farther apart, thereby gently unfolding the support structure from the person's body and leaving the person lying on their second side.

Alternatively, a device to help a person in bed to avoid decubitus ulcers can comprise: a longitudinal flexible support structure on which a person lies, wherein the support structure further comprises a head portion which is closer to the person's head and a foot portion which is closer to the person's foot; a first arcuate beam which curves over the width of the support structure, wherein corners (or edges) of the head portion of the support structure are connected to the first beam at a plurality of connections; a second arcuate beam which curves over the width of the support structure, wherein corners (or edges) of the foot portion of the support structure are connected to the second arcuate beam at a plurality of connections; wherein the support structure is suspended between the first arcuate beam and the second arcuate beam; and a plurality of actuators which move the connections on the first arcuate beam and the connections on the second arcuate beam; wherein the plurality of actuators move the connections in the following sequence—firstly, the actuators move the connections on the first arcuate beam closer together and the connections on the second arcuate beam closer together, thereby gently folding the support structure around the person's body as the person is lying on their first side; secondly, the actuators jointly move the connections on the first arcuate beam along the first arcuate beam and jointly move the connections on the second arcuate beam along the second arcuate beam, thereby rotating and/or tilting the person's body; and thirdly, the actuators move the connections on the first arcuate beam farther apart and move the connections on the second arcuate beam farther apart, thereby gently unfolding the support structure from the person's body and leaving the person lying on their second side.

In an example, a device to help a person in bed to avoid decubitus ulcers can comprise: a concave flexible support structure (e.g. net, mesh, hammock, sling, sheet, or blanket) on which a person lies; a first arcuate beam which spans (in an arc) over and across the width of the support structure, wherein two corners or edges of the support structure are connected to the first arcuate beam; a second arcuate beam which spans (in an arc) over and across the width of the support structure, wherein the first arcuate beam is closer to the head of the support structure than the second arcuate beam, wherein two other corners or edges of the support structure are connected to the second arcuate beam, and wherein the support structure is suspended between the first arcuate beam and the second arcuate beam; and a plurality of actuators which move the connections between the support structure and the arcuate beams, thereby changing the slope and/or shape of the support structure suspended between the first and second arcuate beams, thereby helping the person to turn from lying on their first (e.g. right) side to lying on their second (e.g. left) side. Alternatively, a device which can help to prevent decubitus ulcers can comprise: a longitudinal flexible support structure on which a person lies, wherein the support structure further comprises a head portion which is closer to the person's head and a foot portion which is closer to the person's foot; a first arcuate rib which curves over the width of the support structure, wherein two corners (or sides) of the head portion of the support structure are connected to the first rib at two connections; a second arcuate rib which curves over the width of the support structure, wherein two corners (or sides) of the foot portion of the support structure are connected to the second arcuate rib at two connections; and a plurality of actuators which move the connections on the first arcuate rib and the connections on the second arcuate rib; wherein the plurality of actuators move the connections in the following sequence—firstly, the actuators move the connections on the first arcuate rib closer together and the connections on the second arcuate rib closer together, thereby gently enfolding the support structure around the person's body as the person lies on their first (e.g. right) side; secondly, the actuators jointly move the connections on the first arcuate rib along the first arcuate rib and jointly move the connections on the second arcuate rib along the second arcuate rib, thereby rotating and/or tilting the person's body; and thirdly, the actuators move the connections on the first arcuate rib farther apart and move the connections on the second arcuate rib farther apart, thereby gently unfolding the support structure from the person's body and leaving the person lying on their second (e.g. left) side.

A device to help a person in bed to avoid decubitus ulcers can comprise: a bed mattress on which a person lies; a first inflatable compartment (or cushion) with an inflation level which varies over time on a first (right or left) side of the mattress; a second inflatable compartment (or cushion) with an inflation level which varies over time on a second (left or right) side of the mattress; wherein the first and second inflatable compartments are both inflated during a first time period, but the first compartment is inflated more than the second compartment; wherein the first and second inflatable compartments are both deflated during a second time period, but the first compartment is deflated more than the second compartment; and wherein the person is moved from lying on their first (e.g. right) side to lying on their second (e.g. left) side during the first and second time periods by sequential inflation and deflation of the first and second inflatable compartments. Alternatively, a device which helps a person in bed to avoid decubitus ulcers can comprise: an article of clothing which is worn by a person lying in a bed; a first set of one or more pressure sensors integrated into a first portion of the article of clothing; a second set of one or more pressure sensors integrated into a second portion of the article of clothing; a first porous but inflatable net or mesh integrated into the first portion of the article of clothing; a second porous but inflatable net or mesh integrated into the second portion of the article of clothing; wherein the first net or mesh is inflated based on pressure level and/or duration measured by the first set of one or more pressure sensors; and wherein the second net or mesh is inflated based on pressure level and/or duration measured by the second set of one or more pressure sensors.

In another example, a device to help a person in bed to avoid decubitus ulcers can comprise: an article of clothing which is worn by a person lying in a bed; a first set of one or more pressure sensors integrated into a first portion of the article of clothing; a second set of one or more pressure sensors integrated into a second portion of the article of clothing; a first concentric array of inflatable micro-bladders integrated into the first portion of the article of clothing; a second concentric array of inflatable micro-bladders integrated into the second portion of the article of clothing; wherein the first net or mesh is inflated based on pressure level and/or duration measured by the first set of one or more pressure sensors; and wherein the second net or mesh is inflated based on pressure level and/or duration measured by the second set of one or more pressure sensors. Alternatively, a device which helps a person in bed to avoid decubitus ulcers can comprise: an article of clothing which is worn by a person lying in a bed; a first set of one or more pressure sensors integrated into a first portion of the article of clothing; a second set of one or more pressure sensors integrated into a second portion of the article of clothing; a first radial array of inflatable micro-bladders integrated into the first portion of the article of clothing; a second radial array of inflatable micro-bladders integrated into the second portion of the article of clothing; wherein the first net or mesh is inflated based on pressure level and/or duration measured by the first set of one or more pressure sensors; and wherein the second net or mesh is inflated based on pressure level and/or duration measured by the second set of one or more pressure sensors.

For example, a device to help a person in bed to avoid decubitus ulcers can comprise: an article of clothing which is worn by a person lying in a bed; a first set of one or more pressure sensors integrated into a first portion of the article of clothing; a second set of one or more pressure sensors integrated into a second portion of the article of clothing; a first porous grid of inflatable micro-chambers integrated into the first portion of the article of clothing; a second porous grid of inflatable micro-chambers integrated into the second portion of the article of clothing; wherein the first net or mesh is inflated based on pressure level and/or duration measured by the first set of one or more pressure sensors; and wherein the second net or mesh is inflated based on pressure level and/or duration measured by the second set of one or more pressure sensors. Alternatively, a device to help a person in bed to avoid decubitus ulcers can comprise: an article of clothing which is worn by a person lying in a bed; a first set of one or more pressure sensors on a first portion (or section) of the article of clothing; a second set of one or more pressure sensors on a second portion (or section) of the article of clothing; a first porous array of inflatable micro-bladders on the first portion or section of the article of clothing; a second porous array of inflatable micro-bladders on the second portion or section of the article of clothing; wherein the first net or mesh is inflated based on pressure level and/or duration measured by the first set of one or more pressure sensors; and wherein the second net or mesh is inflated based on pressure level and/or duration measured by the second set of one or more pressure sensors.

In another example, a device to help a person in bed to avoid decubitus ulcers can comprise: an article of clothing which is worn by a person lying in a bed; a first set of one or more pressure sensors on a first portion or section of the article of clothing; a second set of one or more pressure sensors on a second portion or section of the article of clothing; a first porous but inflatable net or mesh on the first portion or section of the article of clothing; a second porous but inflatable net or mesh on the second portion or section of the article of clothing; wherein the first net or mesh is inflated based on pressure level and/or duration measured by the first set of one or more pressure sensors; and wherein the second net or mesh is inflated based on pressure level and/or duration measured by the second set of one or more pressure sensors. Alternatively, a device which helps a person in bed avoid decubitus ulcers can comprise: an article of clothing which is worn by a person lying in a bed; a first set of one or more pressure sensors on a first portion or section of the article of clothing; a second set of one or more pressure sensors on a second portion or section of the article of clothing; a first nested array of inflatable micro-bladders on the first portion or section of the article of clothing; a second nested array of inflatable micro-bladders on the second portion or section of the article of clothing; wherein the first net or mesh is inflated based on pressure level and/or duration measured by the first set of one or more pressure sensors; and wherein the second net or mesh is inflated based on pressure level and/or duration measured by the second set of one or more pressure sensors.

In another embodiment, a device to help a person in bed to avoid decubitus ulcers can comprise: an article of clothing which is worn by a person lying in a bed; a first set of one or more pressure sensors on a first portion or section of the article of clothing; a second set of one or more pressure sensors on a second portion or section of the article of clothing; a first porous grid of inflatable micro-bladders on the first portion or section of the article of clothing; a second porous grid of inflatable micro-bladders on the second portion or section of the article of clothing; wherein the first net or mesh is inflated based on pressure level and/or duration measured by the first set of one or more pressure sensors; and wherein the second net or mesh is inflated based on pressure level and/or duration measured by the second set of one or more pressure sensors. Alternatively, a device which can help to prevent decubitus ulcers can comprise: an article of clothing which is worn by a person lying in a bed; a first set of one or more pressure sensors on a first portion or section of the article of clothing; a second set of one or more pressure sensors on a second portion or section of the article of clothing; a first porous grid of inflatable micro-bubbles on the first portion or section of the article of clothing; a second porous grid of inflatable micro-bubbles on the second portion or section of the article of clothing; wherein the first net or mesh is inflated based on pressure level and/or duration measured by the first set of one or more pressure sensors; and wherein the second net or mesh is inflated based on pressure level and/or duration measured by the second set of one or more pressure sensors.

In an example, a device to help a person in bed to avoid decubitus ulcers can comprise: an article of clothing which is worn by a person lying in a bed; a first set of one or more pressure sensors which is attached to a first area of the article of clothing; a second set of one or more pressure sensors which is attached to a second area of the article of clothing; a first porous but inflatable net or mesh which is attached to the first area of the article of clothing; a second porous but inflatable net or mesh which is attached to the second area of the article of clothing; wherein the first net or mesh is inflated based on prolonged high pressure levels measured by the first set of one or more pressure sensors; and wherein the second net or mesh is inflated based on prolonged pressure levels measured by the second set of one or more pressure sensors. Alternatively, a device which helps a person in bed to avoid decubitus ulcers can comprise: an article of clothing which is worn by a person lying in a bed; a first set of one or more pressure sensors which is woven into a first area of the article of clothing; a second set of one or more pressure sensors which is woven into a second area of the article of clothing; a first porous but inflatable net or mesh which is woven into the first area of the article of clothing; a second porous but inflatable net or mesh which is woven into the second area of the article of clothing; wherein the first net or mesh is inflated based on data from the first set of one or more pressure sensors; and wherein the second net or mesh is inflated based on data from the second set of one or more pressure sensors.

In another example, a device to help a person in bed to avoid decubitus ulcers can comprise: a flexible and breathable (e.g. porous to gas and liquid) upper support surface (e.g. sheet, pad, blanket, net, or mesh) on which a sleeping person lies; a flexible and breathable (e.g. porous to gas and liquid) middle support surface (e.g. sheet, pad, blanket, net, or mesh) below the upper support surface, wherein the middle support surface is automatically moved along a first (e.g. longitudinal or lateral) axis by one or more actuators, wherein the middle support surface has a first surface portion with a first elasticity level and a second surface portion with a second elasticity level, wherein the second elasticity level is greater than the first elasticity level, and wherein the second surface portion is smaller than (and nested within) the first surface portion; and a flexible and breathable (e.g. porous to gas and liquid) lower support surface (e.g. sheet, pad, blanket, net, or mesh) below the middle support surface, wherein the lower support surface is automatically moved along a second axis by one or more actuators, wherein the second axis is perpendicular to the first axis, wherein the middle support surface has a third surface portion with a third elasticity level and a fourth surface portion with a fourth elasticity level, wherein the fourth elasticity level is greater than the third elasticity level, wherein the fourth surface portion is smaller than (and nested within) the third surface portion, and wherein middle support surface and the lower support surface are moved so as to overlap the second surface portion and the fourth surface portion, thereby creating a localized surface portion with greater elasticity below a selected part of the sleeping person's body that has a pressure ulcer and/or is particularly vulnerable to developing a pressure ulcer.

Alternatively, a device to help a person in bed to avoid decubitus ulcers can comprise: a flexible and breathable (e.g. porous to gas and liquid) upper support surface (e.g. sheet, pad, blanket, net, or mesh) on which a sleeping person lies; a flexible and breathable (e.g. porous to gas and liquid) middle support surface (e.g. sheet, pad, blanket, net, or mesh) below the upper support surface, wherein the middle support surface is automatically moved along a first (e.g. longitudinal or lateral) axis by one or more actuators, wherein the middle support surface has a first surface portion with a first durometer level and a second surface portion with a second durometer level, wherein the second durometer level is lower than the first durometer level, and wherein the second surface portion is smaller than (and nested within) the first surface portion; and a flexible and breathable (e.g. porous to gas and liquid) lower support surface (e.g. sheet, pad, blanket, net, or mesh) below the middle support surface, wherein the lower support surface is automatically moved along a second axis by one or more actuators, wherein the second axis is perpendicular to the first axis, wherein the middle support surface has a third surface portion with a third durometer level and a fourth surface portion with a fourth durometer level, wherein the fourth durometer level is lower than the third durometer level, wherein the fourth surface portion is smaller than (and nested within) the third surface portion, and wherein middle support surface and the lower support surface are moved so as to overlap the second surface portion and the fourth surface portion, thereby creating a localized surface portion with lower durometer below a selected part of the sleeping person's body that has a pressure ulcer and/or is particularly vulnerable to developing a pressure ulcer.

In an example, a device to help a person in bed to avoid decubitus ulcers can comprise: a flexible and breathable (e.g. porous to gas and liquid) upper support surface (e.g. sheet, pad, blanket, net, or mesh) on which a sleeping person lies; a flexible and breathable (e.g. porous to gas and liquid) middle support surface (e.g. sheet, pad, blanket, net, or mesh) below the upper support surface, wherein the middle support surface is automatically moved along a first (e.g. longitudinal or lateral) axis by one or more actuators, wherein the middle support surface has a first surface portion with a first stretchability level and a second surface portion with a second stretchability level, wherein the second stretchability level is greater than the first stretchability level, and wherein the second surface portion is smaller than (and nested within) the first surface portion; and a flexible and breathable (e.g. porous to gas and liquid) lower support surface (e.g. sheet, pad, blanket, net, or mesh) below the middle support surface, wherein the lower support surface is automatically moved along a second axis by one or more actuators, wherein the second axis is perpendicular to the first axis, wherein the middle support surface has a third surface portion with a third stretchability level and a fourth surface portion with a fourth stretchability level, wherein the fourth stretchability level is greater than the third stretchability level, wherein the fourth surface portion is smaller than (and nested within) the third surface portion, and wherein middle support surface and the lower support surface are moved so as to overlap the second surface portion and the fourth surface portion, thereby creating a localized surface portion with greater stretchability below a selected part of the sleeping person's body that has a pressure ulcer and/or is particularly vulnerable to developing a pressure ulcer.

Alternatively, a device which can help to prevent decubitus ulcers can comprise: a flexible and breathable (e.g. porous to gas and liquid) upper support surface (e.g. sheet, pad, blanket, net, or mesh) on which a sleeping person lies; a flexible and breathable (e.g. porous to gas and liquid) middle support surface (e.g. sheet, pad, blanket, net, or mesh) below the upper support surface, wherein the middle support surface is automatically moved along a first (e.g. longitudinal or lateral) axis by one or more actuators, wherein the middle support surface has a first surface portion with a first flexibility level and a second surface portion with a second flexibility level, wherein the second flexibility level is greater than the first flexibility level, and wherein the second surface portion is smaller than (and nested within) the first surface portion; and a flexible and breathable (e.g. porous to gas and liquid) lower support surface (e.g. sheet, pad, blanket, net, or mesh) below the middle support surface, wherein the lower support surface is automatically moved along a second axis by one or more actuators, wherein the second axis is perpendicular to the first axis, wherein the middle support surface has a third surface portion with a third flexibility level and a fourth surface portion with a fourth flexibility level, wherein the fourth flexibility level is greater than the third flexibility level, wherein the fourth surface portion is smaller than (and nested within) the third surface portion, and wherein middle support surface and the lower support surface are moved so as to overlap the second surface portion and the fourth surface portion, thereby creating a localized surface portion with greater stretchability below a selected part of the sleeping person's body that has a pressure ulcer and/or is particularly vulnerable to developing a pressure ulcer.

In another example, a device to help a person in bed to avoid decubitus ulcers can comprise: a flexible and breathable (e.g. porous to gas and liquid) upper support surface (e.g. sheet, pad, blanket, net, or mesh) on which a sleeping person lies; a flexible and breathable (e.g. porous to gas and liquid) middle support surface (e.g. sheet, pad, blanket, net, or mesh) below the upper support surface, wherein the middle support surface is automatically moved along a first (e.g. longitudinal or lateral) axis by one or more actuators, wherein the middle support surface has a first opening (or hole); and a flexible and breathable (e.g. porous to gas and liquid) lower support surface (e.g. sheet, pad, blanket, net, or mesh) below the middle support surface, wherein the lower support surface is automatically moved along a second axis by one or more actuators, wherein the second axis is perpendicular to the first axis, wherein the middle support surface has a second opening (or hole), and wherein middle support surface and the lower support surface are moved so as to overlap the first opening (or hole) and the second opening (or hole), thereby creating a localized opening (or hole) below a selected part of the sleeping person's body that has a pressure ulcer and/or is particularly vulnerable to developing a pressure ulcer.

Alternatively, a device which helps a person to avoid decubitus ulcers can comprise: a flexible and breathable (e.g. porous to gas and liquid) upper support surface (e.g. sheet, pad, blanket, net, or mesh) on which a sleeping person lies; a flexible and breathable (e.g. porous to gas and liquid) middle support surface (e.g. sheet, pad, blanket, net, or mesh) below the upper support surface, wherein the middle support surface is suspended between first and second rollers; wherein the middle support surface is automatically moved between the first and second rollers by one or more actuators, wherein the middle support surface has a first surface portion with a first elasticity level and a second surface portion with a second elasticity level, wherein the second elasticity level is greater than the first elasticity level, and wherein the second surface portion is smaller than (and nested within) the first surface portion; and a flexible and breathable (e.g. porous to gas and liquid) lower support surface (e.g. sheet, pad, blanket, net, or mesh) below the middle support surface, wherein the lower support surface is suspended between third and fourth rollers; wherein the lower support surface is automatically moved between the third and fourth rollers, wherein the middle support surface has a third surface portion with a third elasticity level and a fourth surface portion with a fourth elasticity level, wherein the fourth elasticity level is greater than the third elasticity level, wherein the fourth surface portion is smaller than (and nested within) the third surface portion, and wherein middle support surface and the lower support surface are moved so as to overlap the second surface portion and the fourth surface portion, thereby creating a localized surface portion with greater elasticity below a selected part of the sleeping person's body that has a pressure ulcer and/or is particularly vulnerable to developing a pressure ulcer.

For example, a device to help a person in bed to avoid decubitus ulcers can comprise: a flexible and breathable upper support surface on which a sleeping person lies; a flexible and breathable middle support surface below the upper support surface, wherein the middle support surface is automatically moved along a first axis by one or more actuators, wherein the middle support surface has a first surface portion with a first elasticity level and a second surface portion with a second elasticity level, wherein the second elasticity level is greater than the first elasticity level, and wherein the second surface portion is smaller than the first surface portion; and a flexible and breathable lower support surface below the middle support surface, wherein the lower support surface is automatically moved along a second axis by one or more actuators, wherein the second axis is perpendicular to the first axis, wherein the middle support surface has a third surface portion with a third elasticity level and a fourth surface portion with a fourth elasticity level, wherein the fourth elasticity level is greater than the third elasticity level, wherein the fourth surface portion is smaller than the third surface portion, and wherein middle support surface and the lower support surface are moved so as to overlap the second surface portion and the fourth surface portion, thereby creating a localized surface portion with greater elasticity below a selected part of the sleeping person's body that has a pressure ulcer and/or is particularly vulnerable to developing a pressure ulcer.

Alternatively, a device which can help to prevent decubitus ulcers can comprise: a flexible upper support surface on which a sleeping person lies; a flexible middle support surface below the upper support surface, wherein the middle support surface is automatically moved by one or more actuators, wherein the middle support surface has a first surface portion with a first elasticity level and a second surface portion with a second elasticity level, wherein the second elasticity level is greater than the first elasticity level, and wherein the second surface portion is smaller than the first surface portion; and a flexible lower support surface below the middle support surface, wherein the lower support surface is automatically moved by one or more actuators, wherein the middle support surface has a third surface portion with a third elasticity level and a fourth surface portion with a fourth elasticity level, wherein the fourth elasticity level is greater than the third elasticity level, wherein the fourth surface portion is smaller than the third surface portion, and wherein middle support surface and the lower support surface are moved so as to overlap the second surface portion and the fourth surface portion, thereby creating a localized surface portion with greater elasticity below a selected part of the sleeping person's body that has a pressure ulcer and/or is particularly vulnerable to developing a pressure ulcer.

A device to help a person in bed to avoid decubitus ulcers can comprise: a flexible support structure (such as a net, mesh, sling, hammock, pad, sheet, or blanket) on which a person lies; a laterally-moving loop of padding which is under the flexible support structure, wherein the loop comprises an upper portion which moves in a selected lateral direction (e.g. right-to-left or left-to-right) and a lower portion which moves in the opposite lateral direction (e.g. left-to-right or right-to-left); a plurality of actuators which lift the flexible support structure up off the loop of padding, move (and/or rotate) the loop of padding laterally, and then lower the flexible support structure back down onto the loop of padding; and a drying and/or cleaning mechanism which dries and/or cleans the loop of padding as it passes through the lower portion of the loop. Alternatively, a device to help a person in bed to avoid decubitus ulcers can comprise: a flexible support structure (such as a net, mesh, sling, hammock, pad, sheet, or blanket) on which a person lies; a laterally-moving loop of padding which is under the flexible support structure, wherein the loop comprises an upper portion which moves in a selected lateral direction (e.g. right-to-left or left-to-right) and a lower portion which moves in the opposite lateral direction (e.g. left-to-right or right-to-left); a plurality of actuators which lift the flexible support structure up off the loop of padding, move (and/or rotate) the loop of padding laterally, and then lower the flexible support structure back down onto the loop of padding; and a fluffing mechanism which fluffs and/or expands the loop of padding as it passes through the lower portion of the loop.

In another example, a device to help a person in bed to avoid decubitus ulcers can comprise: a flexible support structure (such as a net, mesh, sling, hammock, pad, sheet, or blanket) on which a person lies; a laterally-moving sinusoidal-surface loop of flexible material which is under the flexible support structure, wherein the loop comprises an upper portion which moves in a selected lateral direction (e.g. right-to-left or left-to-right) and a lower portion which moves in the opposite lateral direction (e.g. left-to-right or right-to-left); and a plurality of actuators which lift the flexible support structure up off the loop of flexible material, move (and/or rotate) the loop of flexible material laterally, and then lower the flexible support structure back down onto the loop of flexible material. Alternatively, a device which helps a person in bed avoid decubitus ulcers can comprise: a flexible net, mesh, sling, hammock, pad, sheet, or blanket on which a person lies; a laterally-scrolling loop of padding which is under the upper support structure; and a plurality of actuators; and using at least one actuator to lift the flexible net, mesh, sling, hammock, pad, sheet, or blanket up off the lower support structure; (b) using at least one actuator to scroll the loop of padding laterally, thereby changing which portion of the loop of padding is directly underneath a selected location on the person's body; and then (c) using at least one actuator to lower the flexible net, mesh, sling, hammock, pad, sheet, or blanket back down onto the lower support structure.

In an example, a device to help a person in bed to avoid decubitus ulcers can comprise: a flexible support structure (such as a net, mesh, sling, hammock, pad, sheet, or blanket) on which a person lies; a longitudinally-moving loop of padding which is under the flexible support structure, wherein the loop comprises an upper portion which moves in a selected longitudinal direction (e.g. head-to-toe) and a lower portion which moves in the opposite longitudinal direction (e.g. toe-to-head); a plurality of actuators which lift the flexible support structure up off the loop of padding, move (and/or rotate) the loop of padding longitudinally, and then lower the flexible support structure back down onto the loop of padding; and a drying and/or cleaning mechanism which dries and/or cleans the loop of padding as it passes through the lower portion of the loop. Alternatively, a device which helps a person in bed to avoid decubitus ulcers can comprise: a flexible support structure (such as a net, mesh, sling, hammock, pad, sheet, or blanket) on which a person lies; a longitudinally-moving loop of padding which is under the flexible support structure, wherein the loop comprises an upper portion which moves in a selected longitudinal direction (e.g. head-to-toe or toe-to-head) and a lower portion which moves in the opposite longitudinal direction (e.g. toe-to-head or head-to-toe); a plurality of actuators which lift the flexible support structure up off the loop of padding, move (and/or rotate) the loop of padding longitudinally, and then lower the flexible support structure back down onto the loop of padding; and a fluffing mechanism which fluffs and/or expands the loop of padding as it passes through the lower portion of the loop.

In another example, a device to help a person in bed to avoid decubitus ulcers can comprise: a flexible support structure (such as a net, mesh, sling, hammock, pad, sheet, or blanket) on which a person lies; a longitudinally-moving sinusoidal-surface loop of flexible material which is under the flexible support structure, wherein the loop comprises an upper portion which moves in a selected longitudinal direction (e.g. head-to-toe or toe-to-head) and a lower portion which moves in the opposite longitudinal direction (e.g. toe-to-head or head-to-toe); and a plurality of actuators which lift the flexible support structure up off the loop of flexible material, move (and/or rotate) the loop of flexible material longitudinally, and then lower the flexible support structure back down onto the loop of flexible material. Alternatively, a device which helps a person in bed to avoid decubitus ulcers can comprise: a flexible support structure (such as a net, mesh, sling, hammock, pad, sheet, or blanket) on which a person lies; a longitudinally-moving undulating loop which is under the flexible support structure, wherein the loop comprises an upper portion which moves in a selected longitudinal direction (e.g. head-to-toe) and a lower portion which moves in the opposite longitudinal direction (e.g. toe-to-head); and a plurality of actuators which sequentially lift the flexible support structure up off the loop, move (and/or rotate) the loop longitudinally, and then lower the flexible support structure back down onto the loop.

In another embodiment, a device to help a person in bed to avoid decubitus ulcers can comprise: a flexible support surface (such as a flexible net, mesh, sling, hammock, pad, sheet, or blanket) on which a person lies; a longitudinally-scrolling loop of padding (such as a loop of compressible foam or a loop of compressible textile padding) which is under the upper support structure; two rollers, one roller closer to the head of the support surface and one roller closer to the foot of the support surface, wherein the longitudinally-scrolling loop of padding loops around the two rollers and scrolls longitudinally between the two rollers; and a plurality of actuators; and using at least one actuator to lift the flexible support surface up off the loop of padding; (b) using at least one actuator to scroll the loop of padding longitudinally, thereby changing which portion of the loop of padding is directly underneath a selected location on the person's body; and then (c) using at least one actuator to lower the flexible support surface back down onto the loop of padding. Alternatively, a device to help a person in bed to avoid decubitus ulcers can comprise: a flexible support structure (such as a net, mesh, sling, hammock, pad, sheet, or blanket) on which a person lies; a loop of padding which is under the flexible support structure; a plurality of actuators which lift the flexible support structure up off the loop of padding, move (and/or rotate) the loop of padding (laterally or longitudinally), and then lower the flexible support structure back down onto the loop of padding; and a reconditioning mechanism, wherein the reconditioning mechanism reconditions a portion of the loop of padding at a location where the person's body is not pressing against the loop of padding, and wherein the reconditioning mechanism performs one of more functions selected group the group consisting of: drying or dehumidifying the padding (e.g. using thermal energy); sanitizing or disinfecting the padding (e.g. using light energy or microwave energy); cleaning the padding (e.g. using soap and water; and fluffing or expanding the padding (e.g. using positive or negative air pressure)

For example, a device to help a person in bed to avoid decubitus ulcers can comprise: a flexible net, mesh, sling, hammock, pad, sheet, or blanket on which a person lies; a loop of padding which is under the upper support structure; and a plurality of actuators; and (a) using at least one actuator to lift the flexible net, mesh, sling, hammock, pad, sheet, or blanket up off the lower support structure; (b) using at least one actuator to scroll the loop of padding laterally, thereby changing which portion of the loop of padding is directly underneath a selected location on the person's body; and then (c) using at least one actuator to lower the flexible net, mesh, sling, hammock, pad, sheet, or blanket back down onto the lower support structure. Alternatively, a device which can help to prevent decubitus ulcers can comprise: a mattress on which a person lies; a lower first-side cushion on a first (e.g. right or left) side of the person; an upper first-side cushion which is also on the first side of the person, but above the lower first-side cushion; a lower second-side cushion on a second (e.g. left or right) side of the person; an upper second-side cushion which is also on the second side of the person, but above the lower second-side cushion; wherein the person is turned from lying on their first (e.g. right) side to lying on their second (e.g. left) side by asymmetrically inflating and deflating the cushions.

In another example, a device to help a person in bed to avoid decubitus ulcers can comprise: a mattress on which a person lies; a lower first-side cushion on a first (e.g. right or left) side of the person; an upper first-side cushion which is also on the first side of the person, but above the lower first-side cushion; a lower second-side cushion on a second (e.g. left or right) side of the person; an upper second-side cushion which is also on the second side of the person, but above the lower second-side cushion; wherein the person is turned from lying on their first (e.g. right) side to lying on their second (e.g. left) side by inflating and deflating the cushions, wherein the level of inflation (and deflation) of cushions on the first vs. second sides is asymmetric with respect to a vertical plane midway between them, and wherein the level of inflation (and deflation) of lower vs. upper cushions is asymmetric with respect to a horizontal plane midway between them. Alternatively, a device which helps a person in bed avoid decubitus ulcers can comprise: a mattress on which a person lies; a lower first-side cushion on a first (e.g. right or left) side of the person; an upper first-side cushion which is also on the first side of the person, but above the lower first-side cushion; a lower second-side cushion on a second (e.g. left or right) side of the person; an upper second-side cushion which is also on the second side of the person, but above the lower second-side cushion; wherein the person is turned from lying on their first (e.g. right) side to lying on their second (e.g. left) side by inflating and deflating the cushions, wherein the timing of inflation (and deflation) of cushions on the first vs. second sides is asymmetric with respect to a vertical plane between them, and wherein the timing of inflation (and deflation) of lower vs. upper cushions is asymmetric with respect to a horizontal plane between them.

In an example, a device to help a person in bed to avoid decubitus ulcers can comprise: a mattress on which a person lies; a lower first-side cushion on a first (e.g. right or left) side of the person; an upper first-side cushion which is also on the first side of the person, but above the lower first-side cushion; a lower second-side cushion on a second (e.g. left or right) side of the person; an upper second-side cushion which is also on the second side of the person, but above the lower second-side cushion; wherein the person is turned from lying on their first (e.g. right) side to lying on their second (e.g. left) side by inflating and deflating the cushions, and wherein inflation of the lower cushions holds a first portion of the person's torso in place and inflation of the upper cushions pushes a second portion of the person's torso in a lateral direction, thereby tilting and/or rotating the person's torso. Alternatively, a device which can help to prevent decubitus ulcers can comprise: an upper support structure (such as a flexible net, mesh, sling, hammock, pad, sheet, or blanket) on which a person lies; a lower support structure (such as a loop of soft padding) which is under the upper support structure; and a plurality of actuators; and (a) using at least one actuator to lift the upper support structure up off the lower support structure; (b) using at least one actuator to scroll the lower support structure (laterally or longitudinally), thereby changing which portion of the lower support structure is directly underneath a selected location on the person's body; and then (c) using at least one actuator to lower the upper support structure back down onto the lower support structure.

In another example, a device to help a person in bed to avoid decubitus ulcers can comprise: an upper support surface on which a person lies; a lower support surface below the upper support surface; and a plurality of cushions around the person's torso; wherein the person is turned from lying on one side to the other side by the following sequence—the cushions are inflated, the upper support surface is tilted and/or rotated between 90 and 180 degrees around its longitudinal axis in a first (clockwise or counter-clockwise) direction, and the cushions are deflated. Alternatively, a device to help a person in bed to avoid decubitus ulcers can comprise: an upper support surface on which a person lies; a lower support surface below the upper support surface; and inflatable cushions around the person; wherein first the cushions are inflated around the person, then the upper support surface is tilted and/or rotated at least 135 degrees, and then the cushions are deflated.

A device to help a person in bed to avoid decubitus ulcers can comprise: an upper support surface on which a person lies; a lower support surface below the upper support surface; and inflatable cushions to the right and left of the; wherein first the cushions are inflated on both sides of the person, then the upper support surface is tilted and/or rotated, and then the cushions are deflated. Alternatively, a device which helps a person in bed to avoid decubitus ulcers can comprise: a longitudinal flexible body support surface (such as a net, mesh, pad, sheet, or blanket) on which a person lies; a mattress under the support surface, wherein the mattress further comprises right-side inflatable compartment and a left-side inflatable compartment; and a plurality of actuators; wherein the person is moved from lying on their first (e.g. right) side to lying on their second (e.g. left) side in the following steps (a) lifting the right and left sides of the support surface using the actuators, thereby wrapping the support surface at least partially around the person's torso and lifting the person who was lying on their first (e.g. right) side at least partially up off the mattress; (b) inflating the second side compartment so that the second-side inflatable compartment pushes against the support surface and tilts, pivots, and/or rotates the person's body around a longitudinal axis; and then (c) lowering the right and left sides of the support surface using the actuators, thereby unwrapping the support surface from around the person's torso and lowering the person down onto the mattress lying on their second (e.g. left) side.

In another embodiment, a device to help a person in bed to avoid decubitus ulcers can comprise: an upper support surface on which a sleeping person lies; a middle support surface below the upper support surface, wherein the middle support surface is automatically moved by one or more actuators, wherein the middle support surface has a first surface portion with a first elasticity level and a second surface portion with a second elasticity level, wherein the second elasticity level is greater than the first elasticity level, and wherein the second surface portion is smaller than the first surface portion; and a lower support surface below the middle support surface, wherein the lower support surface is automatically moved by one or more actuators, wherein the middle support surface has a third surface portion with a third elasticity level and a fourth surface portion with a fourth elasticity level, wherein the fourth elasticity level is greater than the third elasticity level, wherein the fourth surface portion is smaller than the third surface portion, and wherein middle support surface and the lower support surface are moved so as to overlap the second surface portion and the fourth surface portion, thereby creating a localized surface portion with greater elasticity below a selected part of the sleeping person's body that has a pressure ulcer and/or is particularly vulnerable to developing a pressure ulcer. Alternatively, a device which can help to prevent decubitus ulcers can comprise: an upper support surface on which a sleeping person lies; a middle support surface below the upper support surface, wherein the middle support surface has a first surface portion with a first elasticity level and a second surface portion with a second elasticity level, wherein the second elasticity level is greater than the first elasticity level, and wherein the second surface portion is smaller than the first surface portion; and a lower support surface below the middle support surface, wherein the middle support surface has a third surface portion with a third elasticity level and a fourth surface portion with a fourth elasticity level, wherein the fourth elasticity level is greater than the third elasticity level, wherein the fourth surface portion is smaller than the third surface portion, and wherein middle support surface and the lower support surface are moved so as to align the second surface portion and the fourth surface portion, thereby creating a localized surface portion with greater elasticity below a selected part of the sleeping person's body that has a pressure ulcer and/or is particularly vulnerable to developing a pressure ulcer.

In another example, a device to help a person in bed to avoid decubitus ulcers can comprise: an upper support surface on which a sleeping person lies; a middle support surface below the upper support surface, wherein the middle support surface has a first surface portion with a first elasticity level and a second surface portion with a second elasticity level, wherein the second elasticity level is greater than the first elasticity level, and wherein the second surface portion is smaller than the first surface portion; and a lower support surface below the middle support surface, wherein the middle support surface has a third surface portion with a third elasticity level and a fourth surface portion with a fourth elasticity level, wherein the fourth elasticity level is greater than the third elasticity level, wherein the fourth surface portion is smaller than the third surface portion, and wherein the middle support surface and the lower support surface are manually moved to align the second surface portion and the fourth surface portion to create a localized area with greater elasticity below a selected part of the sleeping person's body that has a pressure ulcer and/or is particularly vulnerable to developing a pressure ulcer. Alternatively, a device which helps a person in bed to avoid decubitus ulcers can comprise: an upper support surface on which a sleeping person lies; a middle support surface below the upper support surface, wherein the middle support surface has a first surface portion with a first elasticity level and a second surface portion with a second elasticity level, wherein the second elasticity level is greater than the first elasticity level, and wherein the second surface portion is smaller than the first surface portion; and a lower support surface below the middle support surface, wherein the middle support surface has a third surface portion with a third elasticity level and a fourth surface portion with a fourth elasticity level, wherein the fourth elasticity level is greater than the third elasticity level, wherein the fourth surface portion is smaller than the third surface portion, and wherein the middle support surface and the lower support surface are automatically moved to overlap the second surface portion and the fourth surface portion to create a localized area with greater elasticity below a selected part of the sleeping person's body that has a pressure ulcer and/or is particularly vulnerable to developing a pressure ulcer.

For example, a device to help a person in bed to avoid decubitus ulcers can comprise: a flexible support surface (such as a flexible net, mesh, sling, hammock, pad, sheet, or blanket) on which a person lies; a moving layer of padding (such as a layer of compressible foam or textile padding) which is under the upper support structure; and a plurality of actuators; and using at least one actuator to lift the flexible support surface up off the loop of padding; (b) using at least one actuator to shift the layer of padding longitudinally, thereby changing which portion of the layer of padding is directly underneath a selected location on the person's body; and then (c) using at least one actuator to lower the flexible support surface back down onto the layer of padding.

Alternatively, a device to help a person in bed to avoid decubitus ulcers can comprise: a support structure on which a person lies; a plurality of actuators which change the cross-sectional shape of the support structure from flat to concave, or vice versa; a garment worn by the person; and one or more sensors on the garment selected from the group consisting of motion sensor, pressure sensor, and moisture sensor; wherein the plurality of actuators are triggered to change the cross-sectional shape of the support structure from flat to concave, or vice versa, based on data from the one or more sensors.

In another example, a device to help a person in bed to avoid decubitus ulcers can comprise: a support structure on which a person lies; a plurality of actuators which change the cross-sectional shape of the support structure from flat to concave, or vice versa; wherein the plurality of actuators are activated periodically (e.g. wherein the time period is between 1 and 8 hours) to change the cross-sectional shape of the support structure from flat to concave, then tilt and/or rotate the support structure, and then change the cross-sectional shape of the support structure back to flat. Alternatively, a device which helps a person in bed avoid decubitus ulcers can comprise: a support structure (such as a mattress) on which a person lies, wherein the support structure further comprises a concentric array of compressible rings; a plurality of actuators which move the concentric array of compressible rings; a plurality of actuators which moves the concentric array of compressible rings; a garment (or dressing) worn by the person, wherein the garment (or dressing) further comprises at least one electromagnetic energy emitter; and a plurality of electromagnetic energy sensors which are used to determine the location of the at least one electromagnetic energy emitter; wherein the concentric array of compressible rings is moved so that its center is under the at least one electromagnetic energy emitter.

In an example, a device to help a person in bed to avoid decubitus ulcers can comprise: a support structure (such as a mattress) on which a person lies, wherein the support structure further comprises a concentric array of foam rings; a plurality of actuators which move the concentric array of foam rings; a plurality of actuators which move the concentric array of foam rings; a garment (or dressing) worn by the person, wherein the garment (or dressing) further comprises an electromagnetic energy emitter; and a plurality of electromagnetic energy sensors which are used to determine the location of the at least one electromagnetic energy emitter; wherein the concentric array of foam rings is moved so that its center is under the electromagnetic energy emitter. Alternatively, a device which helps a person in bed to avoid decubitus ulcers can comprise: a support structure (such as a mattress) on which a person lies, wherein the support structure further comprises a concentric array of foam rings; a plurality of actuators which move the concentric array of foam rings; and a camera which records infrared images which are analyzed to determine the location of a selected part of the person's body at a selected time; wherein the concentric array of foam rings is moved so that its center is under the selected part of the person's body.

In another embodiment, a device to help a person in bed to avoid decubitus ulcers can comprise: a support structure (such as a mattress) on which a person lies, wherein the support structure further comprises a concentric array of inflated rings; a plurality of actuators which move the concentric array of inflated rings; and a camera which records images which are analyzed to determine the location of a selected part of the person's body at a selected time; wherein the concentric array of inflated rings is moved so that its center is under the selected part of the person's body. Alternatively, a device which can help to prevent decubitus ulcers can comprise: a longitudinal flexible support structure on which a person lies; a plurality of arcuate beams which span laterally over the support structure, wherein the support structure is connected to the arcuate beams at a plurality of movable connections, and wherein the support structure is suspended between the arcuate beams; and a plurality of actuators which move the connections; wherein moving the connections changes the slope and/or shape of the support structure which, in turn, helps the person to move from lying on their first (e.g. right) side to lying on their second (e.g. left) side.

In another example, a device to help a person in bed to avoid decubitus ulcers can comprise: a longitudinal flexible support structure (such as a reinforced sheet, pad, blanket, net, mesh, or sling) on which a person lies; a plurality of beams (or ribs) which laterally span the support structure above the support structure, wherein the support structure is connected to the beams at a plurality of connections which are moved along tracks in the beams (or ribs); and a plurality of actuators which move the connections; wherein moving the connections changes the slope and/or shape of the support structure which, in turn, helps the person to move from lying on their first (e.g. right) side to lying on their second (e.g. left) side. Alternatively, a device to help a person in bed to avoid decubitus ulcers can comprise: a longitudinal flexible support structure on which a person lies; a plurality of beams which span laterally over the support structure, wherein the support structure is connected to the beams at a plurality of movable connections; and a plurality of actuators which move the connections closer together or farther apart in an alternating manner; wherein moving the connections closer together or farther apart in an alternating manner changes the slope and/or shape of the support structure in an alternating manner which, in turn, helps the person to move from lying on their first (e.g. right) side to lying on their second (e.g. left) side by gently lifting the person from lying on their first side and gently lowering them onto their second side.

A device to help a person in bed to avoid decubitus ulcers can comprise: a longitudinal flexible support structure on which a person lies; a plurality of beams which span laterally over the support structure, wherein right and left sides of the support structure are connected to the beams at a plurality of movable connections; and a plurality of actuators which move the connections closer together and farther apart; wherein moving the connections closer together and farther apart changes the slope and/or shape of the support structure in a sequential manner which, in turn, helps the person to move from lying on their first (e.g. right) side to lying on their second (e.g. left) side. Alternatively, a device which helps a person to avoid decubitus ulcers can comprise: a longitudinal flexible support structure on which a person lies; a plurality of beams which span laterally over the support structure, wherein corners of the support structure are connected to the beams at a plurality of movable connections; and a plurality of actuators which move the connections of laterally-aligned corners of the support structure closer together and farther apart; wherein moving these connections closer together partially folds the support structure around the person's body; wherein moving these connections farther apart unfolds the support structure around the person's body; and wherein folding and unfolding the support structure in a sequential manner helps the person to move from lying on their first (e.g. right) side to lying on their second (e.g. left) side.

In another example, a device to help a person in bed to avoid decubitus ulcers can comprise: a longitudinal flexible support structure on which a person lies; a plurality of beams which span laterally over the support structure, wherein corners of the support structure are connected to the beams at a plurality of movable connections; and a plurality of actuators which move the connections of laterally-aligned corners of the support structure; wherein moving these connections changes the slope and/or shape of the support structure which, in turn, helps the person to move from lying on their first (e.g. right) side to lying on their second (e.g. left) side. Alternatively, a device which can help to prevent decubitus ulcers can comprise: a longitudinal flexible support structure on which a person lies; a plurality of beams which span laterally over the support structure, wherein corners (and/or sides) of the support structure are connected to the beams at a plurality of movable connections; and a plurality of actuators which move the connections; wherein the plurality of actuators move the connections in the following three-step sequential manner; firstly, the actuators gently fold the support structure around the person's body as they lie on their first side by moving laterally-aligned corners (and/or sides) of the support structure closer to each other; secondly, the actuators rotate and/or tilt the person's body within the folder support structure by moving both laterally-aligned corners (and/or sides) of the support structure; and then thirdly, the actuators gently unfold the support structure from the person's body, leaving the person lying on their second side.

For example, a device to help a person in bed to avoid decubitus ulcers can comprise: a longitudinal flexible support structure on which a person lies; a plurality of beams which span laterally over the support structure, wherein the support structure is connected to the beams at a plurality of movable connections, and wherein the support structure is suspended between the beams; and a plurality of actuators which move the connections; wherein moving the connections changes the slope and/or shape of the support structure which, in turn, helps the person to move from lying on their first (e.g. right) side to lying on their second (e.g. left) side. Alternatively, a device which helps a person in bed avoid decubitus ulcers can comprise: a longitudinal flexible support structure on which a person lies; a plurality of beams which span laterally over the support structure, wherein the support structure is connected to the beams at a plurality of movable connections; and a plurality of actuators which move the connections; wherein moving the connections enfolds the support structure around the person's body and tilts the person's body from a first configuration lying on their first (e.g. right) side to a second configuration lying on their second (e.g. left) side.

In an example, a device to help a person in bed to avoid decubitus ulcers can comprise: a longitudinal flexible support structure on which a person lies; a plurality of beams which span laterally over the support structure, wherein corners of the support structure are connected to the beams at a plurality of movable connections; and a plurality of actuators which raise and lower the connections; wherein raising or lowering the connections changes the slope and/or shape of the support structure which, in turn, helps the person to move from lying on their first (e.g. right) side to lying on their second (e.g. left) side. Alternatively, a device to help a person in bed to avoid decubitus ulcers can comprise: a support structure on which a person lies, wherein the support structure further comprises a plurality of adjustable portions (e.g. cells, columns, bladders, or compartments) whose sizes and/or shapes can be individually adjusted; a plurality of electromagnetic energy sensors; and a garment (or dressing) which is worn by the person, wherein the garment (or dressing) further comprises an electromagnetic energy emitter, wherein the adjustable portions which are within a selected distance (e.g. between ½" and 6") from the electromagnetic energy emitter at a selected time are identified by the electromagnetic energy sensors, and wherein the sizes and/or shapes of the identified adjustable portions at the selected time are adjusted relative to the sizes and/or shapes of the other adjustable portions.

In another example, a device to help a person in bed to avoid decubitus ulcers can comprise: a support structure on which a person lies, wherein the support structure further comprises a plurality of adjustable portions (e.g. cells, columns, bladders, or compartments) whose sizes and/or shapes can be individually adjusted; a plurality of electromagnetic energy sensors; and a garment (or dressing) which is worn by the person, wherein the garment (or dressing) further comprises at least one electromagnetic energy emitter, wherein the adjustable portions which are below the electromagnetic energy emitter at a selected time are identified by the electromagnetic energy sensors, and wherein the sizes and/or shapes of the adjustable portions near (e.g. within 6" of) the electromagnetic energy emitter at the selected time are adjusted relative to the sizes and/or shapes of the rest of the adjustable portions. Alternatively, a device which can help to prevent decubitus ulcers can comprise: one or more garments which are worn by a person who lies in a bed, wherein the garments further comprise electromagnetic markers on pant legs and torso; a plurality of electromagnetic sensors which detect the locations of the markers; a human-to-computer interface (e.g. voice command interface) which is controlled by the person; a first (robotic) soft support structure (such as a moving sling, pad, or pillow) onto which the person can place their knees; a second (robotic) soft support structure (such as a moving sling, pad, or pillow) onto which the person can place their torso; wherein the first and second soft support structures engage the person's knees and torso if the person gives the appropriate command (via the human-to-computer interface) and the plurality of sensors indicate that the person's knees and torso are properly positioned relative to the first and second soft support structure; and wherein the first and second soft support structures are moved, in an arcuate manner, from a first (right or left) side of the bed to a second (left or right) side of the bed, thereby gently moving the person from lying on their first (e.g. right) side to lying on their second (e.g. left) side at their command.

In an example, a device to help a person in bed to avoid decubitus ulcers can comprise: one or more garments which are worn by a person who lies in a bed, wherein the garments further comprise electromagnetic markers on pant legs and torso; a plurality of electromagnetic sensors which detect the locations of the markers; a human-to-computer interface (e.g. voice command interface) which is controlled by the person; a first soft C-shaped structure into which the person can place their knees; a second soft C-shaped structure into which the person can place their torso; wherein the support structures move (a) if the person gives the appropriate command and (b) if the sensors indicate that the person's knees and torso are properly positioned in the support structures; and wherein the support structures are moved, spanning an arc in 3D space, from a first (right or left) side of the bed to a second (left or right) side of the bed, thereby gently moving the person from lying on their first (e.g. right) side to lying on their second (e.g. left) side at their command. Alternatively, a device which helps a person in bed to avoid decubitus ulcers can comprise: one or more garments which are worn by a person who lies in a bed, wherein the garments further comprise electromagnetic markers on pant legs and torso; a plurality of electromagnetic sensors which detect the locations of the markers; a human-to-computer interface (e.g. voice command interface) which is controlled by the person; a first set of robotic arms which gently engages the person's knees; a second set of robotic arms which gently engage the person's torso; wherein the robotic arms move the person's knees and torso, in an arcuate manner, from a first (right or left) side of the bed to a second (right or left) side of the bed: (a) if the person gives the appropriate command; and (b) if the sensors indicate that the person's knees and torso are properly positioned.

In another example, a device to help a person in bed to avoid decubitus ulcers can comprise: one or more garments which are worn by a person who lies in a bed, wherein the garments further comprise electromagnetic markers on pant legs and shirt sleeves; a plurality of electromagnetic sensors which detect the locations of the markers; a human-to-computer interface (e.g. voice command interface) which is controlled by the person; a first (robotic) soft support structure (such as a moving sling, pad, or pillow) onto which the person can place their knees; a second (robotic) soft support structure (such as a moving sling, pad, or pillow) onto which the person can place their elbows; wherein the first and second soft support structures engage the person's knees and elbows if the person gives the appropriate command (via the human-to-computer interface) and the plurality of sensors indicate that the person's knees and elbows are properly positioned relative to the first and second soft support structure; and wherein the first and second soft support structures are moved, in an arcuate manner, from a first (right or left) side of the bed to a second (left or right) side of the bed, thereby gently moving the person from lying on their first (e.g. right) side to lying on their second (e.g. left) side at their command. Alternatively, a device which helps a person to avoid decubitus ulcers can comprise: one or more garments which are worn by a person who lies in a bed, wherein the garments further comprise electromagnetic markers on pant legs and shirt sleeves; a plurality of electromagnetic sensors which detect the locations of the markers; a human-to-computer interface (e.g. voice command interface) which is controlled by the person; a first sling structure onto which the person can place their knees; a second sling structure onto which the person can place their elbows; wherein the sling structures move (a) if the person gives the appropriate command and (b) if the sensors indicate that the person's knees and elbows are properly positioned in the support structures; and wherein the support structures are moved in arc in 3D space from a first (right or left) side of the bed to a second (left or right) side of the bed, thereby gently moving the person from lying on their first (e.g. right) side to lying on their second (e.g. left) side at their command.

In an example, a device to help a person in bed to avoid decubitus ulcers can comprise: one or more garments which are worn by a person who lies in a bed, wherein the garments further comprise electromagnetic markers on pant legs and shirt sleeves; a plurality of electromagnetic sensors which detect the locations of the markers; a human-to-computer interface (e.g. voice command interface) which is controlled by the person; a first set of robotic arms which gently engages the person's knees; a second set of robotic arms which gently engage the person's elbows; wherein the robotic arms move the person's knees and elbows in a sequence of at least five gradual and limited moves, along an arcuate path in 3D space, from a first (right or left) side of the bed to a second (right or left) side of the bed: (a) if the person gives the appropriate command to continue for each of the five sequential gradual and limited moves; and (b) if the sensors indicate that the person's knees and elbows are properly positioned for each of the five sequential gradual and limited moves. Alternatively, a device to help a person in bed to avoid decubitus ulcers can comprise: a longitudinal flexible support structure on which a person lies; a plurality of lateral beams above the support structure which span the width of the support structure, wherein right and left side corners (or sides or edges) of the support structure are connected to right and left sides, respectively, of the lateral beams; a longitudinal beam which spans longitudinally under a central portion of the support structure and is connected to the longitudinal beam; and a plurality of actuators which move the connections between the support structure and the lateral beams in a sequential manner, which changes the slope and/or shape of the support structure in a sequential manner which, in turn, helps the person to move from lying on their first (e.g. right) side to lying on their second (e.g. left) side; wherein this sequential manner further comprises the following steps: (a) first, actuators fold the support structure partially around the person's body while the person lies on their first side, by moving right side and left side connections closer to each other; (b) second, actuators rotate and/or tilt the support structure, with the person's body enfolded inside it, by jointly moving right side and left side connections to the right or left; and (c) third, actuators unfold the support structure to release the person's body into a position lying on their second side, by moving right and left side connections apart from each other.

For example, a device to help a person in bed to avoid decubitus ulcers can comprise: a plurality of longitudinal fabric strips; a plurality of lateral fabric strips; wherein the longitudinal fabric strips and the lateral fabric strips together create an orthogonal mesh or grid which supports a sleeping person's body; and a plurality of actuators which move (selected) longitudinal fabric strips apart from each other and move (selected) lateral fabric strips apart from each other in order to create an opening (or hole) in the mesh or grid at a selected location; wherein the selected location is located under a portion of the sleeping person's body which has a pressure ulcer or is particularly vulnerable to getting a pressure ulcer. Alternatively, a device which helps a person in bed to avoid decubitus ulcers can comprise: a plurality of longitudinal rods; a plurality of lateral rods; wherein the longitudinal rods and the lateral rods together create an orthogonal mesh or grid which supports a sleeping person's body; and a plurality of actuators which move (selected) longitudinal rods apart from each other and move (selected) lateral rods apart from each other in order to create an opening (or hole) in the mesh or grid at a selected location; wherein the selected location is located under a portion of the sleeping person's body which has a pressure ulcer or is particularly vulnerable to getting a pressure ulcer.

In another example, a device to help a person in bed to avoid decubitus ulcers can comprise: a plurality of longitudinal strips; a plurality of lateral strips; wherein the longitudinal strips and the lateral strips are woven together create an orthogonal mesh or grid which supports a sleeping person's body; and a plurality of actuators which move (selected) longitudinal strips apart and move (selected) lateral strips apart in order to create an opening (or hole) in the mesh or grid at a selected location; wherein the selected location is located under a portion of the sleeping person's body which has a pressure ulcer or is particularly vulnerable to getting a pressure ulcer. Alternatively, a device which can help to prevent decubitus ulcers can comprise: a plurality of porous longitudinal straps; a plurality of porous lateral straps; wherein the longitudinal straps and the lateral straps together create an orthogonal porous mesh or grid which supports a sleeping person's body; and a plurality of actuators which move (selected) longitudinal straps in a lateral manner and move (selected) lateral straps in a longitudinal manner in order to create an opening (or hole) in the mesh or grid at a selected location; wherein the selected location is located under a portion of the sleeping person's body which has a pressure ulcer or is particularly vulnerable to getting a pressure ulcer.

A device to help a person in bed to avoid decubitus ulcers can comprise: a plurality of porous longitudinal strips; a plurality of porous lateral strips; wherein the longitudinal strips and the lateral strips together create an orthogonal porous mesh or grid which supports a sleeping person's body; and a plurality of actuators which move (selected) longitudinal strips to overlap each other and move (selected) lateral strips to overlap each other in order to create an opening (or hole) in the mesh or grid at a selected location; wherein the selected location is located under a portion of the sleeping person's body which has a pressure ulcer or is particularly vulnerable to getting a pressure ulcer. Alternatively, a device which helps a person in bed avoid decubitus ulcers can comprise: a plurality of porous longitudinal strips; a plurality of porous lateral strips; wherein the longitudinal strips and the lateral strips together create an orthogonal porous mesh or grid which supports a sleeping person's body; and a plurality of actuators which move (selected) longitudinal strips away from each other and move (selected) lateral strips away from each other in order to create an opening (or hole) in the mesh or grid at a selected location; wherein the selected location is located under a portion of the sleeping person's body which has a pressure ulcer or is particularly vulnerable to getting a pressure ulcer.

In another example, a device to help a person in bed to avoid decubitus ulcers can comprise: a longitudinal flexible support structure (such as a reinforced sheet, blanket, pad, mesh, net, or sling) on which a person lies; a right side longitudinal beam to the right of the support structure; a left side longitudinal beam to the left of the support structure; and a central longitudinal beam under a central portion of the support structure; wherein the support structure is attached to the right side, left side, and central longitudinal beams; and a plurality of actuators which move the beams in a lateral manner, thereby changing the slope and/or shape of the support structure and helping the person to move from lying on their first (e.g. right) side to lying on their second (e.g. left) side. Alternatively, a device to help a person in bed to avoid decubitus ulcers can comprise: a longitudinal flexible support structure on which a person lies; a right side longitudinal beam to the right of the support structure; a left side longitudinal beam to the left of the support structure; and a central longitudinal beam under a central portion of the support structure; wherein the support structure is attached to the right side, left side, and central longitudinal beams; and a plurality of actuators which move the beams closer together or farther apart in sequential manner, thereby changing the slope and/or shape of the support structure in order to help the person to move from lying on their first (e.g. right) side to lying on their second (e.g. left) side.

In another embodiment, a device to help a person in bed to avoid decubitus ulcers can comprise: a longitudinal flexible support structure on which a person lies; a right-side cushion (or pillow) to the right of the person; a left-side cushion (or pillow) to the left of the person; wherein the right-side and left-side cushions (or pillows) are first asymmetrically moved toward the person, then tilted and/or rotated around their longitudinal axes, and then asymmetrically moved away from the person. Alternatively, a device which can help to prevent decubitus ulcers can comprise: a longitudinal flexible support structure on which a person lies; a right-side inflatable cushion (or pillow); a left-side inflatable cushion (or pillow); wherein the right-side and left-side cushions are asymmetrically inflated during a first period of time; wherein the right-side and left-side cushions are deflated during a second period of time. In another example, a device to help a person in bed to avoid decubitus ulcers can comprise: a longitudinal flexible support structure on which a person lies; a right-side inflatable cushion; a left-side inflatable cushion, wherein the right-side and left-side cushions are inflated during a first period of time, wherein the right-side and left-side cushions are deflated during a second period of time, wherein a first cushion is inflated more than a second cushion during the first period of time, and wherein the first cushion is deflated more than the second cushion during the second period of time. Alternatively, a device which helps a person in bed to avoid decubitus ulcers can comprise: a longitudinal flexible support structure on which a person lies; a right-side inflatable cushion; a left-side inflatable cushion, wherein the right-side and left-side cushions are inflated during a first period of time, wherein the right-side and left-side cushions are deflated during a second period of time, wherein a first cushion is inflated longer than a second cushion during the first period of time, and wherein the second cushion is inflated longer than the first cushion during the second period of time.

In another example, a device to help a person in bed to avoid decubitus ulcers can comprise: a longitudinal flexible support structure on which a person lies; a right-side inflatable lateral-wedge-shaped chamber on the right side of the support structure; a left-side inflatable lateral-wedge-shaped chamber on the left side of the support structure; wherein the right-side and left-side chambers are inflated during a first period of time; wherein the right-side and left-side chambers are deflated during a second period of time; wherein a first chamber on a first selected side is inflated sooner than a second chamber on a second side during the first period of time; and wherein the first chamber is deflated sooner than the second chamber during the second period of time. Alternatively, a device which can help to prevent decubitus ulcers can comprise: a longitudinal flexible support structure on which a person lies; a right-side inflatable longitudinal air compartment on the right side of the support structure; a left-side inflatable longitudinal air compartment on the left side of the support structure; wherein the right-side and left-side air compartments are inflated during a first period of time; wherein the right-side and left-side air compartments are deflated during a second period of time; wherein a first air compartment on a first (right or left) side is inflated more than a second air compartment on a second (left or right) side during the first period of time; and wherein the first air compartment is deflated more than the second air compartment during the second period of time.

For example, a device to help a person in bed to avoid decubitus ulcers can comprise: a longitudinal flexible support structure on which a person lies; a right-side inflatable longitudinal air compartment on the right side of the support structure; a left-side inflatable longitudinal air compartment on the left side of the support structure; wherein the right-side and left-side air compartments are inflated during a first period of time; wherein the right-side and left-side air compartments are deflated during a second period of time; wherein a first air compartment on a first selected side is inflated sooner than a second air compartment on a second side during the first period of time; and wherein the first air compartment is deflated sooner than the second air compartment during the second period of time. Alternatively, a device to help a person in bed to avoid decubitus ulcers can comprise: a longitudinal flexible support structure on which a person lies; a right-side inflatable longitudinal cushion (or chamber) on the right side of the support structure; a left-side inflatable longitudinal cushion (or chamber) on the left side of the support structure; wherein the right-side and left-side cushions are inflated during a first period of time; wherein the right-side and left-side cushions are deflated during a second period of time; wherein a first cushion on a first selected side is inflated more rapidly than a second cushion on a second side during the first period of time; and wherein the first cushion is deflated more rapidly than the second cushion during the second period of time.

In another example, a device to help a person in bed to avoid decubitus ulcers can comprise: a longitudinal flexible support structure on which a person lies; a right-side inflatable longitudinal cushion on the right side of the support structure; a left-side inflatable longitudinal cushion on the left side of the support structure; wherein the right-side and left-side cushions are inflated during a first period of time; wherein the right-side and left-side cushions are deflated during a second period of time; wherein a first cushion on a first selected side is inflated earlier than a second cushion on a second side during the first period of time; and wherein the first cushion is deflated earlier than the second cushion during the second period of time. Alternatively, a device which helps a person in bed to avoid decubitus ulcers can comprise: a longitudinal flexible body support surface (such as a net, mesh, pad, sheet, or blanket) on which a person lies; a right-side inflatable member (such as a compartment, bladder, cushion, or wedge) and a left-side inflatable member (such as a compartment, bladder, cushion, or wedge) under the support surface; a mattress under the support surface; and a plurality of actuators; wherein the person is moved from lying on their first (e.g. right) side to lying on their second (e.g. left) side as follows (a) lifting the right and left edges (or sides) of the support surface using the actuators, thereby wrapping the support surface at least partially around the person's torso and lifting the person who was lying on their first (e.g. right) side at least partially up off the mattress so that the lateral axis of their torso becomes substantially vertical; (b) inflating the right-side and/or left-side inflatable members such that one or both of the inflatable members push against the side of the support surface, thereby tilting, pivoting, and/or rotating the person's body around a longitudinal axis; and then (c) lowering the right and left edges (or sides) of the support surface using the actuators, thereby unwrapping the support surface from being around the person's torso and lowering the person down onto the mattress lying on their second (e.g. left) side.

In another embodiment, a device to help a person in bed to avoid decubitus ulcers can comprise: a longitudinal flexible body support surface (such as a net, mesh, pad, sheet, or blanket) on which a person lies; a right-side inflatable member (such as a compartment, bladder, cushion, or wedge) and a left-side inflatable member (such as a compartment, bladder, cushion, or wedge) under the support surface; a mattress under the support surface; and a plurality of actuators; wherein the person is moved from lying on their first (e.g. right) side to lying on their second (e.g. left) side in the following steps (a) lifting the right and left sides of the support surface using the actuators, thereby wrapping the support surface at least partially around the person's torso and lifting the person who was lying on their first (e.g. right) side at least partially up off the mattress; (b) inflating the second side inflatable member so that the second-side inflatable member pushes against the support surface and tilts, pivots, and/or rotates the person's body around a longitudinal axis; and then (c) lowering the right and left sides of the support surface using the actuators, thereby unwrapping the support surface from around the person's torso and lowering the person down onto the mattress lying on their second (e.g. left) side. Alternatively, a device which helps a person in bed avoid decubitus ulcers can comprise: a longitudinal flexible body support surface (such as a net, mesh, pad, sheet, or blanket) on which a person lies; a right-side inflatable member (such as a compartment, bladder, cushion, or wedge) and a left-side inflatable member (such as a compartment, bladder, cushion, or wedge) under the support surface; a mattress under the support surface; and a plurality of actuators; wherein the person is moved from lying on their first (e.g. right) side to lying on their second (e.g. left) side in the following steps (a) lifting the right and left sides of the support surface using the actuators, thereby wrapping the support surface at least partially around the person's torso and lifting the person who was lying on their first (e.g. right) side at least partially up off the mattress; (b) inflating the second side inflatable member so that the second-side inflatable member pushes against the support surface and tilts, pivots, and/or rotates the person's body around a longitudinal axis; (c) lowering the right and left sides of the support surface using the actuators, thereby unwrapping the support surface from around the person's torso and lowering the person down onto the mattress lying on their second (e.g. left) side; and then (d) deflating the second-side inflatable member.

A device to help a person in bed to avoid decubitus ulcers can comprise: a longitudinal flexible body support surface (such as a net, mesh, pad, sheet, or blanket) on which a person lies; a right-side inflatable wedge and a left-side inflatable wedge under the support surface; and a plurality of actuators; wherein the person is moved from lying on their first (e.g. right) side to lying on their second (e.g. left) side in the following steps (a) lifting the right and left sides of the support surface using the actuators, thereby wrapping the support surface at least partially around the person's torso and lifting the person who was lying on their first (e.g. right) side at least partially up off the mattress; (b) inflating the second side (opposite the first side) inflatable wedge so that the second-side inflatable compartment pushes against the support surface and tilts, pivots, and/or rotates the person's body around a longitudinal axis; (c) lowering the right and left sides of the support surface using the actuators, thereby unwrapping the support surface from around the person's torso and lowering the person down onto the mattress lying on their second (e.g. left) side; and then (d) deflating the second side inflatable wedge. Alternatively, a device which helps a person to avoid decubitus ulcers can comprise: a longitudinal flexible body support surface (such as a net, mesh, pad, sheet, or blanket) on which a person lies; a right-side inflatable wedge and a left-side inflatable wedge under the support surface; and a plurality of actuators; wherein the person is moved from lying on their first (e.g.

right) side to lying on their second (e.g. left) side in the following steps (a) lifting the right and left sides of the support surface using the actuators, thereby wrapping the support surface at least partially around the person's torso and lifting the person who was lying on their first (e.g. right) side at least partially up off the mattress; (b) inflating the second side (opposite the first side) inflatable wedge so that the second-side inflatable compartment pushes against the support surface and tilts, pivots, and/or rotates the person's body around a longitudinal axis; and then (c) lowering the right and left sides of the support surface using the actuators, thereby unwrapping the support surface from around the person's torso and lowering the person down onto the mattress lying on their second (e.g. left) side.

In another example, a device to help a person in bed to avoid decubitus ulcers can comprise: a longitudinal flexible support structure on which a person lies; a right-side inflatable wedge-shaped cushion, wherein the narrower side of the cushion faces toward the person's body; a left-side inflatable wedge-shaped cushion; wherein the narrower side of the cushion faces toward the person's body, wherein the right-side and left-side cushions are inflated during a first period of time, wherein the right-side and left-side cushions are deflated during a second period of time, wherein a first cushion is inflated more than a second cushion during the first period of time, and wherein the first cushion is deflated more than the second cushion during the second period of time. Alternatively, a device to help a person in bed to avoid decubitus ulcers can comprise: a longitudinal flexible support structure on which a person lies; a right-side inflatable wedge-shaped cushion, wherein the narrower side of the cushion faces toward the person's body; a left-side inflatable wedge-shaped cushion; wherein the narrower side of the cushion faces toward the person's body, wherein the right-side and left-side cushions are inflated during a first period of time, wherein the right-side and left-side cushions are deflated during a second period of time, wherein a first cushion is inflated longer than a second cushion during the first period of time, and wherein the second cushion is inflated longer than the first cushion during the second period of time.

In an example, a device to help a person in bed to avoid decubitus ulcers can comprise: a reinforced sheet (or blanket or pad) on which a person lies; a right-side longitudinal beam (or arm) to which the right side of the sheet is attached; a left-side longitudinal beam (or arm) to which the left side of the sheet is attached; a central longitudinal beam (or arm) to which a central longitudinal portion of the sheet is attached; and a plurality of actuators which raise and lower the right-side and left-side longitudinal beams, in a sequential manner, thereby changing the shape of the sheet and helping the person to move from lying on their first (e.g. right) side to lying on their second (e.g. left) side. Alternatively, a device which can help to prevent decubitus ulcers can comprise: a reinforced sheet (or blanket or pad) on which a person lies; a right-side longitudinal beam (or arm) to which the right side of the sheet is attached; a left-side longitudinal beam (or arm) to which the left side of the sheet is attached; a central longitudinal beam (or arm) to which a central longitudinal portion of the sheet is attached; and a plurality of actuators which raise and lower the longitudinal beams, in a sequential manner, thereby changing the shape of the sheet and helping the person to move from lying on their first (e.g. right) side to lying on their second (e.g. left) side.

In another example, a device to help a person in bed to avoid decubitus ulcers can comprise: a reinforced sheet (or blanket or pad) on which a person lies; a right-side longitudinal beam (or arm) to which the right side of the sheet is attached; a left-side longitudinal beam (or arm) to which the left side of the sheet is attached; a central longitudinal beam (or arm) to which a central longitudinal portion of the sheet is attached; and a plurality of actuators which move the right-side and left-side longitudinal beams (or arms) closer together or farther apart, thereby enfolding around a portion of the persons torso, moving the person from lying on their first (e.g. right) side to lying on their second (e.g. left) side, and unfolding from around the portion of the person's torso. Alternatively, a device which helps a person in bed to avoid decubitus ulcers can comprise: a first arcuate beam (or rib) which arcs over the width of a bed on which a person lies; a second arcuate beam (or rib) which arcs over the width of the bed, wherein the first beam is closer to the head of the bed than the second arcuate beam; a concave flexible support structure which is connected to the first beam and to the second beam; wherein the support structure is suspended between the first beam and the second beam; and a plurality of actuators which move the connections between the support structure and the first beam and the second beam, thereby changing the slope and/or shape of the support structure which, in turn, helps the person to turn from lying on their first (e.g. right) side to lying on their second (e.g. left) side.

For example, a device to help a person in bed to avoid decubitus ulcers can comprise: a first body support surface with a first configuration in which it is below a person's (lower) torso and a second configuration in which it is above a person's (lower) torso, wherein the first body support surface is in its first configuration during a first period of time and in its second configuration during a second period of time; a second body support surface with a third configuration in which it is below the person's (lower) torso and a fourth configuration in which it is above the person's (lower) torso, wherein the second body support surface is in its fourth configuration during the first period of time and in its third configuration during the second period of time; and a plurality of actuators, wherein the actuators decrease the distance between the first and second body support surfaces, then rotate the first body support surface from its first configuration to its second configuration and rotate the second body support surface from its fourth configuration to its third configuration, and then increase the distance between the first and second body support surfaces. Alternatively, a device which can help to prevent decubitus ulcers can comprise: a first inflated support surface with a first configuration in which it is below a person's (lower) torso and a second configuration in which it is above a person's (lower) torso, wherein the first support surface is in its first configuration during a first period of time and in its second configuration during a second period of time; a second inflated support surface with a third configuration in which it is below the person's (lower) torso and a fourth configuration in which it is above the person's (lower) torso, wherein the second support surface is in its fourth configuration during the first period of time and in its third configuration during the second period of time; and a plurality of actuators; wherein a person is turned from lying on their first (e.g. right or left) side to lying on their second (e.g. left or right side) in the following manner—the first and/or second support surfaces are inflated; the actuators rotate the first body support surface from its first configuration to its second configuration and rotate the second body support surface from its fourth configuration to its third configuration, and the first and/or second support surfaces are deflated.

In another embodiment, a device to help a person in bed to avoid decubitus ulcers can comprise: a first pivoting (and/or rotating) conic-section-shaped rib which spans from a first pivot joint at the foot of a bed to a second pivot joint at the head of the bed, wherein the first pivoting conic-section-shaped rib has a concave shape which opens toward the bed mattress, wherein the first pivoting conic-section-shaped rib has a first configuration in which it spans (from the foot of the bed to the head of the bed) around a portion of the perimeter of the bed mattress and the plane of its concavity is substantially horizontal, wherein the first pivoting conic-section-shaped rib has a second configuration in which it spans (from the foot of the bed to the head of the bed) over the bed mattress and the plane of its concavity is substantially vertical, and wherein the first pivoting conic-section-shaped rib is manually (or automatically using at least one actuator) pivoted (and/or rotated) from its first configuration to its second configuration, or vice versa; a second pivoting (and/or rotating) conic-section-shaped rib which spans from the first pivot joint at the foot of a bed to the second pivot joint at the head of the bed, wherein the second pivoting conic-section-shaped rib has a concave shape which opens toward the bed mattress, wherein the second pivoting conic-section-shaped rib has a third configuration in which it spans (from the foot of the bed to the head of the bed) around a portion of the perimeter of the bed mattress and the plane of its concavity is substantially horizontal, wherein the second pivoting conic-section-shaped rib has a fourth configuration in which it spans (from the foot of the bed to the head of the bed) over the bed mattress and the plane of its concavity intersects a horizontal plane at an angle greater than 45 degrees, and wherein the second pivoting conic-section-shaped rib is manually (or automatically using at least one actuator) pivoted (and/or rotated) from its third configuration to its fourth configuration, or vice versa; and a flexible support structure (e.g. reinforced sheet, blanket, pad, net, mesh, strap, or sling) on which a person lies, wherein a first (e.g. right or left) side of the support structure is attached to the first pivoting conic-section-shaped rib and a second (e.g. left or right) side of the support structure is attached to the second pivoting conic-section-shaped rib, and wherein changing the first pivoting conic-section-shaped rib from its first configuration to its second configuration (or vice versa) and changing the second pivoting conic-section-shaped rib from its third configuration to its fourth configuration (or vice versa) assists in turning (or automatically turns) the person from lying on their first (e.g. right or left) side to lying on their second (e.g. left or right) side.

Alternatively, a device to help a person in bed to avoid decubitus ulcers can comprise: a first pivoting (and/or rotating) rib which curves from a pivot joint at the foot of a bed to a pivot joint at the head of the bed, wherein the first pivoting rib has a first configuration in which it curves around a first (e.g. right or left) side of the bed mattress, wherein the first pivoting rib has a second configuration in which it curves over the bed mattress, and wherein the first pivoting rib is manually (or automatically using at least one actuator) pivoted (and/or rotated) from its first configuration to its second configuration, or vice versa; a second pivoting (and/or rotating) rib which curves from a pivot joint at the foot of a bed to a pivot joint at the head of the bed, wherein the second pivoting rib has a third configuration in which it curves around a second (e.g. left or right) side of the bed mattress, wherein the second pivoting rib has a fourth configuration in which it curves over the bed mattress, and wherein the second pivoting rib is manually (or automatically using at least one actuator) pivoted (and/or rotated) from its third configuration to its fourth configuration, or vice versa; and a flexible support structure (e.g. reinforced sheet, blanket, pad, net, mesh, strap, or sling) on which a person lies, wherein a first (e.g. right or left) side of the support structure is attached to the first pivoting rib and a second (e.g. left or right) side of the support structure is attached to the second pivoting rib, and wherein changing the first pivoting rib from its first configuration to its second configuration (or vice versa) and changing the second pivoting rib from its third configuration to its fourth configuration (or vice versa) assists in turning (or automatically turns) the person from lying on their first (e.g. right or left) side to lying on their second (e.g. left or right) side.

In another example, a device to help a person in bed to avoid decubitus ulcers can comprise: a first pivoting (and/or rotating) rib which spans from a (laterally-central) pivot joint at the foot of a bed to a (laterally-central) pivot joint at the head of the bed, wherein the first pivoting rib has a concave shape which opens toward the bed mattress, wherein the first pivoting rib has a first configuration in which it spans (from the foot of the bed to the head of the bed) around a portion of the perimeter of the bed mattress and the plane of its concavity is substantially horizontal, wherein the first pivoting rib has a second configuration in which it spans (from the foot of the bed to the head of the bed) over the bed mattress and the plane of its concavity is substantially vertical, and wherein the first pivoting rib is manually (or automatically using at least one actuator) pivoted (and/or rotated) from its first configuration to its second configuration, or vice versa; a second pivoting (and/or rotating) rib which spans from a (laterally-central) pivot joint at the foot of a bed to a (laterally-central) pivot joint at the head of the bed, wherein the second pivoting rib has a concave shape which opens toward the bed mattress, wherein the second pivoting rib has a third configuration in which it spans (from the foot of the bed to the head of the bed) around a portion of the perimeter of the bed mattress and the plane of its concavity is substantially horizontal, wherein the second pivoting rib has a fourth configuration in which it spans (from the foot of the bed to the head of the bed) over the bed mattress and the plane of its concavity intersects a horizontal plane at an angle greater than 45 degrees, and wherein the second pivoting rib is manually (or automatically using at least one actuator) pivoted (and/or rotated) from its third configuration to its fourth configuration, or vice versa; and a flexible support structure (e.g. reinforced sheet, blanket, pad, net, mesh, strap, or sling) on which a person lies, wherein a first (e.g. right or left) side of the support structure is attached to the first pivoting rib and a second (e.g. left or right) side of the support structure is attached to the second pivoting rib, and wherein changing the first pivoting rib from its first configuration to its second configuration (or vice versa) and changing the second pivoting rib from its third configuration to its fourth configuration (or vice versa) assists in turning (or automatically turns) the person from lying on their first (e.g. right or left) side to lying on their second (e.g. left or right) side.

Alternatively, a device which helps a person in bed to avoid decubitus ulcers can comprise: a first pivoting (and/or rotating) rib which spans from a pivot joint at the foot of a bed to a pivot joint at the head of the bed, wherein the first pivoting rib has a concavity which opens toward the bed mattress, wherein the first pivoting rib has a first configuration in which it spans around a first (e.g. right or left) side of the bed mattress and the plane of its concavity is substantially horizontal, wherein the first pivoting rib has a second configuration in which it spans over the bed mattress and the plane of its concavity is substantially vertical, and wherein the first pivoting rib is manually (or automatically using at least one actuator) pivoted (and/or rotated) from its first configuration to its second configuration, or vice versa; a second pivoting (and/or rotating) rib which spans from a pivot joint at the foot of a bed to a second pivot joint at the head of the bed, wherein the second pivoting rib has a concavity which opens toward the bed mattress, wherein the second pivoting rib has a third configuration in which it spans around a second (e.g. left or right) side of the bed mattress and the plane of its concavity is substantially horizontal, wherein the second pivoting rib has a fourth configuration in which it spans over the bed mattress and the plane of its concavity intersects a horizontal plane at an angle greater than 45 degrees, and wherein the second pivoting rib is manually (or automatically using at least one actuator) pivoted (and/or rotated) from its third configuration to its fourth configuration, or vice versa; and a flexible support structure (e.g. reinforced sheet, blanket, pad, net, mesh, strap, or sling) on which a person lies, wherein a first (e.g. right or left) side of the support structure is attached to the first pivoting rib and a second (e.g. left or right) side of the support structure is attached to the second pivoting rib, and wherein changing the first pivoting rib from its first configuration to its second configuration (or vice versa) and changing the second pivoting rib from its third configuration to its fourth configuration (or vice versa) assists in turning (or automatically turns) the person from lying on their first (e.g. right or left) side to lying on their second (e.g. left or right) side.

In an example, a device to help a person in bed to avoid decubitus ulcers can comprise: a first pivoting (and/or rotating) rib which spans from a pivot joint at the foot of a bed to a pivot joint at the head of the bed, wherein the first pivoting rib has a concavity which opens toward the bed mattress, wherein the first pivoting rib has a first configuration in which it spans around a first (e.g. right or left) side of the bed mattress, wherein the first pivoting rib has a second configuration in which it spans over the bed mattress, and wherein the first pivoting rib is manually (or automatically using at least one actuator) pivoted (and/or rotated) from its first configuration to its second configuration, or vice versa; a second pivoting (and/or rotating) rib which spans from a pivot joint at the foot of a bed to a second pivot joint at the head of the bed, wherein the second pivoting rib has a concavity which opens toward the bed mattress, wherein the second pivoting rib has a third configuration in which it spans around a second (e.g. left or right) side of the bed mattress, wherein the second pivoting rib has a fourth configuration in which it spans over the bed mattress, and wherein the second pivoting rib is manually (or automatically using at least one actuator) pivoted (and/or rotated) from its third configuration to its fourth configuration, or vice versa; and a flexible support structure (e.g. reinforced sheet, blanket, pad, net, mesh, strap, or sling) on which a person lies, wherein a first (e.g. right or left) side of the support structure is attached to the first pivoting rib and a second (e.g. left or right) side of the support structure is attached to the second pivoting rib, and wherein changing the first pivoting rib from its first configuration to its second configuration (or vice versa) and changing the second pivoting rib from its third configuration to its fourth configuration (or vice versa) assists in turning (or automatically turns) the person from lying on their first (e.g. right or left) side to lying on their second (e.g. left or right) side.

Alternatively, a device which can help to prevent decubitus ulcers can comprise: a first pivoting (and/or rotating) rib which spans from a pivot joint on a first (e.g. right or left) side of the foot of a bed to a pivot joint on the first side of the head of the bed, wherein the first pivoting rib has a concavity which opens toward the bed mattress, wherein the first pivoting rib has a first configuration in which it spans around a first (e.g. right or left) side of the bed mattress, wherein the first pivoting rib has a second configuration in which it spans over the bed mattress, and wherein the first pivoting rib is manually (or automatically using at least one actuator) pivoted (and/or rotated) from its first configuration to its second configuration, or vice versa; a second pivoting (and/or rotating) rib which spans from a pivot joint on a second (e.g. left or right) side of the foot of a bed to a pivot joint on the second side of the head of the bed, wherein the second pivoting rib has a concavity which opens toward the bed mattress, wherein the second pivoting rib has a third configuration in which it spans around a second (e.g. left or right) side of the bed mattress, wherein the second pivoting rib has a fourth configuration in which it spans over the bed mattress, and wherein the second pivoting rib is manually (or automatically using at least one actuator) pivoted (and/or rotated) from its third configuration to its fourth configuration, or vice versa; and a flexible support structure (e.g. reinforced sheet, blanket, pad, net, mesh, strap, or sling) on which a person lies, wherein a first (e.g. right or left) side of the support structure is attached to the first pivoting rib and a second (e.g. left or right) side of the support structure is attached to the second pivoting rib, and wherein changing the first pivoting rib from its first configuration to its second configuration (or vice versa) and changing the second pivoting rib from its third configuration to its fourth configuration (or vice versa) assists in turning (or automatically turns) the person from lying on their first (e.g. right or left) side to lying on their second (e.g. left or right) side.

In another example, a device to help a person in bed to avoid decubitus ulcers can comprise: a first pivoting (and/or rotating) rib which spans from a rotating joint at the foot of a bed to a rotating joint at the head of the bed, wherein the first pivoting rib has a concavity which opens toward a bed mattress, wherein the first pivoting rib has a first configuration in which it spans around a first (e.g. right or left) side of the bed mattress, wherein the first pivoting rib has a second configuration in which it spans over the bed mattress, and wherein the first pivoting rib is manually (or automatically using at least one actuator) pivoted (and/or rotated) from its first configuration to its second configuration, or vice versa; a second pivoting (and/or rotating) rib which spans from a rotating joint at the foot of a bed to a rotating joint at the head of the bed, wherein the second pivoting rib has a concavity which opens toward the bed mattress, wherein the second pivoting rib has a third configuration in which it spans around a second (e.g. left or right) side of the bed mattress, wherein the second pivoting rib has a fourth configuration in which it spans over the bed mattress, and wherein the second pivoting rib is manually (or automatically using at least one actuator) pivoted (and/or rotated) from its third configuration to its fourth configuration, or vice versa, and wherein the second pivoting rib is symmetric (relative to the central longitudinal axis of the bed) to the first pivoting rib when the first pivoting rib is in its first configuration and the second pivoting rib is in its third configuration; and a flexible support structure (e.g. reinforced sheet, blanket, pad, net, mesh, strap, or sling) on which a person lies, wherein a first (e.g. right or left) side of the support structure is attached to the first pivoting rib and a second (e.g. left or right) side of the support structure is attached to the second pivoting rib, and wherein changing the first pivoting rib from its first configuration to its second configuration (or vice versa) and changing the second pivoting rib from its third configuration to its fourth configuration (or vice versa) assists in turning (or automatically turns) the person from lying on their first (e.g. right or left) side to lying on their second (e.g. left or right) side.

Alternatively, a device which helps a person in bed avoid decubitus ulcers can comprise: a first pivoting (and/or rotating) sinusoidal rib which spans from a first pivot joint at the foot of a bed to a second pivot joint at the head of the bed, wherein the first pivoting sinusoidal rib has a concave shape which opens toward the bed mattress, wherein the first pivoting sinusoidal rib has a first configuration in which it spans (from the foot of the bed to the head of the bed) around a portion of the perimeter of the bed mattress and the plane of its concavity is substantially horizontal, wherein the first pivoting sinusoidal rib has a second configuration in which it spans (from the foot of the bed to the head of the bed) over the bed mattress and the plane of its concavity is substantially vertical, and wherein the first pivoting sinusoidal rib is manually (or automatically using at least one actuator) pivoted (and/or rotated) from its first configuration to its second configuration, or vice versa; a second pivoting (and/or rotating) sinusoidal rib which spans from the first pivot joint at the foot of a bed to the second pivot joint at the head of the bed, wherein the second pivoting sinusoidal rib has a concave shape which opens toward the bed mattress, wherein the second pivoting sinusoidal rib has a third configuration in which it spans (from the foot of the bed to the head of the bed) around a portion of the perimeter of the bed mattress and the plane of its concavity is substantially horizontal, wherein the second pivoting sinusoidal rib has a fourth configuration in which it spans (from the foot of the bed to the head of the bed) over the bed mattress and the plane of its concavity intersects a horizontal plane at an angle greater than 45 degrees, and wherein the second pivoting sinusoidal rib is manually (or automatically using at least one actuator) pivoted (and/or rotated) from its third configuration to its fourth configuration, or vice versa; and a flexible support structure (e.g. reinforced sheet, blanket, pad, net, mesh, strap, or sling) on which a person lies, wherein a first (e.g. right or left) side of the support structure is attached to the first pivoting sinusoidal rib and a second (e.g. left or right) side of the support structure is attached to the second pivoting sinusoidal rib, and wherein changing the first pivoting sinusoidal rib from its first configuration to its second configuration (or vice versa) and changing the second pivoting sinusoidal rib from its third configuration to its fourth configuration (or vice versa) assists in turning (or automatically turns) the person from lying on their first (e.g. right or left) side to lying on their second (e.g. left or right) side.

A device to help a person in bed to avoid decubitus ulcers can comprise: a first plurality of parallel flexible strips; a second plurality of parallel flexible strips; a third plurality of parallel flexible strips; wherein the first, second, and third pluralities of parallel flexible strips are woven together to create a hexagonal mesh or grid which supports a sleeping person's body; and a plurality of actuators which move selected strips apart from each other in order to create a hexagonal-shaped opening in the mesh or grid at a selected location; wherein the selected location is located under a portion of the sleeping person's body which has a pressure ulcer or is particularly vulnerable to getting a pressure ulcer. Alternatively, a device to help a person in bed to avoid decubitus ulcers can comprise: a first plurality of parallel flexible strips; a second plurality of parallel flexible strips; wherein the first and second pluralities of parallel flexible strips are woven together to create an orthogonal mesh or grid which supports a sleeping person's body; and a plurality of actuators which move selected strips apart from each other in order to create a quadrilateral-shaped opening in the mesh or grid at a selected location; wherein the selected location is located under a portion of the sleeping person's body which has a pressure ulcer or is particularly vulnerable to getting a pressure ulcer.

For example, a device to help a person in bed to avoid decubitus ulcers can comprise: a first roller (or tube) at the head a bed (or bed mattress); a second roller (or tube) at the foot of the bed; one or more actuators; and a plurality of moving loops, wherein an upper portion of each loop spans the length of the bed between the rollers in a first direction; wherein a lower portion of each moving loop spans the length of the bed between the rollers in a second direction; and wherein each loop is rotated around the rollers by the one or more actuators. Alternatively, a device which helps a person in bed to avoid decubitus ulcers can comprise: a first roller (or tube) at the head a bed (or bed mattress); a second roller (or tube) at the foot of the bed; one or more actuators; and a plurality of moving undulating loops, wherein each loop has longitudinal undulation in thickness, wherein an upper portion of each loop spans the length of the bed between the rollers in a first direction; wherein a lower portion of each moving loop spans the length of the bed between the rollers in a second direction; and wherein each loop is rotated around the rollers by the one or more actuators.

In another example, a device to help a person in bed to avoid decubitus ulcers can comprise: a first roller (or tube) at the head a bed (or bed mattress); a second roller (or tube) at the foot of the bed; one or more actuators; and a plurality of moving loops, wherein an upper portion of each loop spans the length of the bed between the rollers in a first direction; wherein a lower portion of each moving loop spans the length of the bed between the rollers in a second direction; wherein each loop is rotated around the rollers by the one or more actuators; and wherein different loops are moved and/or rotated in different directions. Alternatively, a device which helps a person to avoid decubitus ulcers can comprise: a first roller (or tube) at the head a bed (or bed mattress); a second roller (or tube) at the foot of the bed; one or more actuators; and a plurality of moving undulating loops, wherein each loop has longitudinal undulation in thickness, wherein an upper portion of each loop spans the length of the bed between the rollers in a first direction; wherein a lower portion of each moving loop spans the length of the bed between the rollers in a second direction; wherein each loop is rotated around the rollers by the one or more actuators; and wherein different loops are moved and/or rotated in different directions.

In an example, a device to help a person in bed to avoid decubitus ulcers can comprise: a first roller (or tube) at the head a bed (or bed mattress); a second roller (or tube) at the foot of the bed; one or more actuators; and a plurality of moving loops, wherein an upper portion of each loop spans the length of the bed between the rollers in a first direction; wherein a lower portion of each moving loop spans the length of the bed between the rollers in a second direction; wherein each loop is rotated around the rollers by the one or more actuators; and wherein adjacent loops are moved and/or rotated in opposite longitudinal directions. Alternatively, a device which can help to prevent decubitus ulcers can comprise: a first roller (or tube) at the head a bed (or bed mattress); a second roller (or tube) at the foot of the bed; one or more actuators; and a plurality of moving undulating loops, wherein each loop has longitudinal undulation in thickness, wherein an upper portion of each loop spans the length of the bed between the rollers in a first direction; wherein a lower portion of each moving loop spans the length of the bed between the rollers in a second direction; wherein each loop is rotated around the rollers by the one or more actuators; and wherein adjacent loops are moved and/or rotated in opposite longitudinal directions.

In another example, a device to help a person in bed to avoid decubitus ulcers can comprise: a first roller (or tube) on a first (e.g. right) side of a bed (or bed mattress); a second roller (or tube) on a second (e.g. left) side of the bed; one or more actuators; and a plurality of moving loops, wherein an upper portion of each loop spans the width of the bed between the rollers in a first direction; wherein a lower portion of each moving loop spans the width of the bed between the rollers in a second direction; and wherein each loop is rotated around the rollers by the one or more actuators. Alternatively, a device to help a person in bed to avoid decubitus ulcers can comprise: a first roller (or tube) on a first (e.g. right) side of a bed (or bed mattress); a second roller (or tube) on a second (e.g. left) side of the bed; one or more actuators; and a plurality of moving undulating loops, wherein each loop has lateral undulation in thickness, wherein an upper portion of each loop spans the width of the bed between the rollers in a first direction; wherein a lower portion of each moving loop spans the width of the bed between the rollers in a second direction; and wherein each loop is rotated around the rollers by the one or more actuators.

In an example, a device to help a person in bed to avoid decubitus ulcers can comprise: a first roller (or tube) on a first (e.g. right) side of a bed (or bed mattress); a second roller (or tube) on a second (e.g. left) side of the bed; one or more actuators; and a plurality of moving loops, wherein an upper portion of each loop spans the width of the bed between the rollers in a first direction; wherein a lower portion of each moving loop spans the width of the bed between the rollers in a second direction; wherein each loop is rotated around the rollers by the one or more actuators; and wherein different loops are moved and/or rotated in different directions. Alternatively, a device which helps a person in bed avoid decubitus ulcers can comprise: a first roller (or tube) on a first (e.g. right) side of a bed (or bed mattress); a second roller (or tube) on a second (e.g. left) side of the bed; one or more actuators; and a plurality of moving undulating loops, wherein each loop has lateral undulation in thickness, wherein an upper portion of each loop spans the width of the bed between the rollers in a first direction; wherein a lower portion of each moving loop spans the width of the bed between the rollers in a second direction; wherein each loop is rotated around the rollers by the one or more actuators; and wherein different loops are moved and/or rotated in different directions.

I claim:

1. A device which helps a patient in bed to avoid decubitus ulcers comprising:

a longitudinal flexible body support structure on which a patient lies; wherein the support structure is selected from the group consisting of a sheet, blanket, pad, net, mesh, and hammock;

wherein the support structure has a first configuration in which the support structure is substantially flat;

wherein the support structure has a second configuration in which first and second edges of the support structure are higher than in the first configuration, wherein the support structure is folded along a longitudinal axis, and wherein the support structure has an upward-facing concavity which is wrapped at least partially around the patient's body;

two or more lateral beams, ribs, or arches; wherein each beam, rib, or arch curves over the support structure from a first side of the support structure to an opposite side of the support structure; and wherein the first side is a right side or a left side;

a plurality of movable connectors which connect the support structure to the lateral beams, ribs, or arches; and a plurality of actuators which move the movable connectors laterally along the lateral beams, ribs, or arches; wherein moving the movable connectors along the lateral beams, ribs, or arches changes the support structure from the first configuration to the second configuration, or vice versa.

* * * * *